US005263532A

United States Patent [19]

Kawaguchi et al.

[11] Patent Number: 5,263,532

[45] Date of Patent: Nov. 23, 1993

[54] MOLD CASTING PROCESS AND APPARATUS AND METHOD FOR PRODUCING MECHANICAL PARTS

[75] Inventors: Masatoshi Kawaguchi; Norio Tajima; Setsumi Hatanaka; Hiroshi Yoshinaga; Masahiro Inoue; Tadao Nagaoka; Hiromu Okunishi; Masaaki Kurosawa; Hideaki Ikeda; Takeshi Ooba; Nobuki Matsuo; Hiroshi Onda, all of Sayama, Japan

[73] Assignee: Honda Giken Kogyo Kabushiki Kaisha, Tokyo, Japan

[21] Appl. No.: 769,323

[22] Filed: Sep. 30, 1991

Related U.S. Application Data

[60] Continuation of Ser. No. 583,948, Sep. 17, 1990, which is a division of Ser. No. 143,625, Jan. 13, 1988, Pat. No. 4,971,134.

[30] Foreign Application Priority Data

| | | | |
|---|---|---|---|
| Jan. 12, 1987 | [JP] | Japan | 62-4629 |
| Jan. 12, 1987 | [JP] | Japan | 62-4630 |
| Feb. 12, 1987 | [JP] | Japan | 62-19077 |
| Jul. 22, 1987 | [JP] | Japan | 62-183151 |
| Aug. 6, 1987 | [JP] | Japan | 62-120636 |
| Aug. 21, 1987 | [JP] | Japan | 62-207944 |
| Sep. 18, 1987 | [JP] | Japan | 62-234640 |
| Sep. 18, 1987 | [JP] | Japan | 62-234641 |
| Sep. 21, 1987 | [JP] | Japan | 62-236598 |

[51] Int. Cl.[5] ..... B22D 27/04; B22D 15/04; B22D 43/00

[52] U.S. Cl. ..... 164/154; 164/342; 164/305

[58] Field of Search ..... 164/122, 125, 127, 120, 164/134, 154, 305, 342, 410

[56] References Cited

U.S. PATENT DOCUMENTS

| | | | |
|---|---|---|---|
| 3,542,330 | 11/1970 | Wirtz | 164/305 |
| 3,752,213 | 8/1973 | Miki | 164/125 |
| 3,822,857 | 7/1974 | Tanie | 164/410 |
| 4,033,401 | 7/1977 | Wlodawer | 164/121 |
| 4,162,700 | 7/1979 | Kahn | 164/154 |
| 4,671,342 | 6/1987 | Balevski | 164/154 |

FOREIGN PATENT DOCUMENTS

| | | | |
|---|---|---|---|
| 2402893 | 8/1974 | Fed. Rep. of Germany | 164/122 |
| 209463 | 12/1983 | Japan | 164/120 |
| 1229462 | 10/1986 | Japan | 164/134 |
| 0033054 | 2/1987 | Japan | 164/154 |
| 620334 | 8/1978 | U.S.S.R. | 164/122 |

*Primary Examiner*—Mark Rosenbaum
*Assistant Examiner*—Erik R. Puknys
*Attorney, Agent, or Firm*—Ladas & Parry

[57] ABSTRACT

A mold casting process comprises, after pouring of a molten metal into a mold, rapidly cooling that surface layer of a cast product which is in contact with a mold, and releasing the resulting product from the mold when the surface layer thereof has been converted into a shell-like solidified layer. Such process is used for casting a mechanical part blank and apparatus for carrying out the process is provided.

9 Claims, 47 Drawing Sheets

MOLD CASTING PROCESS AND APPARATUS AND METHOD FOR PRODUCING MECHANICAL PARTS

This is a continuation of copending application Ser. No. 07/583,948 filed on Sep. 17, 1990, which in turn is a division of Ser. No. 07/143,625 filed Jan. 13, 1988 now Pat. No. 4,971,134.

BACKGROUND OF THE INVENTION

1. Field of the Invention

The present invention relates to a mold casting process and a mold casting apparatus used for carrying out the process, as well as a method for producing mechanical parts by application of the mold casting process.

2. Description of the Prior Art

There is conventionally known a mold casting process wherein a temperature gradient is applied to a mold to provide a directional solidification, but timing for releasing a casting from the mold is not considered in any way (see Japanese Utility Model Application Laid-open No. 82746/86).

When a cast product is obtained by a casting process using a mold in order to improve the productivity thereof, the following problems are encountered: Due to a high heat transfer coefficient of the mold and the form of the product, the solidification and shrinkage of the cast product is partially greatly accelerated, so that a portion of the product is restrained by the mold, resulting in thermal cracking of the product and damage such as deformation and wearing of the mold.

To provide a product free from casting defects such as cavities, it is necessary to take corresponding measures, but no special measures have been taken in the prior art.

In achieving a product including a first formed portion of a harder structure and a second formed portion of a softer structure in a casting process using a mold, a procedure used in the prior art is to rapidly cool a first formed portion shaping region of the mold with cooling water and to prevent rapid cooling of a second formed portion shaping region of the mold by a block formed of a material such as a shell sand.

The prior art process is accompanied by the following problem: Thermal insulation between the first and second formed portions is not taken into account positively and for this reason, heat transfer take place therebetween, and the manner of such heat transfer is not even. Thus, the structures of the both formed portions are widely different from the intended structure.

With a cast product having a thinner portion and a thicker portion integral with the thinner portion, there is a problem that the cooling rates for both portions are different from each other and hence, releasing a resulting product from a mold at a timing suitable for the thinner portion results in that the thicker portion cannot have a sufficient shape retainability at the time of release, whereas releasing the resulting product at a timing suitable for the thicker portion leads to the possibility of producing thermal cracking in the thinner portion.

Further, in producing a mechanical part blank in a casting process using a mold, it is necessary to correct its shape when a deformation, a bend or the like are produced in the resulting mechanical part blank released from the mold. However, the mechanical part blank after being cooled has a small ductility and hence, a large-sized shape correcting or setting device having a higher pressing force must be provided, resulting in an increase in cost of equipment and in addition, a cracking or the like may be produced, resulting in a defective product.

Yet further, in efficiently producing a high strength cast product having a fine structure through a rapid solidification of a molten metal utilizing a high heat transfer coefficient of a mold, it is required to increase the pouring rate in order to prevent a failure of running of the molten metal. However, increasing the pouring rate only produces casting defects such as cavities and pin holes in the resulting product, because the molten metal is liable to include slag and gas thereinto. In addition, even if a slag removing portion is provided in a molten metal passage communicating with a cavity, a slag removing effect is less achieved, because the molten metal within the slag removing portion may be rapidly solidified to form a solidified layer.

There is also known a mold comprising a convex shaping portion to form a recess in a resulting product, and in such conventional known mold, its body and convex shaping portion are integrally formed of the same material (see Japanese Patent Application Laid-open No. 8382/80).

The aforesaid convex shaping portion may be worn by the flow of molten metal or damaged due to an adhesion force of the cast product attendant upon the solidification and shrinkage thereof. For this reason, if the mold body and the convex shaping portion are integrally formed as described above, a repairing operation on a large scale must be carried out for providing a padding by welding, a machine working or the like to the mold body. Such repairing operation is very troublesome and brings about a reduction in production efficiency.

Moreover, to prevent the trapping of gas into a molten metal, it is a conventional practice to provide a vent hole opened into a cavity in a mold, or to provide a gas venting slit in a split face of a mold.

However, with the above mold, even though gas in the cavity can be forced out and removed by the molten metal before pouring, a gas venting effect is poor after pouring because the molten metal enters and is solidified in the vent hole or slit. This results in that gas produced in the cavity from the molten metal after pouring cannot be sufficiently removed.

SUMMARY OF THE INVENTION

It is a first object of the present invention to provide a mold casting process as described above and a mold casting apparatus of the type described above for use in carrying out this process, wherein a cast product is released from the mold before thermal cracking of the product occurs, thereby giving an acceptable cast product, while avoiding damage to the mold due to the solidification and shrinkage of a cast product.

To accomplish the above object, according to the present invention there is provided a mold casting process comprising the steps of rapidly cooling a surface layer of a casting material which is in contact with a mold and releasing a resulting product from the mold when the surface layer has been converted into a shell-like solidified layer.

With the above mold casting process, since the resulting product is released from the mold when its surface layer has been converted into the shell-like solidified layer, a shape retainability of the surface layer can be assured to give an acceptable product, while preventing the mold from being damaged to provide an extended service life thereof.

Additionally, it is possible to improve the production efficiency, because releasing of the product is conducted in a higher temperature region.

In addition, according to the present invention, there is provided a mold casting apparatus comprising a cooling circuit and a heating circuit provided in a mold for producing a cast product by casting, and a cooling-temperature controller and a heating-temperature controller connected to the cooling circuit and the heating circuit, respectively, the heating-temperature controller having a function for activating the heating circuit to heat the mold prior to pouring of a molten metal and for deactivating the heating circuit or reducing the output from the heating circuit after starting of pouring, and the cooling-temperature controller having a function for activating the cooling circuit after pouring to cool the mold, thereby rapidly cooling a surface layer of the cast product to convert it into a shell-like solidified layer.

With the above mold casting apparatus, it is possible to easily and reliably carry out the above-described casting process. Particularly, since the apparatus is constructed so that the mold may be heated prior to pouring, it is possible to improve the running of the molten metal and to avoid cracking or the like of the product due to rapid cooling of the molten metal.

It is a second object of the present invention to provide a mold casting process of a high productivity in which a product is released from a mold before it thermally cracks, thereby producing a defect-free cast product, while avoiding damage of the mold due to the solidification and shrinkage of a cast product.

To accomplish the above object, according to the present invention, there is provided a mold casting process comprising the steps of pouring a molten metal under a condition where a cavity defining portion of a mold which defines a cavity and a portion defining a molten metal passage such as a gate and a runner have been heated; starting cooling of the cavity defining portion at pouring, thereby converting a surface layer of a cast product being shaped in the cavity into a shell-like solidifed layer, and starting cooling of the molten metal passage defining portion after completion of pouring, thereby bringing unrequired portions shaped by the molten metal passage into the solidified state to release the unrequired portions from the mold; and then stopping cooling of the cavity defining portion and the molten metal defining portion when their temperatures have dropped a value near a preheated temperature and thereafter recovering the temperatures of the cavity defining portion and the molten metal defining portion to the preheated temperature.

With the above mold casting process, the surface layer of the cast product is converted into the shell-like solidified layer by providing such a cooling as described above, and the unrequired portions shaped by the molten metal passage are rapidly cooled and are released from the mold in this state. Therefore, the releasing operation can be reliably conducted, and a shape retainability of the solidified layer can be assured to give a cast product free from defects, while preventing damage to the mold to ensure a prolonged service life thereof.

In addition, the mold releasing and recovering to the preheated temperature as described above make it possible to substantially reduce the operating time for one run of casting as compared with the prior art mold casting process awaiting a perfect solidification of a cast product, and this leads to an improvement in productivity.

It is a third object of the present invention to provide a mold casting process and a mold casting apparatus for use in carrying out the process, in which a cast product is released from a mold before it thermally cracks, thereby producing a defect-free and high quality cast product, while avoiding damages of the mold due to the solidification and shrinkage of the product.

To attain the above object, according to the present invention, there is provided a mold casting process for casting a product by using a mold having a casting cavity and a molten metal passage communicating with the cavity, comprising the steps of pouring a molten metal into the cavity through the molten metal passage, rapidly cooling and solidifying the molten metal within the molten metal passage to close the molten metal passage, and then rapidly cooling a surface layer of a product which is in an unsolidified state within the cavity while applying a pressing force thereto, and releasing a resulting product from the mold when the surface layer of the product has been converted into a shell-like solidified layer.

With the above mold casting process, the surface layer of the cast product is rapidly cooled through application of a pressing force, and releasing of the resulting product is conducted when the surface layer of the casting material has been converted into the shell-like solidified layer, as described above. Therefore, in releasing the resulting product, a shape retainability of the solidified layer can be assured to produce a defect-free and high quality cast product, while preventing damage of the mold to provide an extended service life thereof. In addition, since releasing of the resulting product is conducted in a higher temperature region thereof, the productivity can be improved.

In addition, according to the present invention, there is provided a mold casting apparatus comprising a mold having a casting cavity and a molten metal passage communicating with the cavity, pressing means provided on the mold for pressing a molten metal within the cavity, a first cooling circuit mounted in a molten metal passage defining portion of the mold, a heating circuit and a second cooling circuit mounted in a cavity defining portion, a heating-temperature controller connected to the heating circuit, and first and second cooling-temperature controllers connected to the first and second cooling circuits, respectively, the heating-temperature controller having a function for activating the heating circuit to heat the cavity defining portion prior to pouring of the molten metal and for deactivating the heating circuit or reducing an output from the heating circuit after starting of pouring, the first cooling-temperature controller having a function for activating the first cooling controller to rapidly cool the molten metal within the molten metal passage after pouring into the cavity is finished, thereby closing the molten metal passage, the second cooling-temperature controller having a function for activating the second cooling circuit after starting of pouring to cool the cavity defining portion, thereby rapidly cooling a surface layer of a cast product to convert it into a shell-like solidified layer, and the pressing means being adapted to apply a pressing force to the cast product which is in an unsolidifiled state within the cavity after the molten metal passage has been closed.

With the above mold casting apparatus, it is possible to easily and reliably carry out the above-described process. Particularly, because the apparatus is constructed so that the mold is heated prior to pouring of the molten metal, it is possible to improve the running of the molten metal and also to avoid cracking of the product which may otherwise occur from rapid cooling of the molten metal.

It is a fourth object of the present invention to provide a mold casting process and a mold casting apparatus for use in carrying out the process, wherein such a product can be achieved as having a first formed portion of a harder structure and a second formed portion of a softer structure.

To attain the above object, according to the present invention, there is provided a mold casting process for casting a product having a first formed portion of a harder structure and a second formed portion of a softer structure by using a mold, comprising the steps of heating the mold under a condition where a heat transfer is suppressed between a first formed portion shaping region and a second formed portion shaping region of the mold and a temperature of the first formed portion shaping region is lower than that of the second formed portion shaping region of the mold, and rapidly cooling the first formed portion shaping region and slowly cooling the second formed portion shaping region accompanying starting of the pouring under a condition where heating of the mold is stopped or an amount of heat applied to the mold is reduced.

With the above mold casting process, a distinct difference in temperature can be generated between the first and second formed portion shaping regions of the mold to reliably obtain a product having a first formed portion of a harder structure and a second formed portion of a softer structure.

In addition, according to the present invention, there is provided a mold casting apparatus for casting a product having a first formed portion of a harder structure and a second formed portion of a softer structure, comprising a first formed portion shaping region, a second formed portion shaping region and a heat insulating material interposed between the two regions, the mold being provided with a heating circuit for heating the two regions prior to pouring of a molten metal in a manner that the first formed portion shaping region stays at a lower temperature than that of the second formed portion shaping region, and for stopping the heating or reducing an amount of heat applied to the two regions at the start of pouring, and a cooling circuit being provided for rapidly cooling the first formed portion shaping region and slowly cooling the second formed portion shaping region at the start of pouring.

With the above mold casting apparatus, since the heat insulating material is interposed between the first and second formed portion shaping regions, it is possible to achieve an accurate and rapid controlling in temperature of both the regions before and after pouring, and to present a distinct difference in temperature between both the regions, thereby ensuring that there is achieved a product having a first formed portion of a harder structure and a second formed portion of a softer structure.

It is a fifth object of the present invention to provide a mold casting process which enables production of a defect-free article having a thinner wall portion and a thicker wall portion integral with the thinner wall portion.

To accomplish the above object, according to the present invention, there is provided a mold casting process for casting a product having a thinner wall portion and a thicker wall portion integral with the thinner wall portion in a mold casting manner, wherein a mold is used including a mold body and a movable core slidably mounted in the mold body for shaping the thinner wall portion in cooperation with the mold body, and wherein the movable core is removed from the thinner wall portion after pouring when a surface layer of the thinner wall portion has become a solidified layer, and a resulting product is removed from the mold when a surface layer of the thicker wall portion has become a solidified layer.

With the above mold casting process, the state of contact of the mold with the thinner wall portion is released early and hence, the thinner wall portion cannot thermally crack. The contact of the mold with the thicker wall portion is then released, i.e., a resulting product is released from the mold when the surface thereof has become a solidified layer. Therefore, a defect-free cast product can be obtained with a good efficiency, and the mold cannot be damaged, leading to a substantially prolonged service life of the mold.

It is a sixth object of the present invention to provide a method for producing a mechanical part, in which a resulting mechanical part blank is released from a mold before it thermally cracks, while avoiding damage of the mold due to the solidification and shrinkage of the mechanical part blank, and the shape of the mechanical part blank can be reliably corrected into a proper one by using a small-sized shape correcting or setting device.

To accomplish the above object, according to the present invention there is provided a method for producing a mechanical part, comprising a mold casting step wherein a mechanical part blank resulting from pouring of a molten metal into and casting thereof in a mold is rapidly cooled its surface layer in contact with the mold and is then released from the mold when the surface layer thereof has become a solidified layer, and a shape correcting step of subjecting the mechanical part blank, which is at a higher temperature immediately after released from the mold, to a pressing treatment.

With the above method, since a resulting mechanical part blank is released from the mold in the mold casting step when the surface layer thereof has become the solidified layer, the mechanical part blank product can be retained in shape by the solidified layer and free from thermal cracks, and also damages of the mold are avoided to provide an extended service life thereof. In addition, since releasing is conducted when the mechanical part blank is in a higher temperature region, the casting efficiency can be improved.

Since the mechanical part blank is at a high temperature in the shape correcting step, a small-sized setting device is sufficient to carry out a reliable shape correction, leading to a reduction in cost of equipment.

In this way, the above producing method makes it possible to provide a defect-free mechanical part with a lower cost.

It is a seventh object of the present invention to provide a mold casting apparatus which enables efficient production of cast products of a high quality.

To attain the above object, according to the present invention there is provided a mold casting apparatus including a filter which is incorporated in a molten metal passage communicating with a casting cavity and which provides a controlled run of the molten metal.

With the above mold casting apparatus, the molten metal can be solidified rapidly utilizing a high heat conductivity of the mold to provide a high strength product having a fine structure.

In addition, since the speed of cooling the molten metal by the mold is high, it is necessary to increase the pouring speed and due to this, the run of the molten metal may be disordered in the molten metal passage to include slag, gas and the like thereinto. However, the slag and the like are removed by the filter, and the molten metal once disordered is controlled in flow by the filter and then introduced into the cavity. Therefore, the inclusion of gas is suppressed to the utmost, and this makes it possible to eliminate the adverse influence due to the increase in pouring rate and to efficiently produce a good quality product.

It is an eighth object of the present invention to provide a mold casting apparatus wherein a mold including a convex shaping portion can be easily repaired.

To attain the above object, according to the present invention there is provided a mold casting apparatus including a convex shaping portion provided on a heat resistant member detachably mounted in a mold body.

With the above mold casting apparatus, when the convex shaping portion is worn or damaged, the mold can be restored to the original state by merely replacing the worn or damaged convex shaping portion with a new one. Therefore, a large-scaled repairing of the mold is unnecessary, and the efficiency of production of cast articles can be improved.

It is a ninth object of the present invention to provide a mold casting apparatus having a good gas venting property.

To attain the above object, according to the present invention there is provided a mold casting apparatus comprising a mold including an air flow channel extending along a back side of a casting cavity, the cavity and the air flow channel communicating with each other through a slit adapted to permit flowing of air thereinto but inhibit flowing of a molten metal thereinto.

With the above mold casting apparatus, venting of a gas within the cavity can be effected with a good efficiency, whereby the charging efficiency of a molten metal can be improved to provide a high quality product free from casting defects such as pin holes, cavities and the like.

In addition, even though the molten metal may enter the slit and may be solidified therein, the solidified material can be easily removed by blowing compressed air into the air flow channel.

The above and other objects, features and advantages of the invention will become apparent from reading of the following description of the preferred embodiments, taken in conjunction with the accompanying drawings.

BRIEF DESCRIPTION OF THE DRAWINGS

FIGS. 1 to 3 illustrate a first mold casting apparatus for casting a cam shaft blank of a cast iron, wherein FIG. 1 is a perspective view of the whole apparatus;

FIG. 2 is a view taken in a direction indicated by an arrow 2—2 in FIG. 1;

FIG. 3 is a sectional view taken along a line 3—3 in FIG. 2;

FIGS. 10 to 12 illustrate a second mold casting apparatus for casting a cast steel cam shaft blank, wherein FIG. 10 is a perspective view of the whole apparatus;

FIG. 11 is a view taken in a direction indicated by an arrow 11—11 in FIG. 10;

FIG. 12 is a sectional view taken along a line 12—12 in FIG. 11;

FIGS. 17 to 19 illustrate a third mold casting apparatus for casting a cast iron cam shaft blank, wherein FIG. 17 is a view of the whole apparatus;

FIG. 18 is a view taken in a direction indicated by an arrow 18—18 in FIG. 17;

FIG. 19 is a sectional view taken along a line 19—19 in FIG. 18;

FIGS. 22 to 24 illustrate a fourth mold casting apparatus for casting a cam shaft blank of a steel casting, wherein FIG. 22 is a view of the whole apparatus;

FIG. 23 is a view taken in a direction indicated by an arrow 23—23 in FIG. 22;

FIG. 24 is a sectional view taken along a line 24—24 in FIG. 23;

FIGS. 27 to 29 illustrate a fifth mold casting apparatus for casting a cast iron cam shaft blank, wherein FIG. 27 is a front view in longitudinal section of the apparatus;

FIG. 28 is an enlarged sectional view of a mold;

FIG. 29 is a view taken in a direction of an arrow 29 in FIG. 28;

FIGS. 30 to 32 illustrate a sixth mold casting apparatus for casting a cast steel cam shaft blank, wherein FIG. 30 is a front view in longitudinal section of the apparatus;

FIG. 31 is an enlarged sectional view of a mold;

FIG. 32 is a view taken in a direction of an arrow 32 in FIG. 31;

FIGS. 33 to 38 illustrate a seventh mold casting apparatus for casting a cast iron cam shaft blank, wherein FIG. 33 is a perspective view of details of the apparatus;

FIG. 34 is a view taken in a direction of an arrow 34—34 in FIG. 33;

FIG. 35 is a sectional view taken along a line 35—35 in FIG. 34;

FIG. 36 is a sectional view taken along a line 36—36 in FIG. 34;

FIG. 37 is a sectional view taken along a line 37—37 in FIG. 34;

FIG. 38 is a sectional view taken along a line 38—38 in FIG. 37;

FIGS. 40 to 42 illustrate a eighth mold casting apparatus for casting a cast iron nuckle arm blank, wherein FIG. 40 is a broken sectional front view of details when a mold is open;

FIG. 41 is a broken sectional front view of the details during casting;

FIG. 42 is an enlarged view of the details shown in FIG. 41;

DESCRIPTION OF THE PREFERRED EMBODIMENTS

[I] Production of Cast Iron Cam Shaft (i) Casting of Cam Shaft Blank

Figure 1:
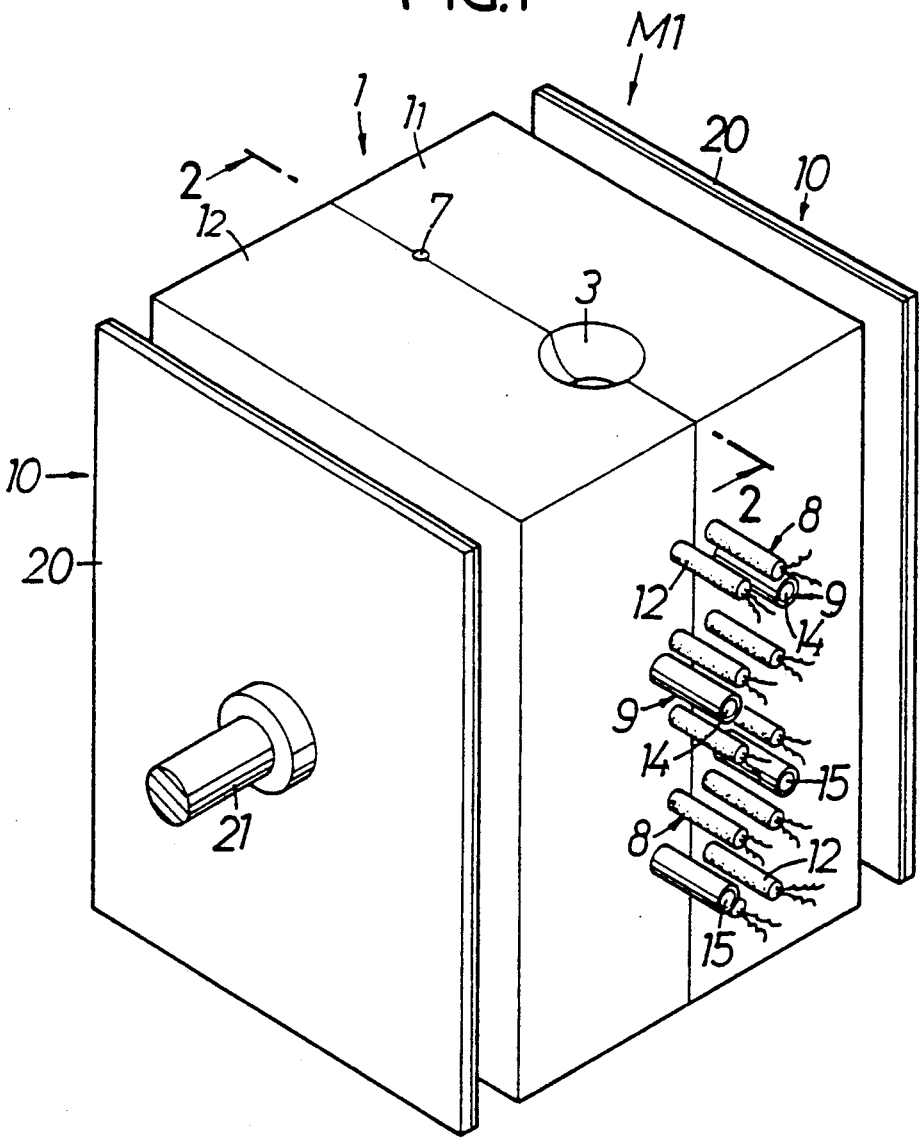
Figure 2:
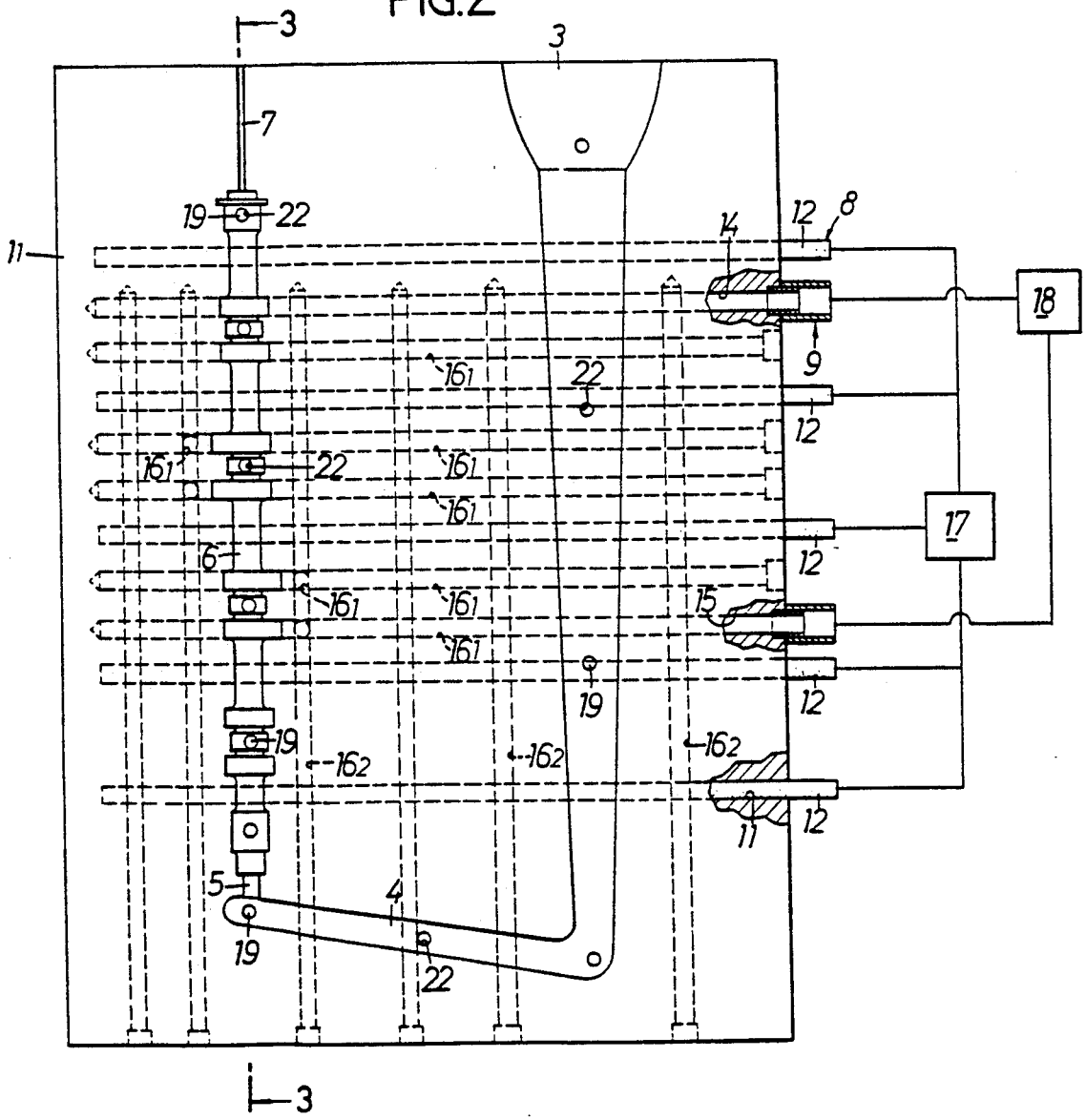
Figure 3:
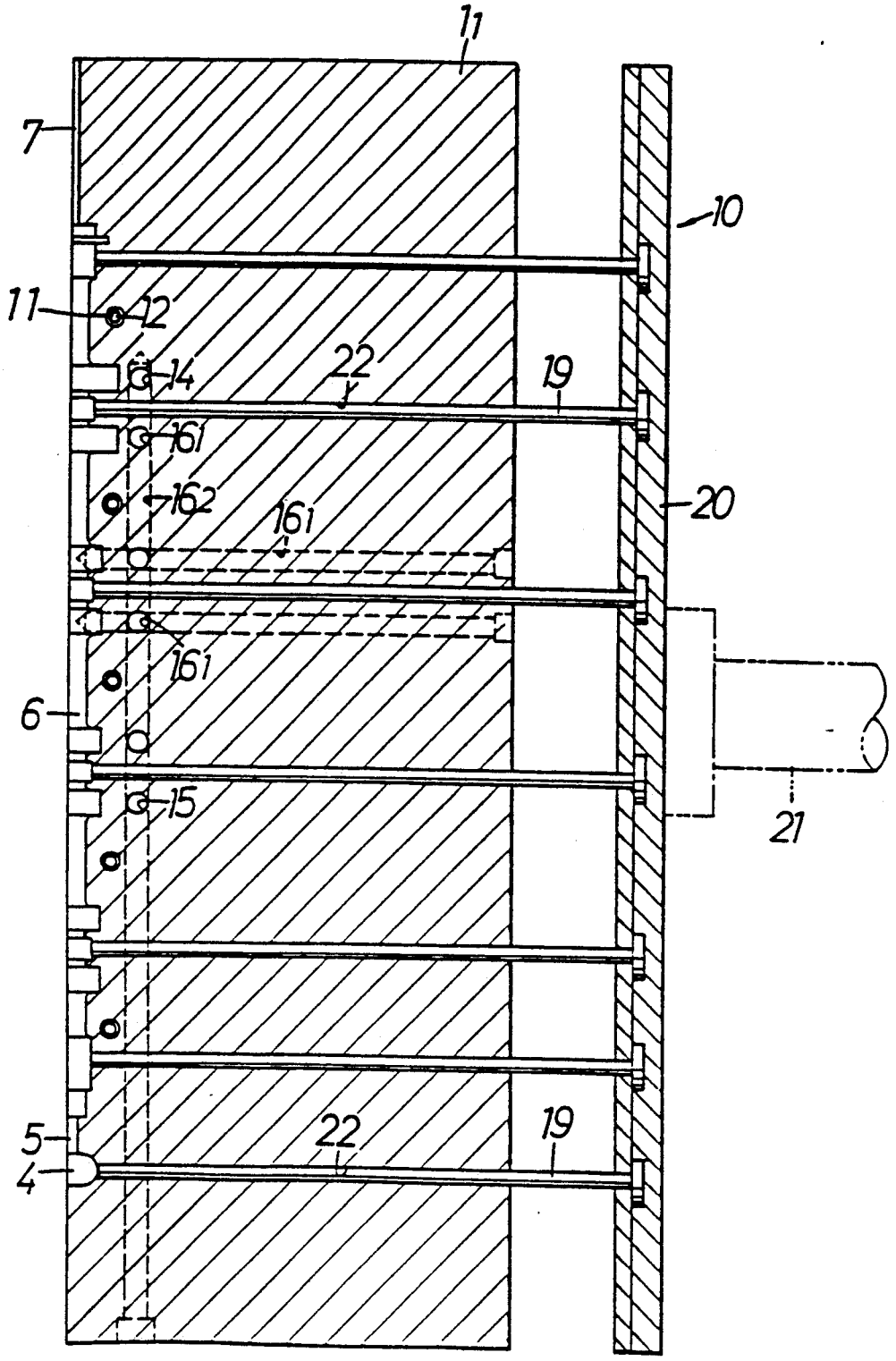

FIGS. 1 to 3 shows a mold casting apparatus M1 including a mold 1. The apparatus M1 is used to cast a cam shaft blank for an internal combustion engine (mechanical part blank) $2_1$ shown in FIG. 4.

Figure 4:
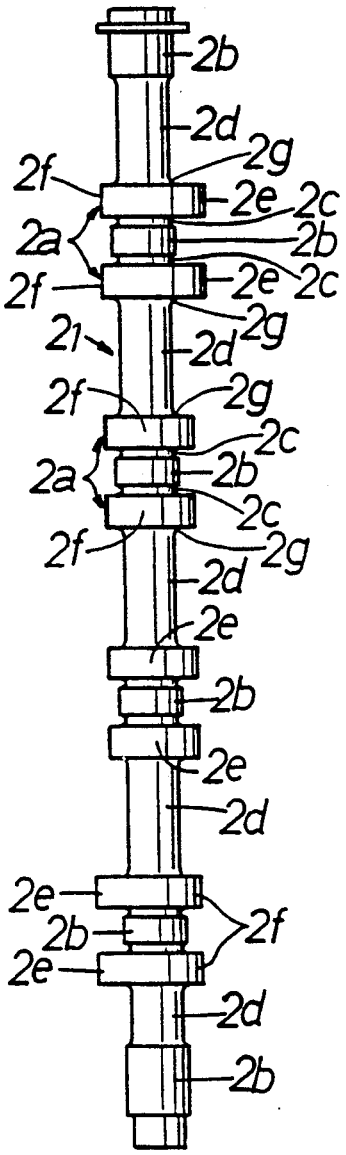
FIG. 4 is a front view of a cam shaft blank.

Referring to FIG. 4, the cam shaft blank $2_1$ is conventionally well-known and includes a plurality of sets of cam portions 2*a* adjacent ones of which are one set, journal portions 2*b* respectively located between the adjacent cam portions 2*a* and at opposite ends of the cam shaft blank $2_1$, neck portions 2*c* each located between the adjacent cam portions 2*a* and journal portions 2*b*, and smaller diameter portions 2*d* respectively located outside the cam portions 2*a* at the opposite ends and between the adjacent sets of the cam portions 2*a*.

The mold 1 is formed of a Cu-Cr alloy containing 0.8 to 4% by weight of Cr and has a thermal conductivity of 0.4 to 0.8 cal/cm/sec./°C.

The mold 1 is constructed of a first die $1_1$ and a second die $1_2$ of a split type and is opened and closed by an operating device which is not shown. Mold faces of the first and second dies $1_1$ and $1_2$ define a sprue 3, a runner, a gate 5, a cam shaft blank-molding cavity 6, and a vent hole 7.

Each of the first and second dies $1_1$ and $1_2$ is provided with a heating circuit 8, a cooling circuit 9 and knock-out means 10. Because these portions are substantially the same for the both dies $1_1$ and $1_2$, the description thereof will be made for the first die $1_1$.

The heating circuit 8 comprises a plurality of insertion holes 11 perforated in the first die $1_1$, and bar-like heaters 12 each inserted into and held in each of the insertion holes 11. Each of the insertion holes 11 is disposed so that a portion thereof may be in proximity to a section in the first die 11 for shaping each of the smaller diameter portions 2*d* of the cam shaft blank $2_1$.

The cooling circuit 9 comprises an inlet passage 14 horizontally made in an upper portion of the first die $1_1$, an outlet passage 15 horizontally made in an intermediate portion of the first die, and a plurality of communication passages $16_1$ and $16_2$ made in the first die $1_1$ to extend horizontally and vertically in an intersecting relation to each other to connect the inlet passage 14 and the outlet passage 15, so that cooling water introduced into the inlet passage 14 may be passed through the individual communication passages $16_1$ and $16_2$ and discharged from the outlet passage 15. The inlet passage 14, the discharge passage 15 and the individual horizontal communication passage $16_1$ are disposed so that a portion of each of them may be in proximity to a region of the first die $1_1$ for shaping a nose 2*e* which is a chilled portion of the resulting cam portion 2*a*.

Each of the heaters 12 in the heating circuit 8 is connected to a heating-temperature controller 17 having a function for activating the heating circuit 8 prior to pouring of a molten metal, i.e., energizing each heater 12 to heat the first die $1_1$, and deactivating the heating circuit 8 after starting of pouring, i.e., deenergizing each heater 12.

Because the individual heater 12 is spaced from the nose 2*e* shaping region of the first die $1_1$, the temperature of that region is lower than that of other regions during heating. Of course, each of the heaters 12 in the second die $1_2$ is also connected to the heating-temperature controller 17.

The inlet passage 14 and the outlet passage 15 of the cooling circuit 9 are connected to a cooling-temperature controller 18 having a function for activating the cooling circuit 9 after starting of pouring, i.e., permitting the cooling water to flow through the cooling circuit 9 to cool the first die $1_1$, rapidly cooling that surface layer of the resulting cam shaft blank $2_1$ which is in contact with the first die $1_1$, thereby converting it into a shell-like solifified layer.

During cooling, it is possible to rapidly cool the nose 2e to reliably achieve chilling thereof, because the inlet passage 14, the outlet passage 15 and the individual horizontal communication passages $16_1$ are in proximity to the nose 2e shaping region of the first die $1_1$ and also because that region is at a temperature lower than that of the other regions at the heating stage. Of course, the cooling circuit 9 of the second die $1_2$ is also connected to the cooling-temperature controller 18.

The knock-out means 10 comprises a plurality of pins 19, a support plate 20 for supporting one ends of the pins 19, and an operating member 21 connected to the support plate 20. Each of the pins 19 is slidably received in each of insertion holes 22 which are provided in the first die $1_1$ and opened into the sprue 3, the runner 4 and the cavity 6. In the cavity 6, an opening of each insertion hole 22 is disposed in a region for shaping each journal portion 2b of the resulting cam shaft blank $2_1$.

Description will now be made of an operation for casting a cam shaft blank $2_1$ in the above-described mold casting apparatus M1.

First, a molten metal of an alloy chilled cast iron containing constituents given in Table 1 is prepared.

TABLE I

| Chemical constituents (% by weight) | | | | | |
|---|---|---|---|---|---|
| C | Si | Mn | Ni | Cr | Mo |
| 3.5 | 1.8 | 0.6 | 0.4 | 0.5 | 0.5 |

Figure 5:
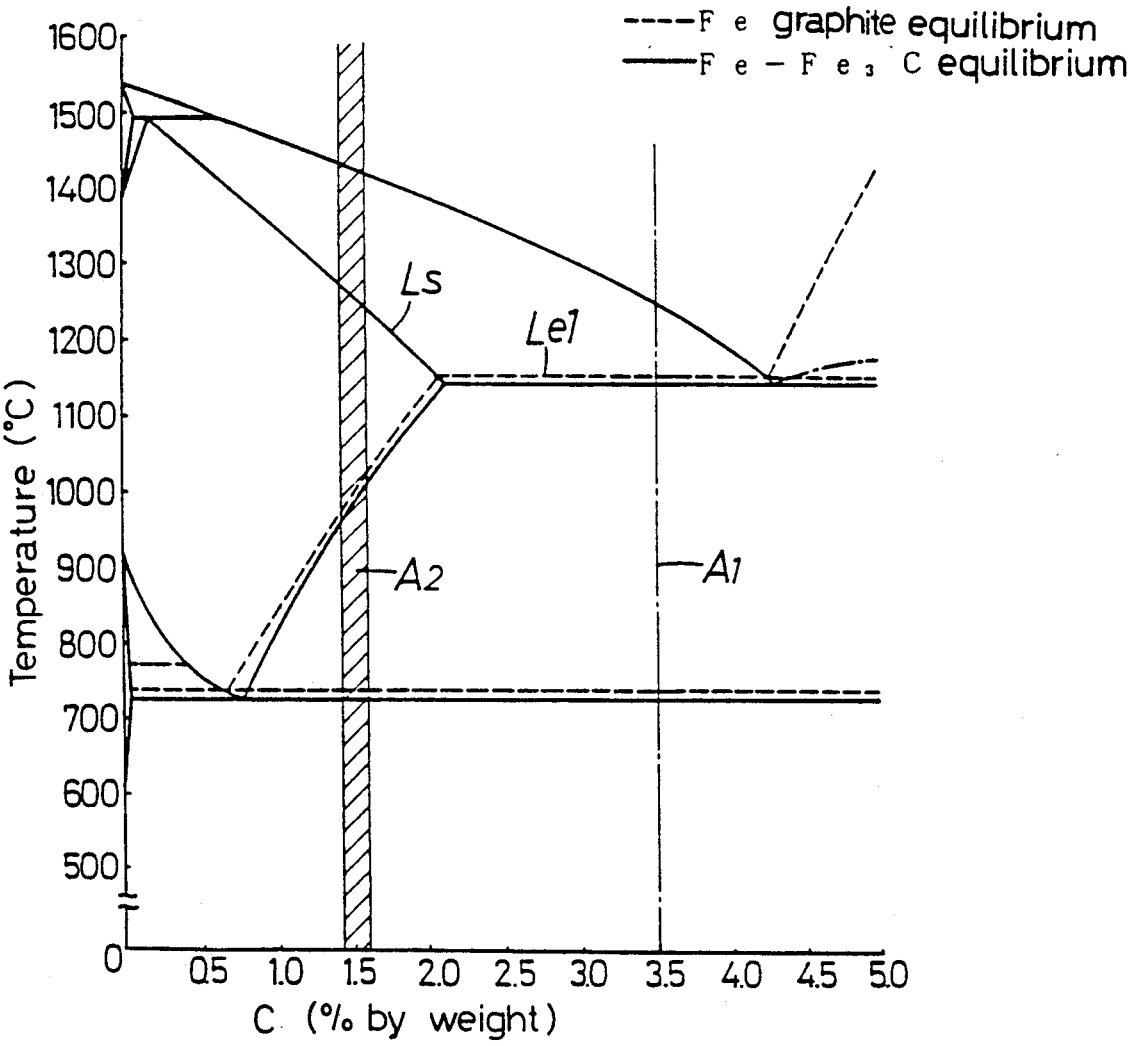
FIG. 5 is an equilibrium state diagram of an Fe-C system.

The alloy chilled cast iron has a composition as indicated by a line A1 in an equilibrium phase diagram shown in FIG. 5, with an eutectic crystal line Le1 intersecting the line A1 at approximately 1150° C.

The mold 1 is heated by the heating circuit 8 prior to pouring of the molten metal, wherein a region for shaping the smaller diameter portion 2d is maintained at approximately 450° C., and the region for shaping the nose 2e is at 150° C. The aforesaid molten metal is poured at a temperature in a range of 1380° to 1420° C. into the mold 1 to cast a cam shaft blank $2_1$. The amount of molten metal poured at this time is 5 kg.

If the mold 1 has been previously heated as described above, the run of the molten metal is improved during pouring, and it is possible to avoid cracking of the resulting cam shaft blank and so on due to the rapid cooling of the molten metal.

After pouring is started, heating of the mold 1 by the heating circuit 8 is stopped and at the same time, the mold 1 is started to be cooled by the cooling circuit 9.

Figure 6:
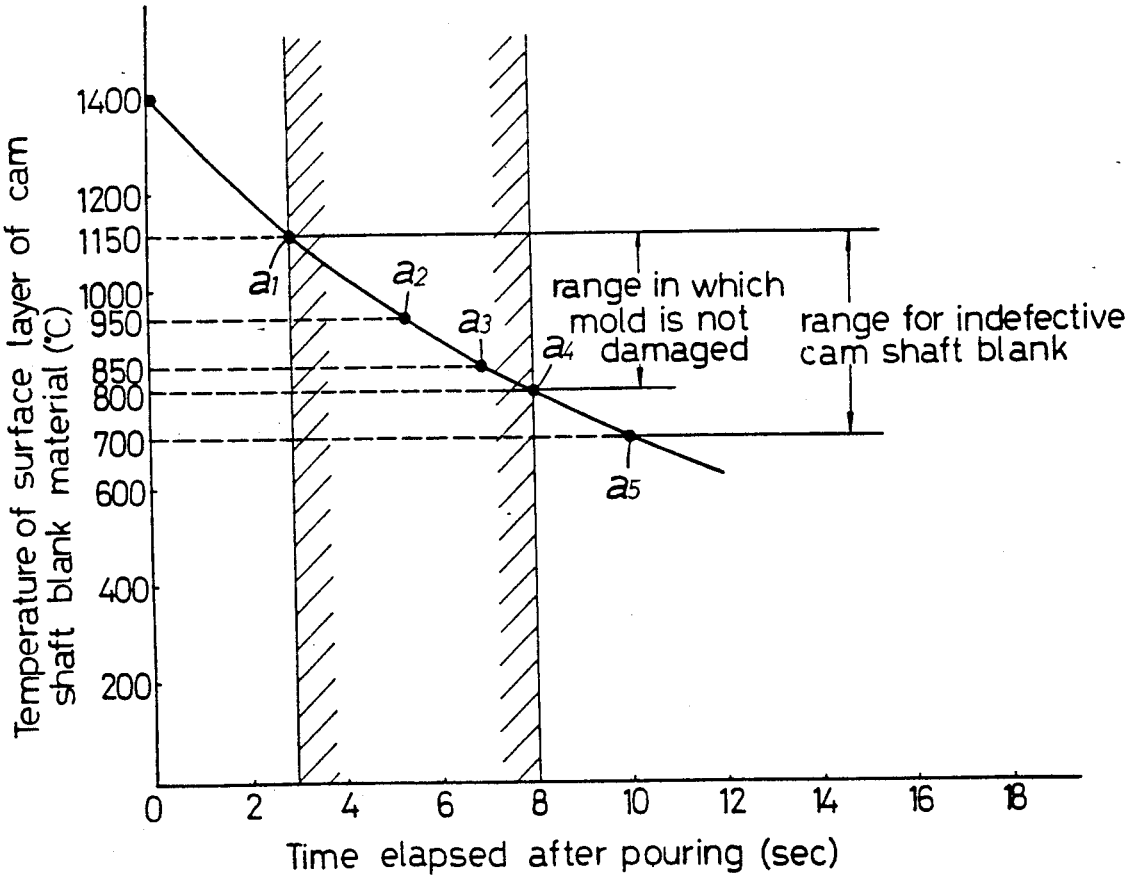
FIG. 6 is a graph illustrating a relationship between the temperature of a surface layer of a cast iron cam shaft blank material and the time elapsed after pouring of a molten metal.

FIG. 6 illustrates a temperature drop for the surface layer of the cam shaft blank material $2_1$ in contact with the mold 1 in a relationship with the time elapsed after pouring.

The surface layer of the cam shaft blank material $2_1$ is rapidly cooled under a cooling effect of the mold, and when the temperature of the surface layer is dropped down to about 1150° C. (eutectic crystal line Le1) indicated by a point $a_1$, the cam shaft blank $2_1$ becomes solidified with the surface layer thereof converted into a shell-like solidified layer.

In this case, if the temperature of the surface layer is lower than 700° C. indicated by a point $a_5$, it is feared that thermal cracking may be produced in the resulting cam shaft blank $2_1$. In addition, if the temperature of the surface layer is lower than 800° C. indicated by a point $a_4$, it is also feared that adhesion of the resulting cam shaft blank $2_1$ to the mold 1 and so on may be produced due to the solidificational shrinkage of the cam shaft blank material $2_1$ to cause damages such as deformation and wearing of the mold 1.

Thereupon, when the temperature of the surface layer of the cam shaft blank material $2_1$ has reached a temperature of 950° C. indicated by a point $a_2$ to 850° C. indicated by a point $a_3$ in about 3 to about 8 seconds after pouring, the mold is opened, and the knock-out pin means 10 is operated to release the resulting cam shaft blank $2_1$ from the mold.

The cam shaft blank $2_1$ provided by the above procedure has no thermal cracks produced therein, and the mold 1 is not damaged in any way. Moreover, the cam shaft blank $2_1$ is covered with the shell-like solidified layer and hence, deformation in releasing the blank is suppressed to the utmost.

Further, the nose 2e of each cam portion 2a is positively chilled, because the region of the mold 1 for shaping the nose 2e has been heated to a relative low temperature and rapidly cooled at the cooling stage.

The optimal timing for releasing the cam shaft blank $2_1$ of the aforesaid alloy chilled cast iron is when the temperature of the surface layer thereof is in a range of about 1150° to 800° C. and thus between the eutectic crystal line and 350° C. therebelow, and experiments have made clear that the same is true even when other cast irons such as a spherical graphite cast iron are employed.

(ii) Setting of Shape of Cam Shaft Blank

Figure 7:
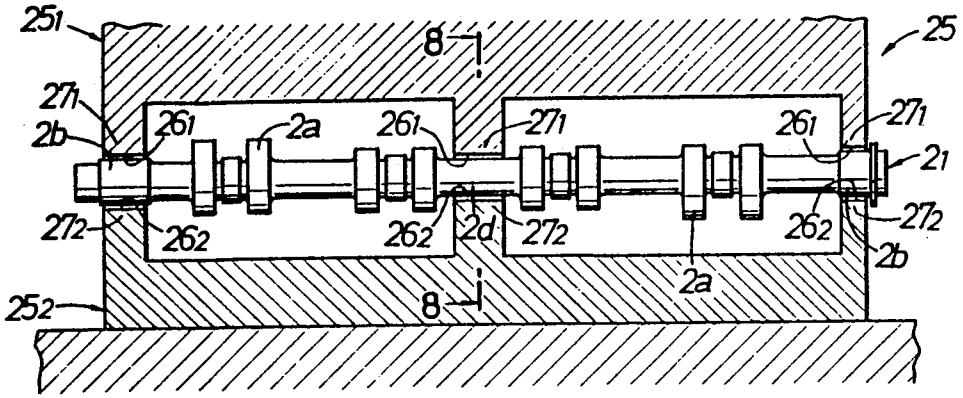
FIG. 7 is a sectional view of a setting device.
Figure 8:
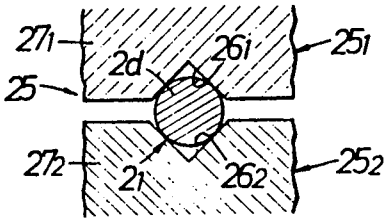
FIG. 8 is a sectional view taken along a line 8—8 in FIG. 7.

FIGS. 7 and 8 shows a shape correcting of setting apparatus 25 which comprises an upper pressing member $25_1$ and a lower pressing member $25_2$. Each of the pressing members $25_1$ and $25_2$ includes, at its longitudinally central portion and opposite ends, pressing portions $27_1$, $27_2$ each having a V-groove $26_1$, $26_2$ adapted to engage each of outer peripheral surface of the smaller dismeter portion 2d at the central portion of the cam shaft blank $2_1$ and of the opposite end journal portions 2b at the opposite ends of the cam shaft blank $2_1$.

The cam shaft blank $2_1$ which is at a high temperature immediately after release from the mold is clamped between both the pressing members $25_1$ and $25_2$ and pressed by application of a pressing force thereto through the upper pressing member $25_1$. This pressing treatment is conducted one or more times through rotation of the cam shaft blank $2_1$, thereby providing a cam shaft (mechanical part).

Figure 9:
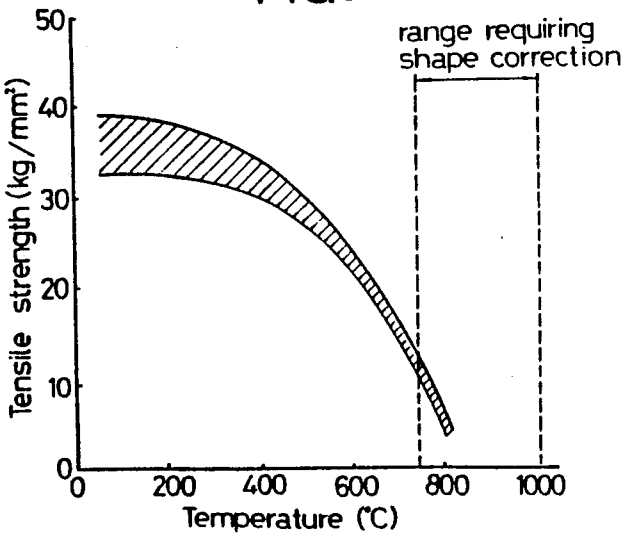
FIG. 9 is a graph illustrating a relationship between the temperature of the cam shaft blank material and the tensile strength thereof.

FIG. 9 illustrates a relationship between the temperature and the tensile strength of the cam shaft blank $2_1$. When the temperature of the cam shaft blank $2_1$ is in a range of 750° to 1,000° C., the cam shaft blank $2_1$ is easy to deform, so that the setting in shape thereof can be reliably carried out with a relatively small pressing force.

In this embodiment, the aforesaid setting step is conducted under conditions of a pressing force of 150 to 450 kg and a pressing time of 5 to 15 sec., whereby if the cam shaft blank $2_1$ released from the mold is bent, then the bending can be corrected. For example, with a cam shaft blank $2_1$ having an overall length of 450 mm, if the center of the central smaller diameter portion (a diameter of 30 mm) deviates by 0.8 mm or more with respect to a line connecting the centers of the journal portions (a diameter of 40 mm) at the opposite ends, then such deviation can be corrected with 0.3 mm.

[II] Production of Cast steel Cam Shaft (i) Casting of Cam Shaft Blank

Figure 10:
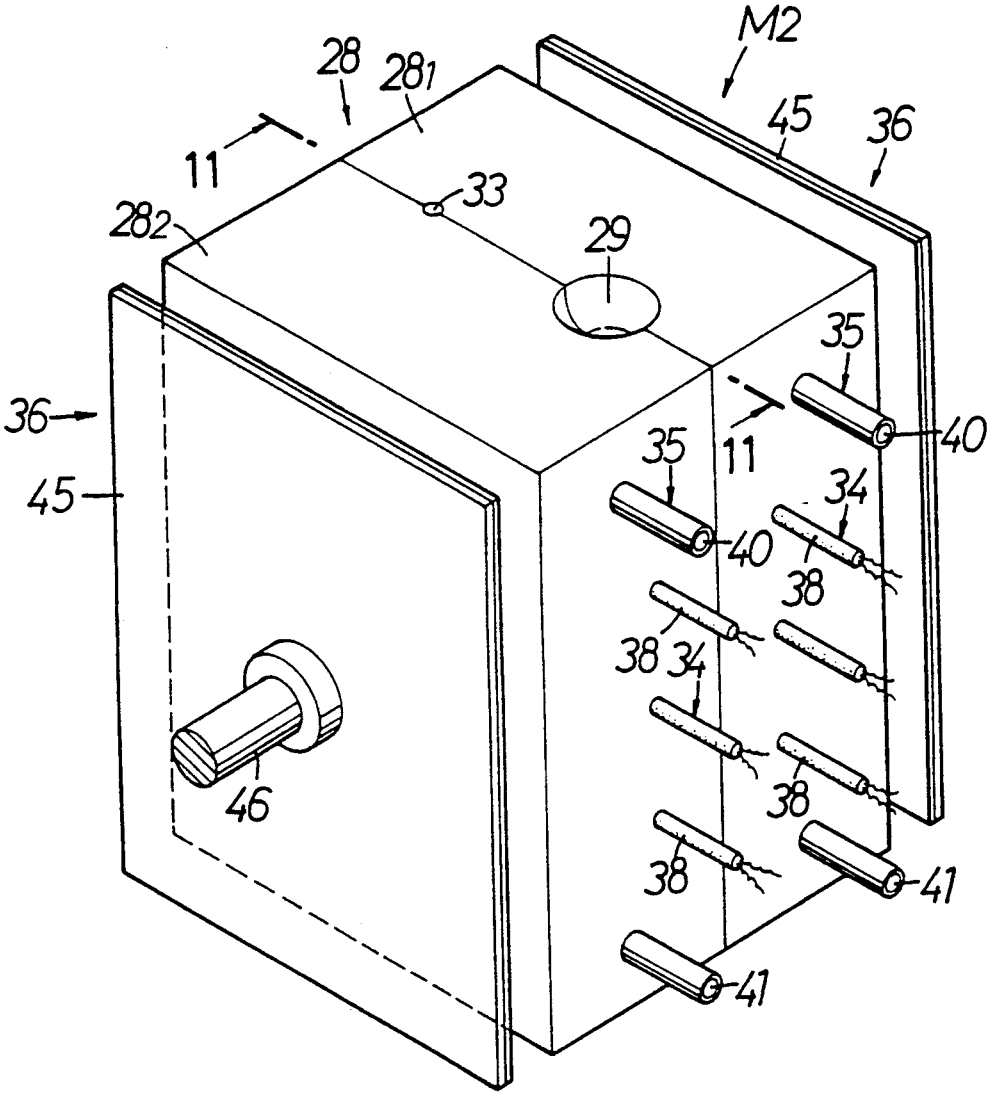
Figure 11:
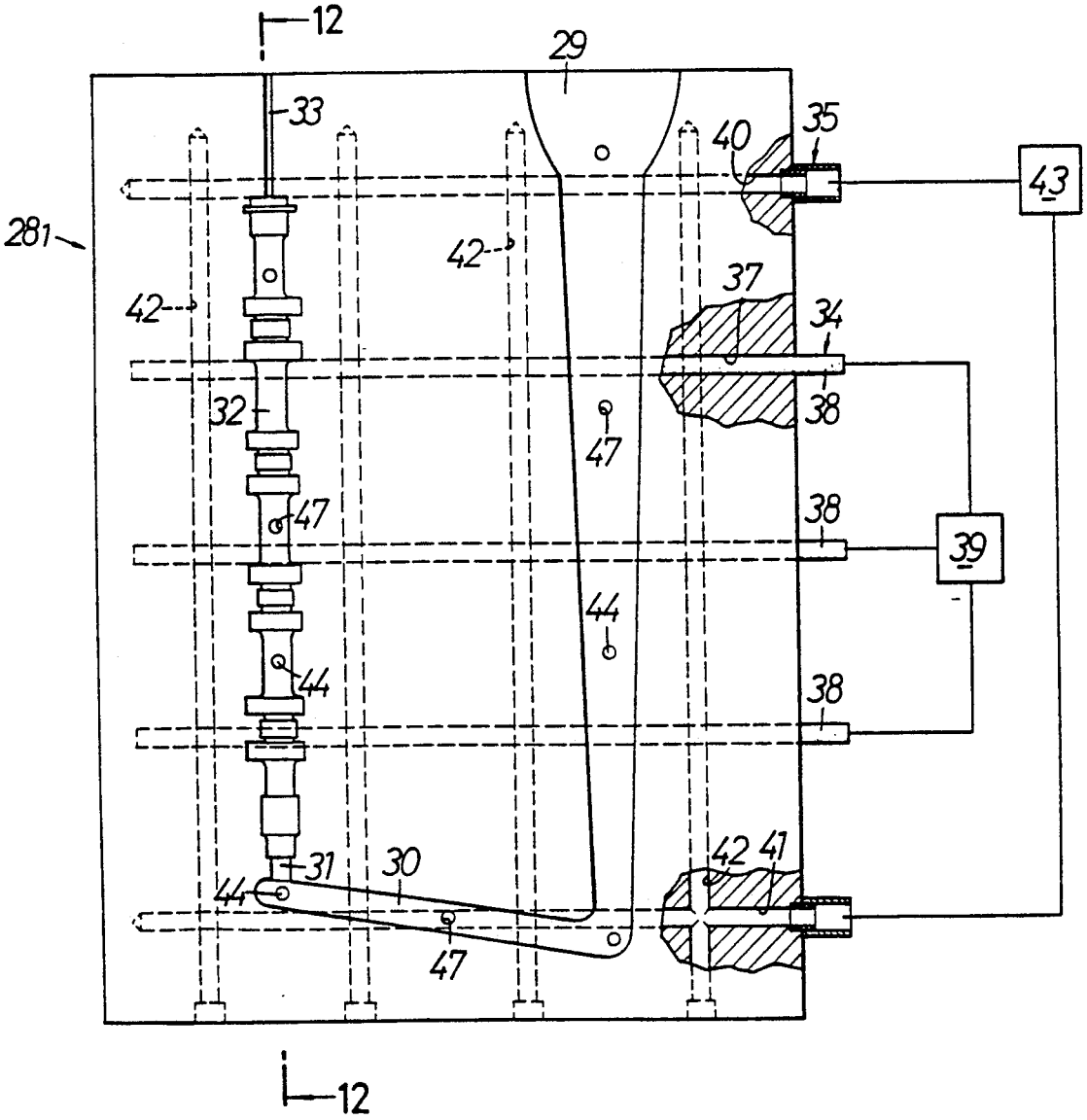
Figure 12:
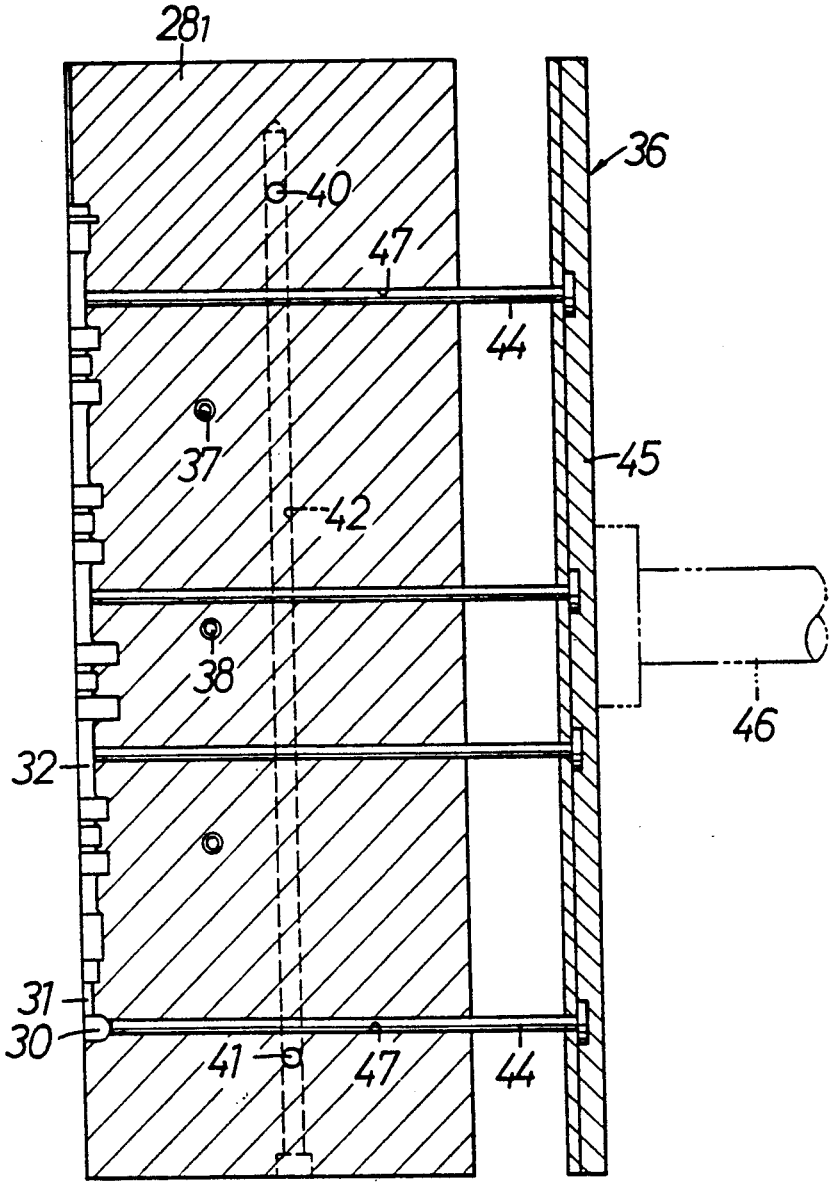

FIGS. 10 to 12 show a mold casting apparatus M2 including a mold 28. The apparatus M2 shaft blank $2_2$ shown in FIG. 13.

The mold 28 is formed of a Cu-Cr alloy in the same manner as described above. The mold 28 is constructed of a first die $28_1$ and a second die $28_2$ into a split type, and opened and closed by an operating device which is not shown. The mold surfaces of the first and second dies $28_1$ and $28_2$ define a sprue 29, a runner 30, a gate 31, a cam shaft blank-molding cavity 32 and a vent hole 33.

Each of the first and second dies $28_1$ and $28_2$ is provided with a heating circuit 34, a cooling circuit 35 and knock-out means 36. These portions are the same for both the dies $28_1$ and $28_2$ and hence, only those for the first dies $28_1$ will be described below.

The heating circuit 34 is comprised of a plurality of insertion holes 37 perforated in the first die $28_1$ and bar-like heaters 38 inserted into and held in the corresponding insertion holes 37.

Each of the heaters 38 is connected to a heating-temperature controller 39 having a function for activating the heating circuit 34 prior to pouring of a molten metal, i.e., energizing each heater 38 to heat the first die $28_1$, and deactivating the heating circuit 34 after starting of pouring, i.e., deenergizing each heater 38. Of course, each of the heaters 38 in the second die $28_2$ is also connected to the heating-temperature controller 39.

The cooling circuit 35 is comprised of a horizontal inlet passage 40 made in an upper portion of the first die 281, a horizontal outlet passage 41 made in a lower portion of the first die, and a plurality of vertical communication passages 42 made in the first die $28_1$ to connect the inlet and outlet passages 40 and 41, so that cooling water introduced into the inlet passage 14 may be passed through the individual communication passages 42 and discharged from the outlet passage 41.

The inlet passage 40 and the outlet passage 41 are connected to a cooling-temperature controller 43 which has a function for activating the cooling circuit 35 after starting of pouring, i.e., permitting the cooling water to flow through the cooling circuit 35 to cool the first die $28_1$, rapidly cooling that surface layer of the cam shaft blank material $2_2$ which is in contact with the first die $28_1$, thereby converting it into a shell-like solidified layer. Of course, the cooling circuit 35 of the second die $28_2$ is also connected to the cooling-temperature controller 43.

The knock-out means 36 comprises a plurality of pins 44, a support plate 45 for supporting one ends of the pins 44, and an operating member 46 connected to the support plate 45. Each of the pins 44 is slidably received in each of insertion holes 47 which are provided in the first die $28_1$ and opened into the sprue 29, the runner 30 and the cavity 32.

Description will now be made of an operation for casting a cam shaft blank 22 in the above-described mold casting apparatus M2.

Fifty to seventy % by weight of a scrap material (steel) and 50 to 60% by weight of a return material as main feeds are charged into a high frequency furnace and dissolved therein, and sub-feeds such as C, Fe-Cr, Fe-Mo, Fe-V, etc., are added thereto to prepare a molten metal of an alloy cast steel composition corresponding to an alloy tool steel (JIS SKD-11) given in Table II.

TABLE II

| Chemical constituents (% by weight) | | | | | | | |
|---|---|---|---|---|---|---|---|
| C | Si | Mn | P | S | Cr | Mo | V |
| 1.40–1.60 | ≦0.4 | ≦0.6 | ≦0.030 | ≦0.030 | 11.0–13.0 | 0.8–1.2 | 0.20–0.50 |

The above alloy cast steel is in a composition range A2 indicated by an obliquely-lined region in a Fe-C equilibrium phase diagram shown in FIG. 5, wherein a solid phase line Ls intersects the composition range A2 at approximately 1,250° C.

The molten metal is increased in temperature in an atmosphere of an inert gas such as argon gas and subjected to a primary deacidification wherein 0.2% by weight of Ca-Si is added at a temperature of 1,500° to 1,530° C. and a secondary deacidification wherein 0.1% by weight is added at a temperature of 1,650° to 1,670° C.

The mold 28 is previously heated to a temperature of 150° to 450° C. by the heating circuit 34 prior to pouring. The molten metal deacidified is poured into the mold 28 at a temperature of 1,630° to 1,670° C. to cast a cam shaft blank $2_2$. The amount of molten metal poured at this time is 5.0 kg.

If the mold 28 has been previously heated as described above, the flow of the molten metal is improved during pouring, and it is possible to avoid cracking of the resulting cam shaft blank and so on due to the rapid cooling of the molten metal.

After pouring is started, heating of the mold 28 by the heating circuit 34 is stopped and at the same time, the mold 28 is started to be cooled by the cooling circuit 35.

Figure 14:
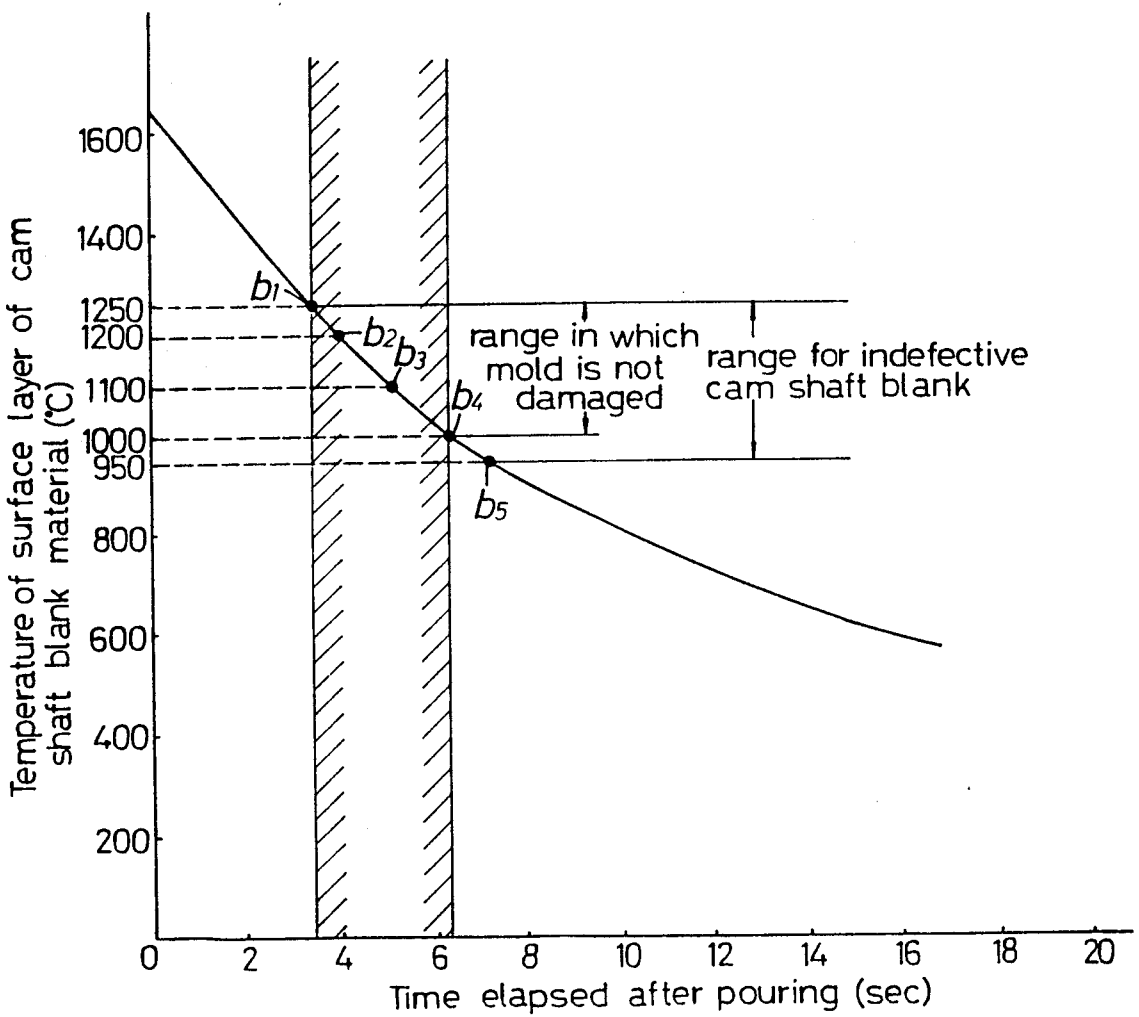
FIG. 14 is a graph illustrating a relationship between the temperature of a surface layer of a cast steel cam shaft blank material and the time elapsed after pouring of a molten metal.

FIG. 14 illustrates a temperature drop for the surface layer of the cam shaft blank material $2_2$ in contact with the mold 28 in a relationship with the time elapsed after pouring.

The surface layer of the cam shaft blank material $2_2$ is rapidly cooled under a cooling effect of the mold 28, and when the temperature of the surface layer is dropped down to about 1,250° C. (eutectic crystal line Le1) indicated by a point $b_1$, the cam shaft blank material $2_2$ becomes solidified with the surface layer thereof converted into a shell-like solidified layer.

In this case, if the temperature of the surface layer is lower than 950° C. indicated by a point $b_5$, it is feared that thermal cracking may be produced in the resulting cam shaft blank $2_2$. In addition, if the temperature of the surface layer is lower than 1,000° C. indicated by a point $b_4$, it is also feared that adhesion of the resulting cam shaft blank $2_2$ to the mold 28 and so on may be produced due to the rapid and large solidificational shrinkage of the cam shaft blank material $2_2$ to cause damage such as deformation and wearing of the mold 28.

Thereupon, when the temperature of the surface layer of the cam shaft blank material $2_2$ has reached a temperature of 1,200° C. indicated by a point $b_2$ to 1,100° C. indicated by a point $b_3$ in about 4 to about 5 seconds after pouring, the mold is opened, and the knock-out pin means 36 is operated to release the resulting cam shaft blank $2_2$ from the mold.

The cam shaft blank $2_2$ provided by the above procedure has no thermal cracks produced therein, and the mold 28 is also not damaged in any way. Moreover, the cam shaft blank $2_2$ is covered with the shell-like solidified layer and hence, deformation in releasing the blank is suppressed to the utmost.

The optimal timing for releasing the cam shaft blank $2_2$ of the aforesaid alloy cast steel is when the temperature of the surface layer thereof is in a range of about 1,250° to 1,000° C. and thus between the solid phase line Ls and 250° C. therebelow, and experiments have made clear that the same is true even when carbon cast steels are employed.

The feed materials which may be charged is not limited to those corresponding to the above-described alloy tool steel, and include those prepared from a main feedstock consisting of a scrap material and a return material, and sub-feed(s) selected alone or in a combination from alloy elements such as C, Ni, Cr, Mo, V, Co, Ti, Si, Al, etc., added thereto in a manner to contain 0.14 to 1.8% by weight of C.

(ii) Setting of Shape of Cam Shaft Blank

This setting step is effected using a setting apparatus similar to that described above, but the conditions therefor are of a temperature of 950° to 1,200° C., a pressing force of 150 to 450 kg and a pressing time of 5 to 15 sec. for the cam shaft blank $2_2$.

[III] Production of Cam Shaft of Aluminum Alloy Casting

The mold casting apparatus M2 for the above-described cast steel cam shaft is used for casting a cam shaft blank $2_2$. In a casting operation, a molten metal of an aluminum alloy composition corresponding to JIS ADC 12 given in Table III is first prepared.

TABLE III

| Chemical constituents (% by weight) | | | | | | | |
|---|---|---|---|---|---|---|---|
| Cu | Si | Mg | Zn | Fe | Mn | Ni | Sn |
| 1.5–3.5 | 9.6–12.0 | ≦0.3 | ≦1.0 | ≦1.3 | ≦0.5 | ≦0.5 | ≦0.3 |

Figure 15:
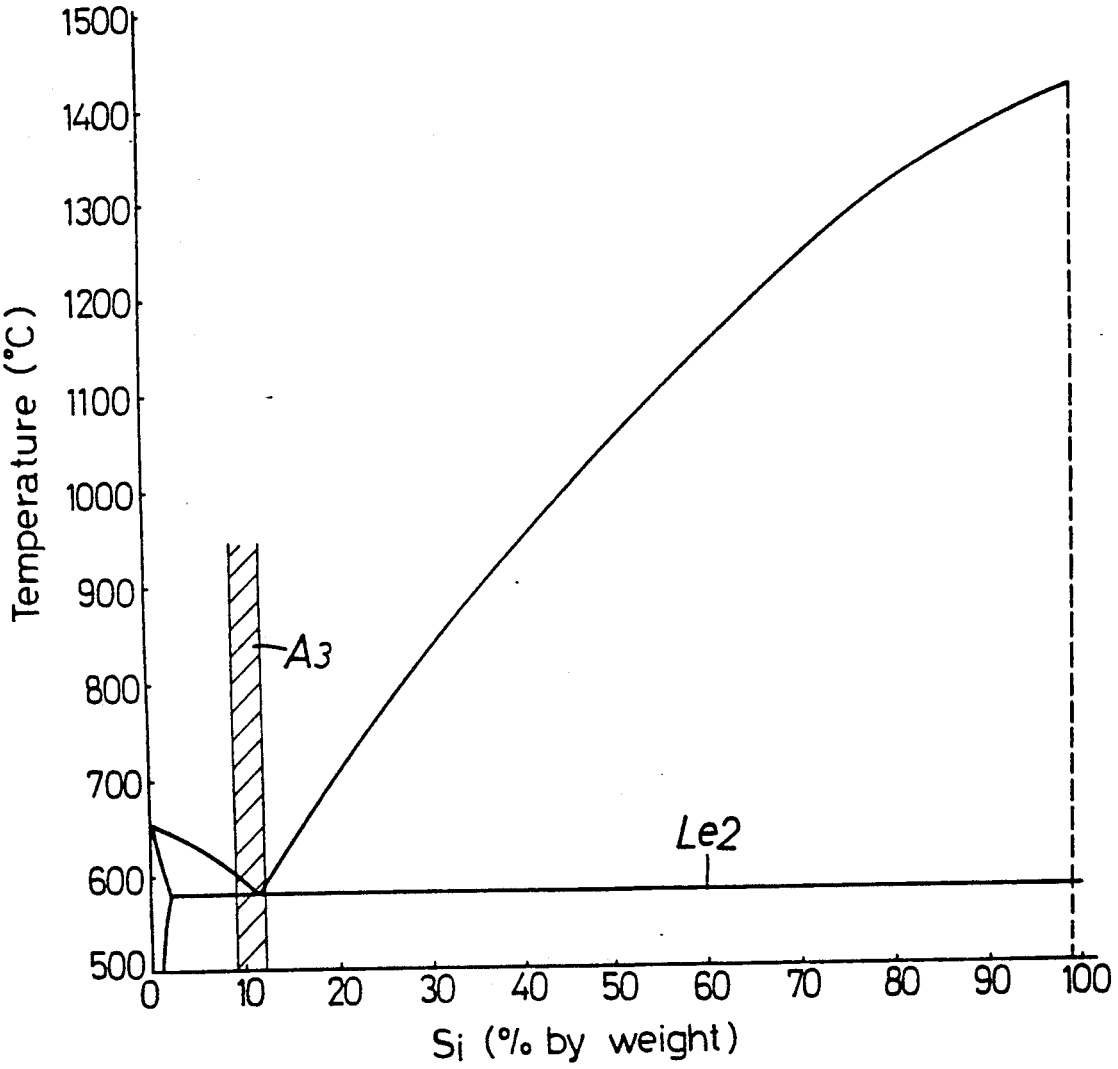
FIG. 15 is an equilibrium state diagram of an Al-Si system.

The aluminum alloy is in a composition range A3 indicated by an obliquely-lined region in an Al-Si equilibrium phase diagram shown in FIG. 15, wherein an eutectic line Le2 intersects the above composition range A3 at approximately 580° C.

The mold 28 is previously heated to a temperature of 100° to 300° C. by the heating circuit 34 prior to pouring. The molten aluminum alloy is poured into the mold 28 at a temperature of 700° to 740° C. to cast a cam shaft blank $2_2$. The amount of molten metal poured is 2.0 kg.

If the mold 28 has been previously heated as described above, the run of the molten metal is improved during pouring, and it is possible to avoid cracking of the resulting cam shaft blank $2_2$ and so on due to the rapid cooling of the molten metal.

After pouring is started, heating of the mold 28 by the heating circuit 34 is stopped and at the same time, the mold 28 is started to be cooled by the cooling circuit 35.

Figure 16:
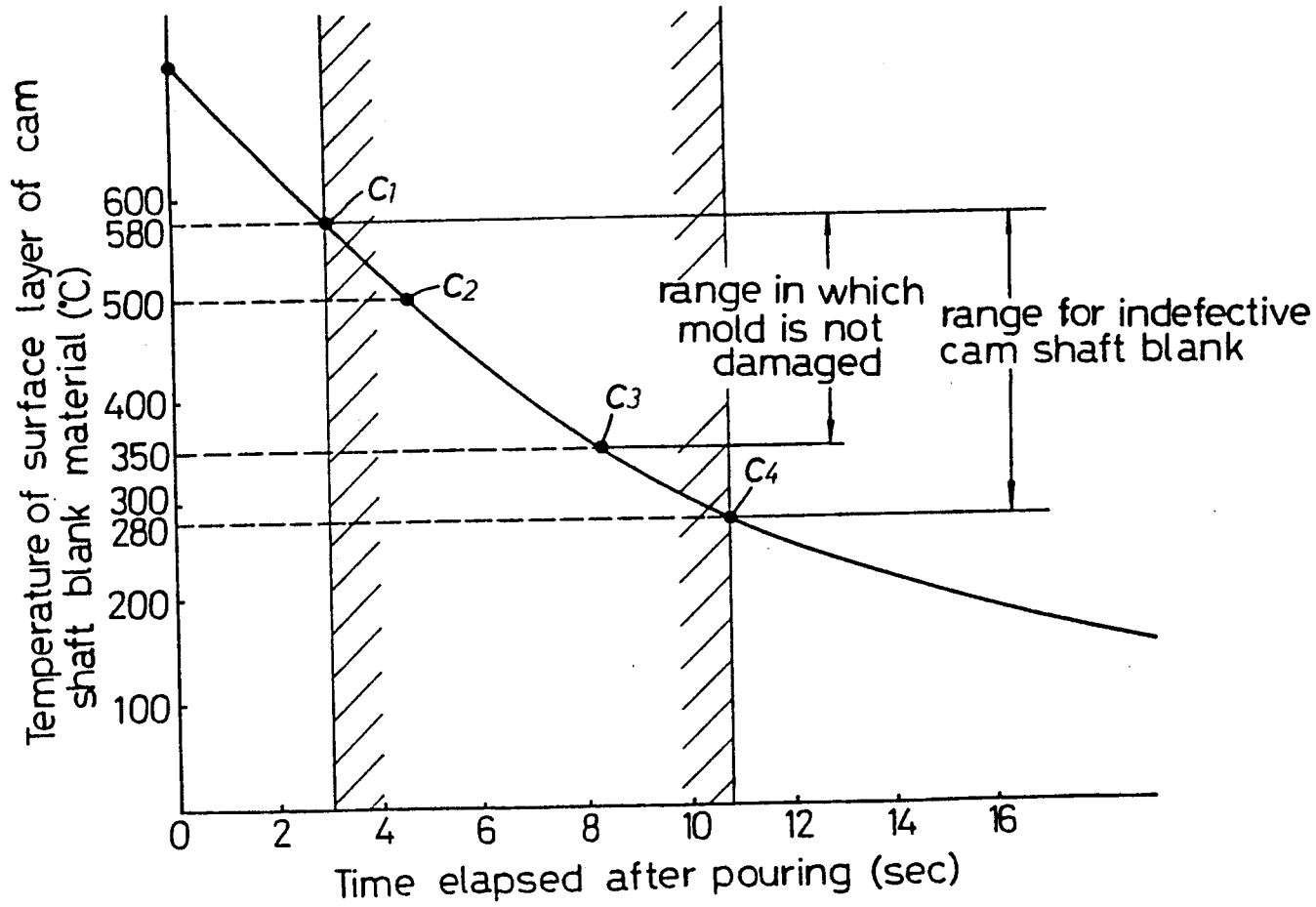
FIG. 16 is a graph illustrating a relationship between the temperature of a surface layer of a cam shaft blank material of an aluminum alloy casting and the time elapsed after pouring of a molten metal.

FIG. 16 illustrates a temperature drop for the surface layer of the cam shaft blank material $2_2$ in contact with the mold 28 in a relationship with the time elapsed after pouring.

The surface layer of the cam shaft blank material $2_2$ is rapidly cooled under a cooling effect of the mold 28, and when the temperature of the surface layer is dropped down to about 1,250° C. (eutectic crystal line Le2) indicated by a point $c_1$, the cam shaft blank material $2_2$ becomes solidified with the surface layer thereof converted into a shell-like solidified layer.

In this case, if the temperature of the surface layer is lower than 280° C. indicated by a point $c_4$, it is feared that thermal cracking may be produced in the resulting cam shaft blank $2_2$. In addition, if the temperature of the surface layer is lower than 350° C. indicated by a point $c_3$, it is also feared that adhesion of the resulting cam shaft blank $2_2$ to the mold 28 and so on may be produced due to the rapid and large solidificational shrinkage of the cam shaft blank material $2_2$ to cause damages such as deformation and wearing of the mold 28.

Thereupon, when the temperature of the surface layer of the cam shaft blank material $2_2$ has reached a temperature of 500° C. indicated by a point $c_2$ in about 4.5 seconds after pouring, the mold is opened, and the knock-out pin means 36 is operated to release the resulting cam shaft blank $2_2$ from the mold.

The cam shaft blank $2_2$ provided by the above procedure has no thermal crack produced therein, and the mold 28 is also not damaged in any way. Moreover, the cam shaft blank $2_2$ is covered with the shell-like solidified layer and hence, deformation in releasing thereof is suppressed to the utmost.

The optimal timing for releasing the casting of the aforesaid alloy is when the temperature of the surface layer thereof is in a range of about 580° to 350° C. and thus between the eutectic crystal line Le2 and 230° C. just therebelow, and experiments have made clear that the same is true even in the case of aluminum alloys such as Al-Cu, Al-Zn and the like.

(ii) Setting of Shape of Cam Shaft Blank

This setting step is effected using a setting apparatus similar to that described above, but the conditions therefor are of a temperature of 300° to 500° C., a pressing force of 130 to 300 kg and a pressing time of 5 to 15 sec. for the cam shaft blank $2_2$.

It should be noted that the heating-temperature controller 17, 39 may be designed to have a function of reducing output from the heating circuit 8, 34 and thus decreasing an energizing current for each heater 12, 38 after starting of pouring in each of the above-described casting steps [I] to [III].

[IV] Casting of Cam Shaft Blank of Cast Iron

Figure 17:
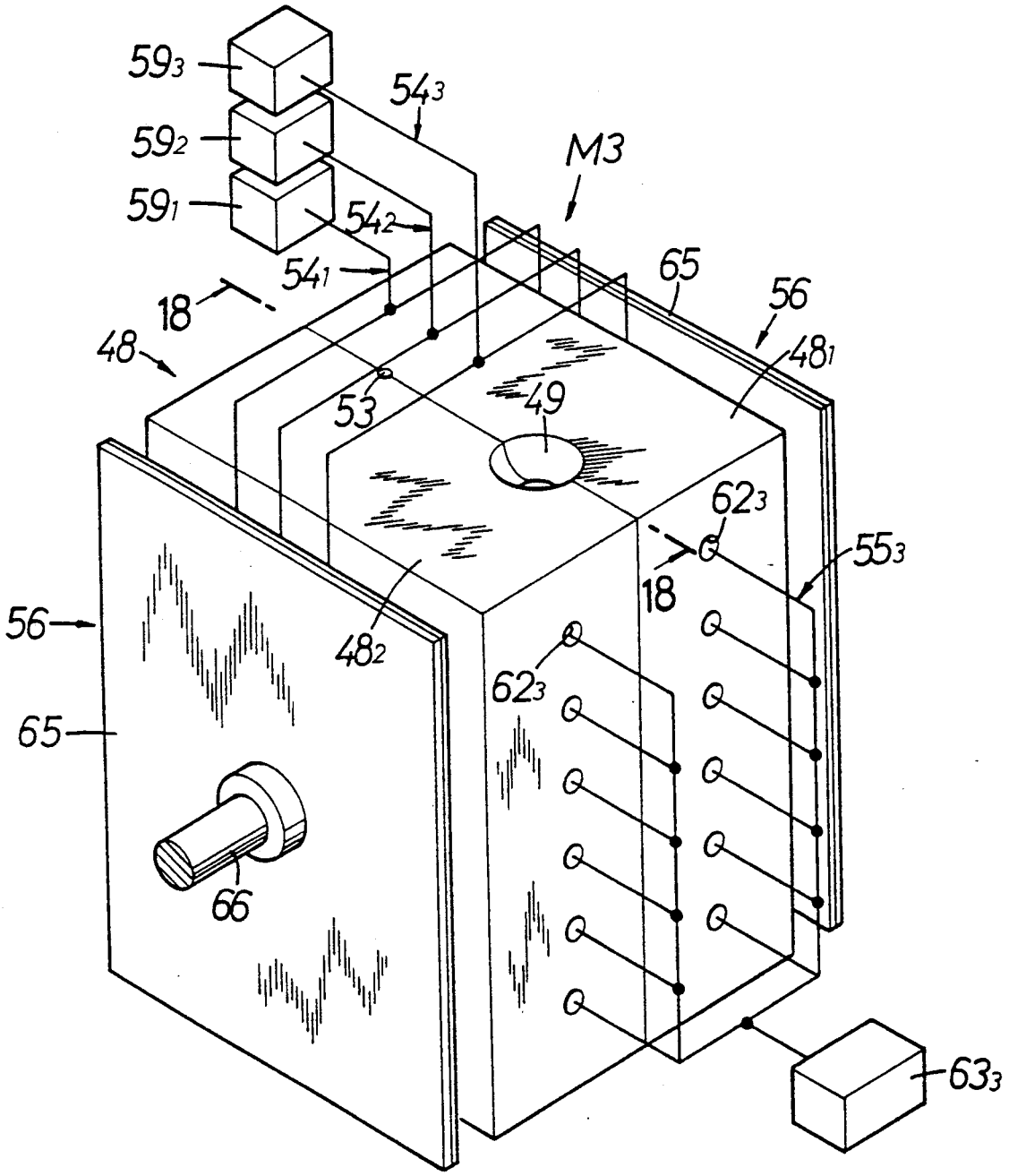
Figure 18:
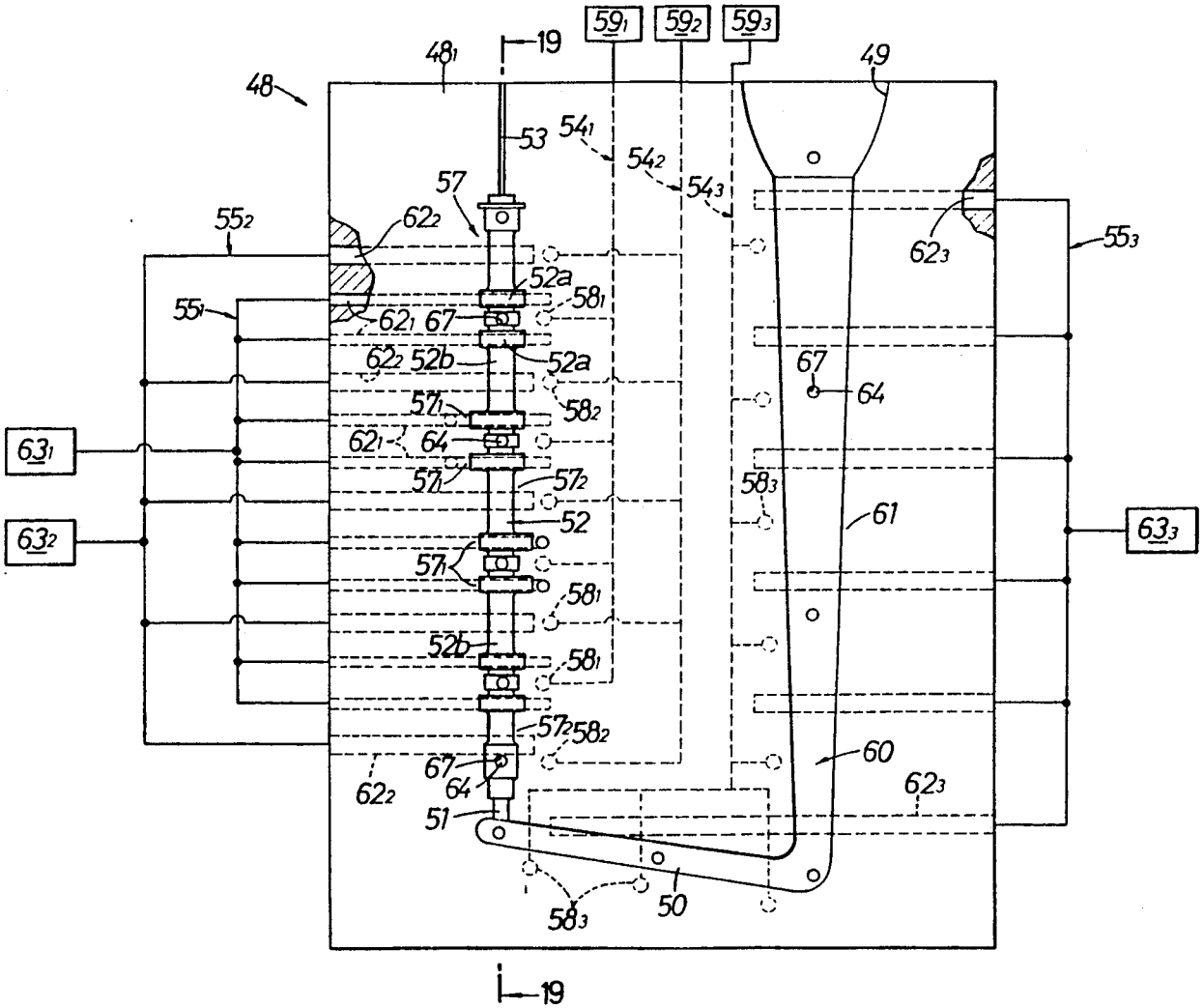
Figure 19:
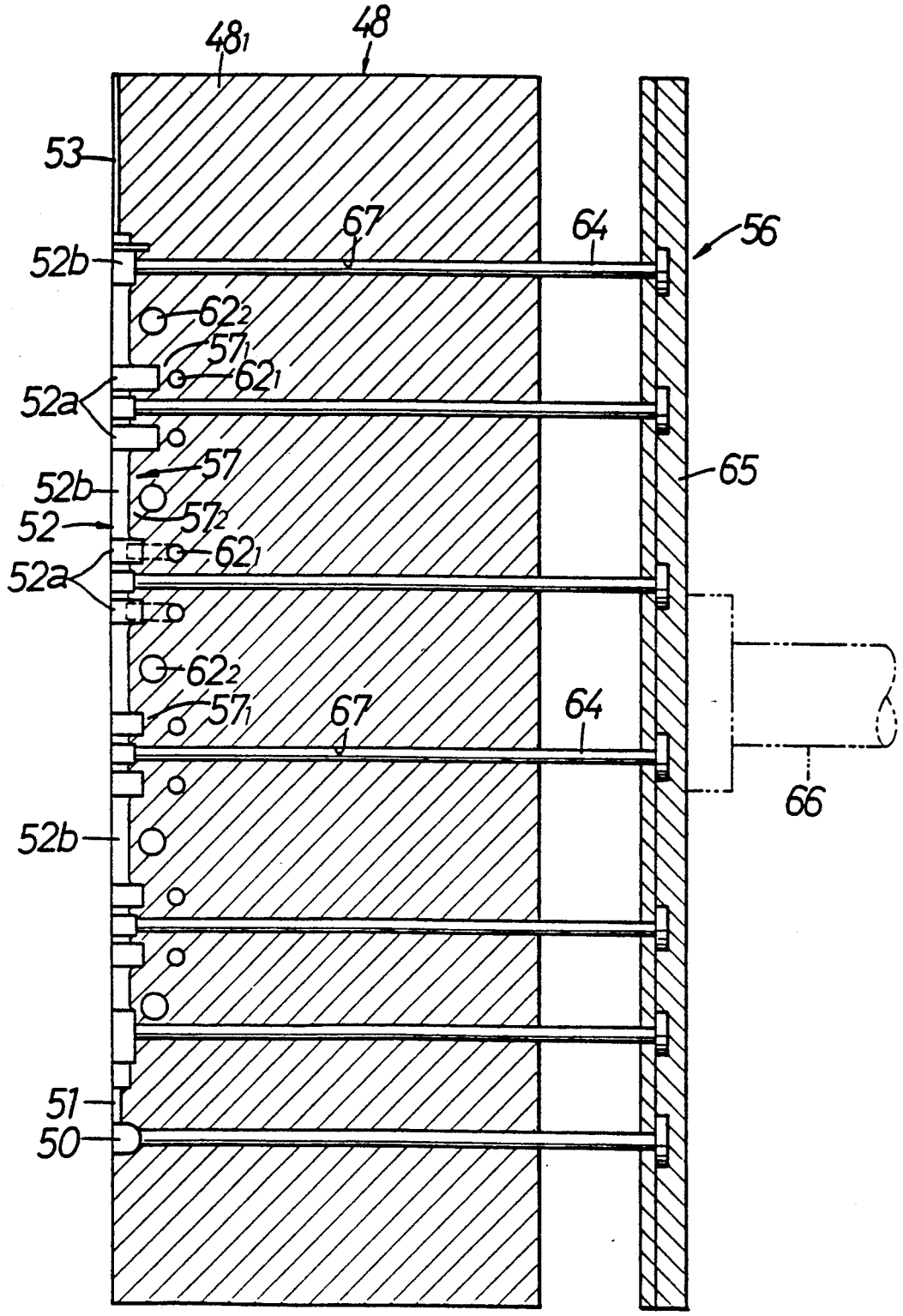

FIGS. 17 to 19 shows a mold casting apparatus M3 including a mold 48. The apparatus M3 is used to cast a cam shaft blank $2_1$ as a cast iron casting, as shown in FIG. 4.

The mold 48 is of the same material as described in the above item [I].

The mold 48 is constructed of a first die $48_1$ and a second die $48_2$ into a split type, and opened and closed by an operating device which is not shown. The mold surfaces of the first and second dies $48_1$ and $48_2$ define a sprue 49, a runner 50, a gate 51, a cam shaft blank-molding cavity 52 and a vent hole 53.

Each of the first and second dies $48_1$ and $48_2$ is provided with first to third preheating mechanisms $54_1$ to $54_3$, first to third cooling mechanisms $55_1$ to $55_3$ and knock-out means 56. These portions are the same for both the dies $48_1$ and $48_2$ and hence, only those for the first die $48_1$ will be described below.

The first preheating mechanism $54_1$ comprises heaters $58_1$ each disposed in each of first sections $57_1$ each defining a cam portion shaping region 52*a* in a cavity defining portion 57 of the first die $48_1$, and a first preheating-temperature controller $59_1$ connected to the individual heaters $58_1$.

The second preheating mechanism $54_2$ comprises heaters $58_2$ each disposed in each of second sections $57_2$ each defined a shank portion shaping region 52*b* for molding each journal portion 2*b* and smaller diameter portion 2*d* in the cavity defining portion 57, and a second preheating-temperature controller $59_2$ connected to the individual heaters $58_2$.

The third preheating mechanism $54_3$ comprises a plurality of heaters $58_3$ disposed in a molten metal passage defining portion 61 of the first die $48_1$ for defining a molten metal passage consisting of the sprue 49, the runner 50 and the gate 51, and a third preheating-temperature controller $59_3$ connected to the individual heaters $58_3$.

The first cooling mechanism $55_1$ comprises cooling water passages $62_1$ each mounted to extend through each of first sections $57_1$ in the cavity defining portion 57 of the first die $48_1$, and a first cooling-temperature controller $63_1$ connected to the individual cooling water passages $62_1$.

The second cooling mechanism $55_2$ comprises cooling water passages $62_2$ each mounted to extend through each of second sections $57_2$ in the cavity defining portion 57, and a second cooling-temperature controller $63_2$ connected to the individual cooling water passages $62_2$.

The third cooling mechanism $55_3$ comprises a plurality of cooling water passages $62_3$ mounted to extend through the molten metal passage defining portion 61 of the first die $48_1$, and a third cooling-temperature controller $63_3$ connected to the individual cooling water passages $62_3$.

The knock-out means 56 comprises a plurality of pins 64, a support plate 65 for supporting one ends of the knock-out pins 64, and an operating member 66 connected to the support plate 65. Each of the pins 64 is slidably received in each of insertion holes 67 provided in the first die $48_1$ and opened into the sprue 49, the runner 50 and the cavity 52. In the cavity 52, an opening of each insertion hole 67 is disposed in the shunk portion shaping region 52*b*.

Description will be made of an operation for casting the cam shaft blank $2_1$ in the above-described mold casting apparatus M3.

First, there is prepared a molten metal of a cast iron composition corresponding to JIS FC20 to FC30 given in Table IV.

TABLE IV

| Chemical constituents (% by weight) | | | | |
|---|---|---|---|---|
| C | Si | Mn | P | S |
| 3.2–3.6 | 1.7–1.8 | 0.5–0.7 | ≦0.1 | <0.1 |

In a Fe-C equilibrium phase diagram shown in FIG. 5, the eutectic crystal line Le1 intersects a composition region of the above cast iron at approximately 1,150° C.

Into the molten metal, there is added 0.15% by weight of Fe-Si, so that the resulting cam shaft blank $2_1$ has a composition given in Table V.

TABLE V

| Chemical constituents (% by weight) | | | | |
|---|---|---|---|---|
| C | Si | Mn | P | S |
| 3.2–3.6 | 1.9–2.1 | 0.5–0.7 | ≦0.1 | ≦0.1 |

Figure 20:
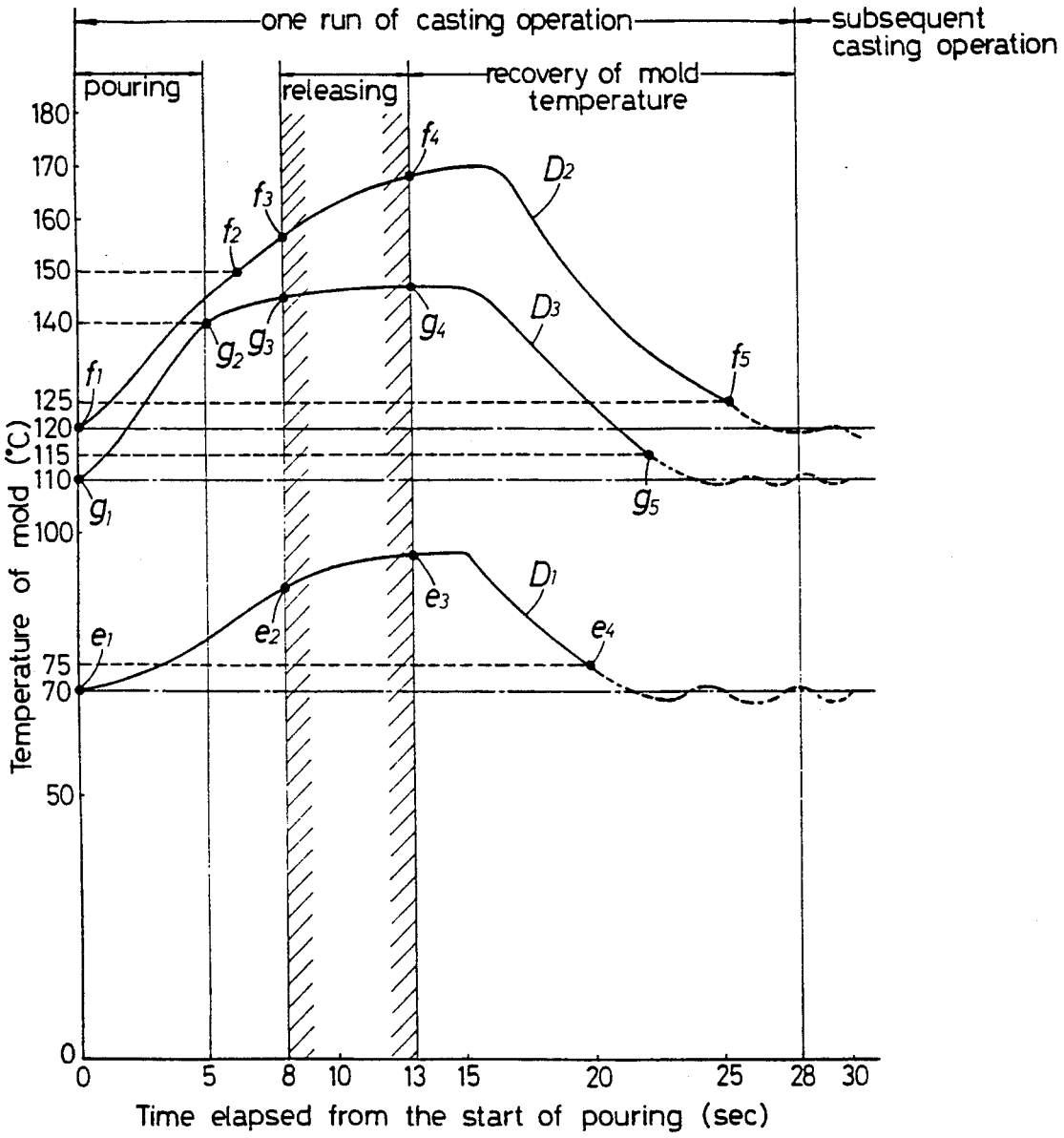
FIG. 20 is a graph illustrating a relationship between the temperature of a mold and the time elapsed from the start of pouring of a molten metal for a cast iron cam shaft blank.

The mold 48 is preheated by the individual preheating mechanisms $54_1$ to $54_3$ prior to pouring, as shown in FIG. 20, so that the individual sections $57_1$ defining the corresponding cam portion shaping regions 52*a* are maintained at approximately 70° C. as indicated by a point $e_1$ of a line D1; the individual second sections $57_2$ defining the corresponding shunk portion shaping regions 52*b* are at approximately 120° C. as indicated by a point $f_1$ of a line D2, and the molten metal passage defining portion 61 is at approximately 110° C. as indicated by a point g1 of a line D3. The molten metal after inoculation is poured into the mold 48 at a temperature of 1,380° to 1,420° C. to cast a cam shaft blank $2_1$. The amount molten metal poured is of 5 kg.

If the mold 48 has been previously preheated as described above, the run of the molten metal during pouring is improved, and it is possible to avoid cracking and the like of the cam shaft blank $2_1$ due to the rapid cooling of the molten metal.

As indicated by the point $e_1$ of the line D1 in FIG. 20, the first cooling mechanism $55_1$ is operated at the same time as the starting of pouring, thereby starting the cooling of the individual first sections $57_1$ to most rapidly cool the molten metal present in the individual cam portion shaping regions 52*a* for achivement of chilling of each of the resulting cam portions 2*a*.

In addition, as indicated by a point $g_2$ of the line D3 in FIG. 20, the third cooling mechanism $55_3$ is operated just at the end of pouring, thereby starting the cooling of the molten metal passage defining portion 61 to start the rapid solidification of the molten metal located in the molten metal passage 60 into a early solidified state.

Further, when the temperature of the individual second section $57_2$ has reached 145° to 180° C., e.g., 150° C. as indicated by a point $f_2$ of the line D2 in FIG. 20, the second cooling mechanism $55_2$ is operated to start the cooling of the individual second sections $57_2$ to rapidly cool the molten metal located in the individual shunk portion shaping regions 52*b*.

As seen in FIG. 6, if the surface layer of the cam shaft blank material $2_1$ is rapidly cooled under the above-described cooling effect until the temperature thereof drops to about 1,150° C. (eutectic crystal line Le1) indicated by the point $a_1$, the cam shaft blank material $2_1$ becomes solidified with its surface layer converted to a shell-like solidified layer.

In this case, if the temperature of the surface layer is lower than 700° C. indicated by the point $a_5$, it is feared that thermal cracking may be produced in the resulting cam shaft blank $2_1$. In addition, if the temperature of the surface layer is lower than 800° C. indicated by the point $a_4$, it is also feared that adhesion of the resulting cam shaft blank $2_1$ to the mold 48 and so on may be produced due to the solidificational shrinkage of the cam shaft blank material $2_2$ to cause damage such as deformation and wearing of the mold 48.

Thereupon, when the temperature of the surface layer of the cam shaft blank material $2_2$ has reached 850° C. indicated by the point $a_3$ from 950° C. indicated by the point $a_2$ in about 3 to about 8 seconds after pouring, and when the temperatures of the individual portions $57_1$, $57_2$ and 61 of the mold 48 have reached ranges of points $e_2$ to $e_3$, points $f_3$ to $f_4$ and points $g_3$ to $g_4$ in FIG. 20, the mold is opened, and the knock-out pin means 56 is operated to release the resulting cam shaft blank $2_1$ and unnecessary portions shaped by the molten metal passage 60 from the mold.

Then, when the temperature of the first section $57_1$ is dropped down to approximately 75° C. as indicated by the points e4 of the line D1; the temperature of the second section $57_2$ is down to approximately 125° C. as indicated by a point $f_5$ of the line D2 and further, the temperature of the molten metal passage defining portion 61 is down to approximately 115° C. as indicated by a point $g_5$ of the line D3 in FIG. 20, the operations of the individual cooling mechanisms $55_1$ to $55_3$ are stopped to stop the cooling of the first and second sections $57_1$ and $57_2$ and the molten metal passage defining portion 61.

The first to third preheating mechanisms $54_1$ to $54_3$ are operative even after the start of pouring to control the temperatures of the first and second sections $57_1$ and $57_2$ and the molten metal passage defining portion 61 as indicated by the lines $D_1$ to $D_3$, so that the temperatures of the first and second sections $57_1$ and $57_2$ and the molten metal passage defining portion 61 can be immediately restored to the preheated temperatures. This enables starting of the subsequent casting operation.

The cam shaft blank $2_1$ produced by the above procedure has no thermal cracking produced therein, and the mold 48 is also not damaged in any way. Moreover, the cam shaft blank $2_2$ is covered with the shell-like solidified layer and hence, cannot be deformed during release thereof. Even if it were deformed, the amount deformed is very slight.

Further, each first section $57_1$ is cooled just at the start of pouring and hence, the molten metal located in each cam portion shaping region 52*a* is rapidly cooled, thereby ensuring that each cam portion 2*a* can be reliably chilled.

Figure 21A:
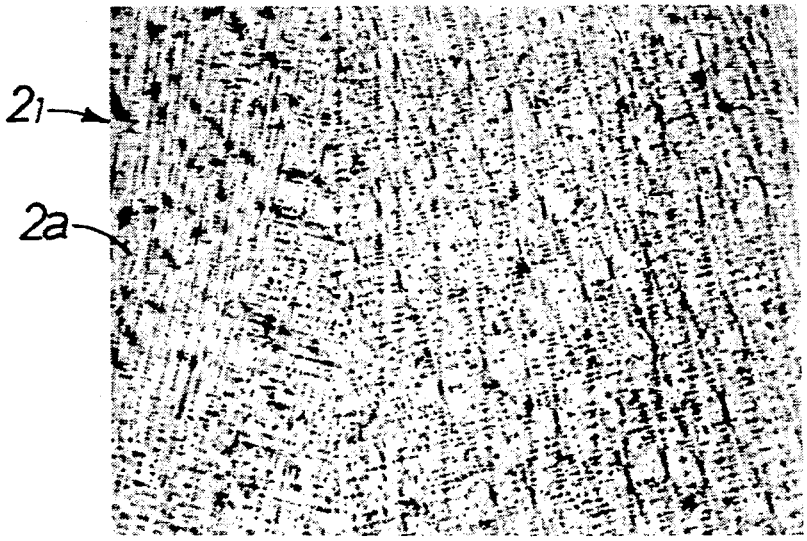
FIGS. 21A and 21B are microphotographs each showing a metallographical structure of a cast iron cam shaft blank.
Figure 21B:
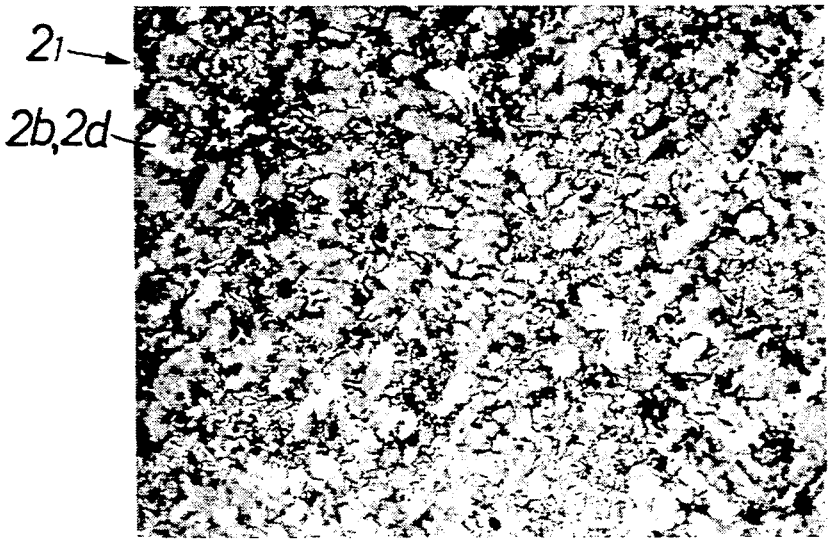

FIG. 21A illustrates a microphotograph (100 times) showing a metallographic structure of the cam portion 2*a*, and FIG. 21B illustrates a microphotograph (100 times) showing metallographic structures of the journal portion 2*b* and the smaller diameter portion 2*d*. It is apparent from FIG. 21A that a white elongated cementite crystal is observed in the structure of the cam portion 2*a* and this demonstrates that the cam portion 2*a* is chilled.

When the cavity defining portion 57 and the molten metal passage defining portion 61 have been cooled until the surface layer of the cam shaft blank material $2_1$ has became a solidified layer, as described above, the resulting cam shaft blank is released from the mold. In addition, after releasing, a preheated-temperature restoring operation conducted for both the defining portions 57 and 61 by the above-described procedure makes it possible to achieve one run of the casting operation in an extremely short time of about 28 seconds as apparent from FIG. 20, leading to an improvement in productivity.

The optimal timing for releasing the cast iron castings of the cast irons corresponding to the above-described JIS FC20 to FC30 is when the temperature of the surface layer thereof is in a range of about 1,150° to 800° C. and thus between the eutectic crystal line Le1 and 350° C. therebelow, and experiments have made clear that the same is true even in the case of cast iron castings employing other cast irons such as a spheroidal graphite cast iron.

It is noted that the above-described cooling operation is conducted according to the lines D2 and D3 for a casting having no chilled portion.

[V] Casting of Cam Shaft Blank of Cast Steel

Figure 13:
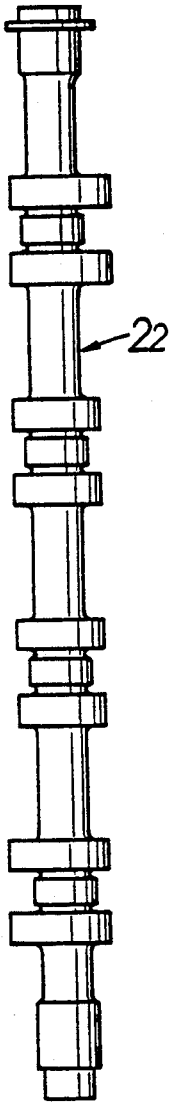
FIG. 13 is a front view of a cam shaft blank.
Figure 22:
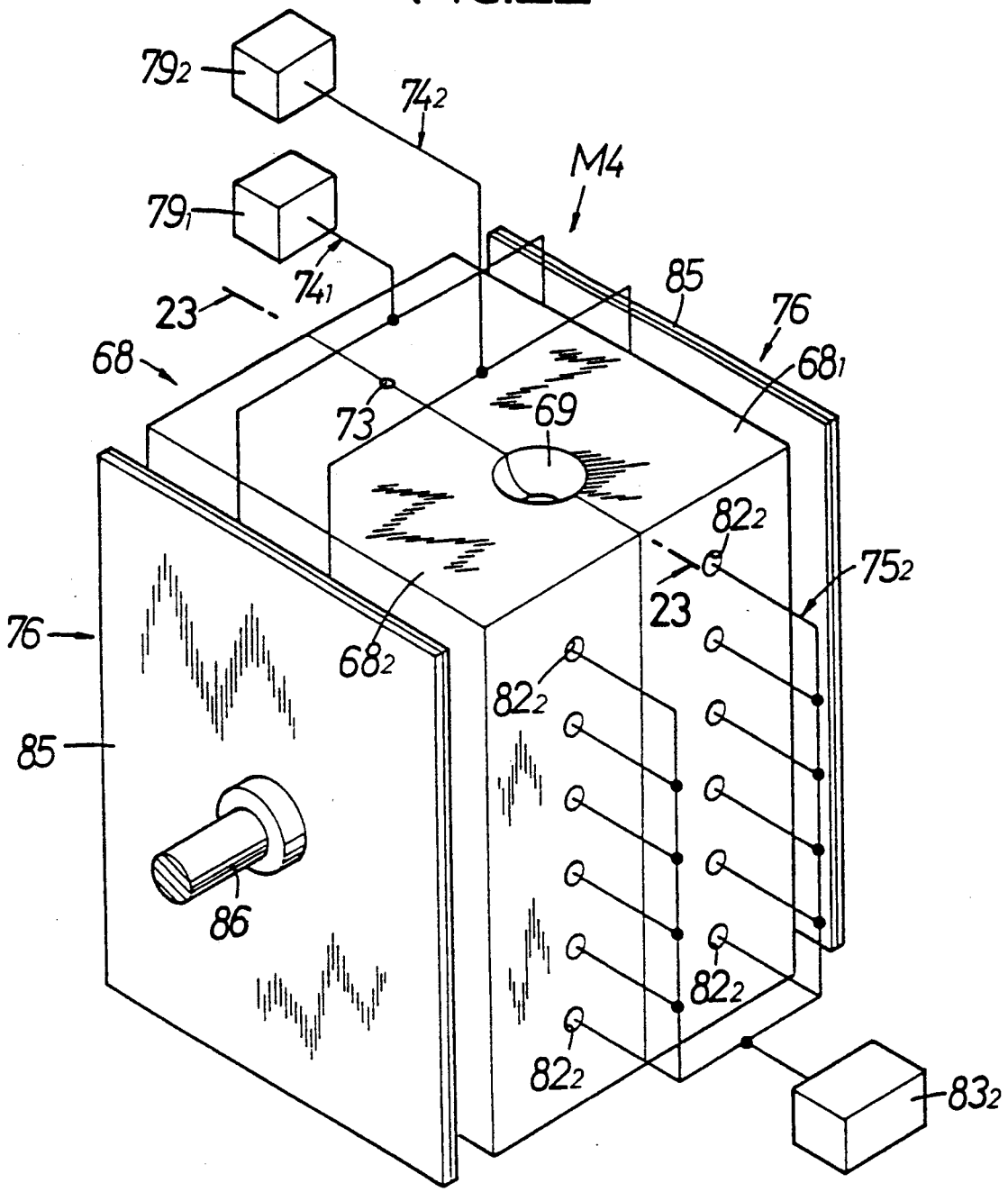
Figure 23:
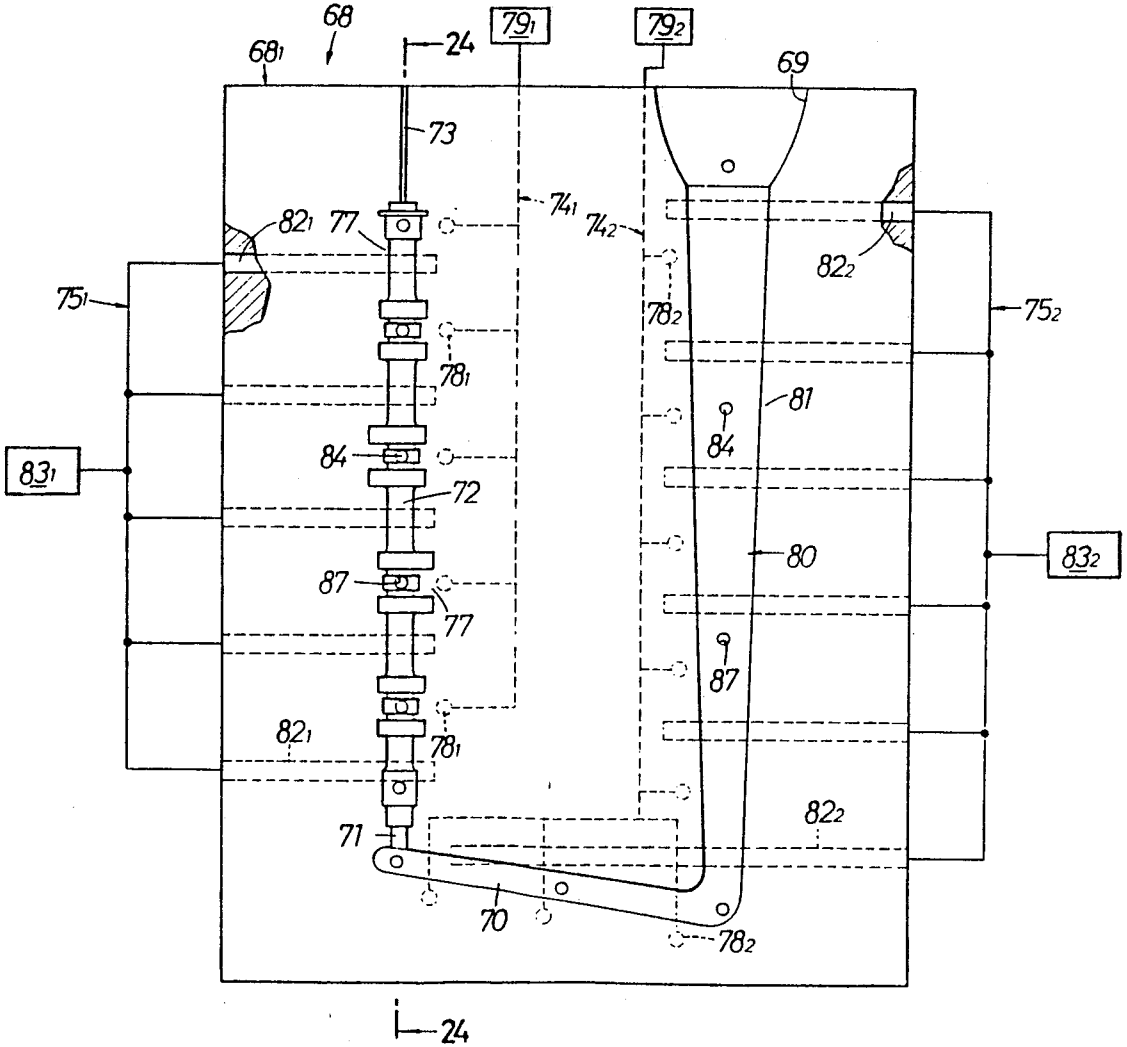
Figure 24:
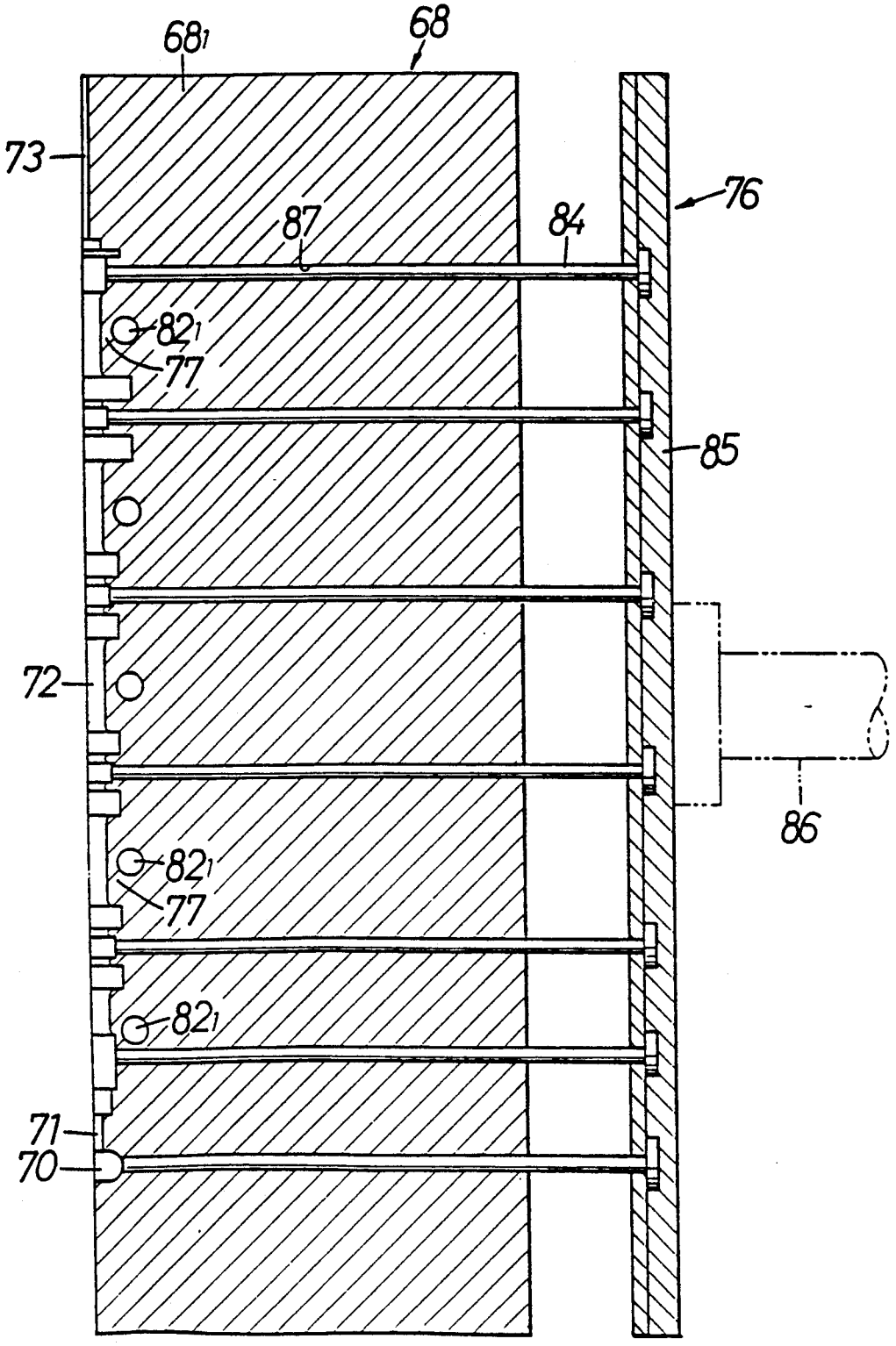

FIGS. 22 to 24 show a mold casting apparatus M4 including a mold 68. The apparatus M4 is used to cast a cam shaft blank $2_2$ as shown in FIG. 13 as a steel casting.

The mold 68 is formed of a Cu-Cr alloy in the same manner as described above. The mold 68 is constructed of a first die $68_1$ and a second die $68_2$ into a split type, and opened and closed by an operating device which is not shown. The mold surfaces of the first and second dies $68_1$ and $68_2$ define a sprue 69, a runner 70, a gate 71, a cam shaft blankmolding cavity 72 and a vent hole 73.

Each of the first and second dies $68_1$ and $68_2$ is provided with first and second preheating mechanisms $74_1$ and $74_2$, first and second cooling mechanisms $75_1$ and $75_3$, and knock-out means 76. These portions are the same for both the dies $68_1$ and $68_2$ and hence, only those for the first dies $68_1$ will be described below.

The first preheating mechanism $74_1$ comprises a plurality of heaters $78_1$ disposed in a cavity defining portion 77 of the first die $68_1$, and a first preheating-temperature controller $79_1$ connected to the individual heaters $78_1$.

The second preheating mechanism $74_3$ comprises a plurality of heaters $78_2$ disposed in a molten metal passage defining portion 81 of the first die $68_1$ for defining a molten metal passage consisting of the sprue 69, the runner 70 and the gate 71, and a second preheating-temperature controller $79_3$ connected to the individual heaters $78_3$.

The first cooling mechanism $75_1$ comprises a plurality of cooling water passages $82_1$ mounted to extend through the cavity defining portion 77 of the first die $68_1$, and a first cooling-temperature controller $83_1$ connected to the individual cooling water passages $82_1$.

The second cooling mechanism $75_3$ comprises a plurality of cooling water passages $82_2$ mounted to extend through the molten metal passage defining portion 81 of the first die $68_1$, and a second cooling-temperature controller $63_3$ connected to the individual cooling water lines $82_2$.

The knock-out means 76 comprises a plurality of pins 84, a support plate 85 for supporting one ends of the knock-out pins 84, and an operating member 86 connected to the support plate 85. Each of the pins 84 is slidably received in each of insertion holes 87 provided in the first die $68_1$ and opened into the sprue 69, the runner 70 and the cavity 72.

Description will be made of an operation for casting the cam shaft blank $2_2$ in the above-described mold casting apparatus M4.

A molten metal of the same alloy cast steel composition as that described in the item [II] is prepared and subjected to similar primary and secondary deacidifying treatments.

Figure 25:
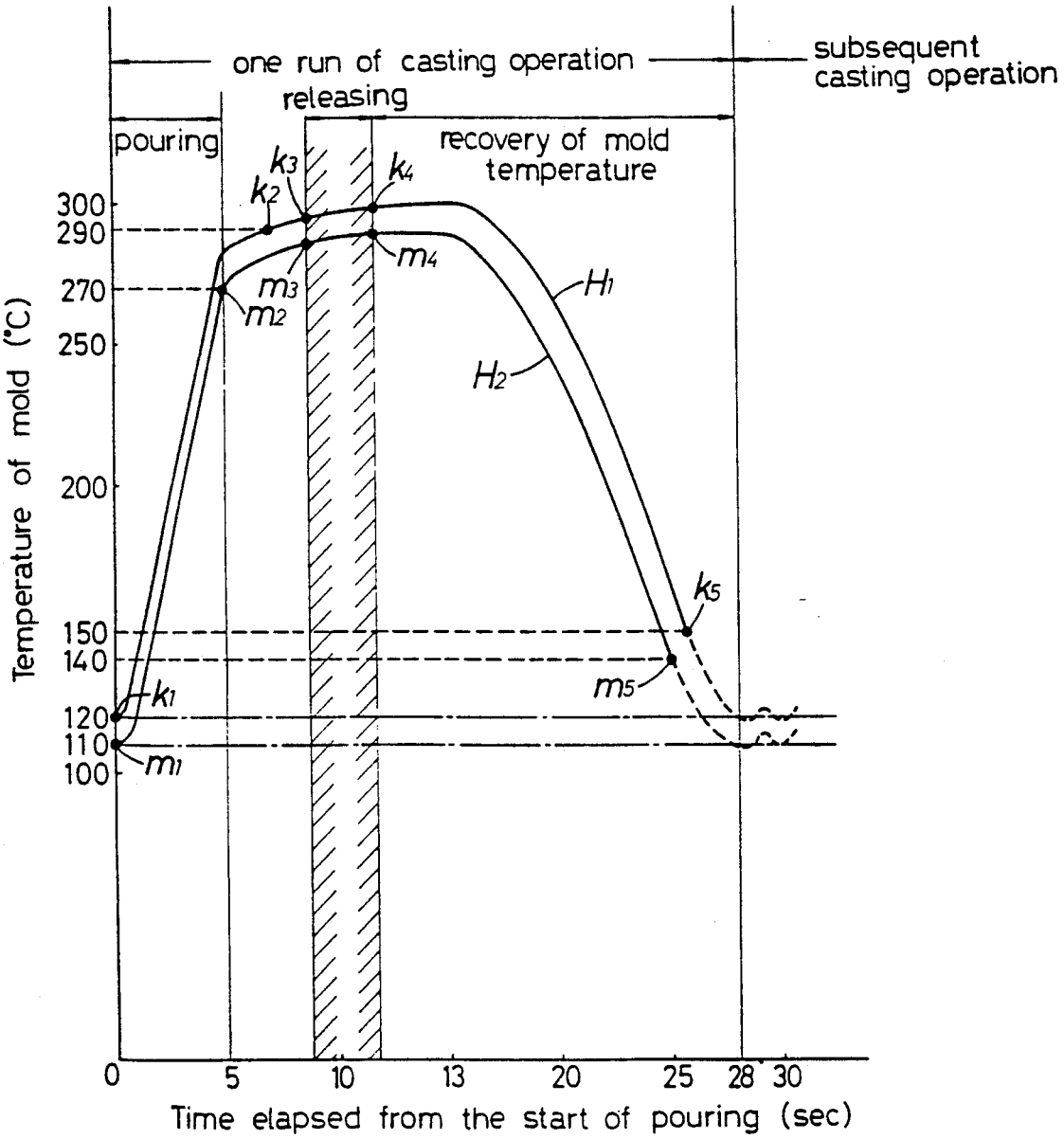
FIG. 25 is a graph illustrating a relationship between the temperature of a mold and the time elapsed from the start of pouring of a molten metal for a cast steel cam shaft blank.

The mold 68 is preheated by both preheating mechanisms $74_1$ to $74_2$ prior to pouring, as shown In FIG. 25, so that the cavity defining portion 77 is maintained at approximately 120° C. as indicated by a point $k_1$ of a line H1, and the molten metal passage defining portion 81 is also at approximately 110° C. as indicated by a point $m_1$ of a line $H_2$. The molten metal deacidified is poured into the mold 68 at a temperature of 1,630° to 1,670° C. to cast a cam shaft blank $2_2$. The amount of molten metal poured at this time is 5.0 kg.

If the mold 68 has been previously preheated as described above, the run of the molten metal during pouring is improved, and it is possible to avoid cracking and the like of the resulting cam shaft blank $2_2$ due to the rapid cooling of the molten metal.

As indicated by a point $m_2$ of the line H1 in FIG. 25, the second cooling mechanism $75_2$ is operated at the same time as the start of pouring, thereby starting the cooling of the molten metal passage defining portion 81 to start the rapid solidification of the molten metal located in the molten metal passage 80 into an early solidified state.

In addition, when the temperature of the cavity defining portion 77 has reached 280° to 330° C., e.g., 290° C.

as indicated by a point $k_2$ of the line H1 in FIG. 25, the first cooling mechanism $75_1$ is operated to start cooling of the cavity defining portion 77 to rapidly cool the molten metal located in the cavity 72.

As seen in FIG. 6, if the surface layer of the cam shaft blank material $2_2$ is rapidly cooled under the above-described cooling effect so that the temperature thereof drops to about 1,250° C. (solid phase line Ls) indicated by the point $b_1$, the cam shaft blank $2_2$ assumes a solidified state with its surface layer converted to a shell-like solidified layer.

In this case, if the temperature of the surface layer is lower than 950° C. indicated by the point $b_5$, it is feared that thermal cracking may be produced in the resulting cam shaft blank $2_2$. In addition, if the temperature of the surface layer is lower than 1,000° C. indicated by the point $b_4$, it is also feared that adhesion of the resulting cam shaft blank $2_2$ to the mold 68 and so on may be produced due to the rapid and large solidificational shrinkage of the cam shaft blank material $2_2$ to cause damage such as deformation and wearing of the mold 68.

Thereupon, when the temperature of the surface layer of the cam shaft blank material $2_2$ has reached 1,100° C. indicated by the point $b_2$ from 1,200° C. indicated by the point $a_3$ in about 3.5 to about 6.5 seconds after pouring, and also when the temperatures of both portions 77 and 81 of the mold 68 are in range of points $k_3$ to $k_4$ and points $m_3$ to $m_4$ in FIG. 25, the mold is opened, and the knock-out pin means 76 is operated to release the cam shaft blank $2_2$ and unnecessary portions shaped by the molten metal passage 80 from the mold.

Then, when the temperature of the cavity defining portion 77 is down to approximately 150° C. as indicated by a point $k_5$ of the line H2 and the temperature of the molten metal passage defining portion 81 is down to approximately 140° C. as indicated by a point $m_5$ of the line H3 in FIG. 25, the operations of the individual cooling mechanisms $75_1$ and $75_2$ are stopped to stop the cooling of the cavity defining portion 77 and the molten metal passage defining portion 81.

The first and second preheating mechanisms $74_1$ to $74_2$ are operative even after the start of pouring to control the temperatures of both defining portions 77 and 81 as indicated by the lines $H_1$ and $H_2$, so that the temperatures of both defining portions 77 and 81 can be immediately restored to the preheated temperatures after the cooling has been stopped. This enables starting of the subsequent casting operation.

The cam shaft blank $2_2$ produced by the above procedure has no thermal cracking produced therein, and the mold 48 is also not damaged in any way. Moreover, the cam shaft blank $2_2$ is covered with the shell-like solidified layer and hence, cannot be deformed during release thereof. Even if it were deformed, the amount deformed is very slight.

[VI] Casting of Cam Shaft Blank of Aluminum Alloy Casting

The mold casting apparatus M4 for the steel casting described in the above item [V] is used for casting a cam shaft blank $2_2$ as an aluminum alloy casting.

In a casting operation, a molten metal of the same aluminum alloy composition as that described in the item [III] is prepared.

Figure 26:
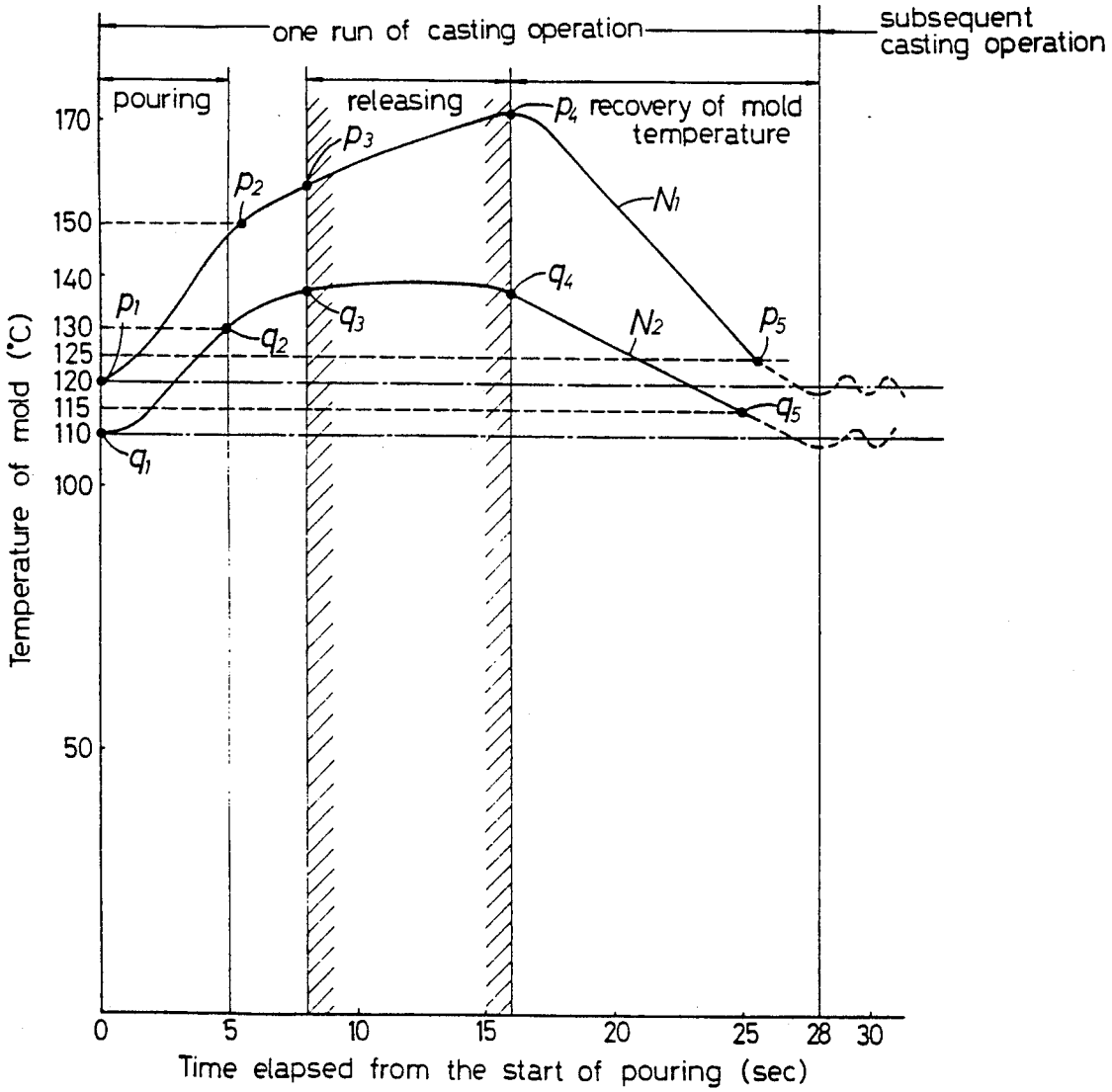
FIG. 26 is a graph illustrating a relationship between the temperature of a mold and the time elapsed from the start of pouring of a molten metal for a cam shaft blank of an aluminum alloy.

The mold 68 is preheated by both preheating mechanisms $74_1$ to $74_2$ prior to pouring, as shown in FIG. 26, so that the cavity defining portion 77 is maintained at approximately 120° C. as indicated by a point $p_1$ of a line N1, and the molten metal passage defining portion 81 is also at approximately 110° C. as indicated by a point $q_1$ of a line $N_2$. The molten metal of the aluminum alloy is poured into the mold 68 at a temperature of 700° to 740° C. to cast a cam shaft blank $2_2$. The amount of molten metal poured at this time is 2.0 kg.

If the mold 68 has been previously preheated as described above, the run of the molten metal during pouring is improved, and it is possible to avoid cracking and the like of the resulting cam shaft blank $2_2$ due to the rapid cooling of the molten metal.

As indicated by a point $q_2$ of the line N1 in FIG. 26, the second cooling mechanism $75_2$ is operated at the same time as the start of pouring, thereby starting the cooling of the molten metal passage defining portion 81 to start the rapid solidification of the molten metal located in the molten metal passage 80, bringing it early into a solidified state.

In addition, when the temperature of the cavity defining portion 77 has reached 140° to 170° C., e.g., 150° C. as indicated by a point $p_2$ of the line N1 in FIG. 26, the first cooling mechanism $75_1$ is operated to start the cooling of the cavity defining portion 77 to rapidly cool the molten metal located in the cavity 72.

As seen in FIG. 16, if the surface layer of the cam shaft blank material $2_2$ is rapidly cooled under the above-described cooling effect so that the temperature thereof drops to about 580° C. (eutectic crystal line Le2) indicated by the point $c_1$, the cam shaft blank $2_2$ assumes a solidified state with its surface layer converted to a shell-like solidified layer.

In this case, if the temperature of the surface layer is lower than 280° C. indicated by the point $c_4$, it is feared that thermal cracking may be produced in the resulting cam shaft blank $2_2$. In addition, if the temperature of the surface layer is lower than 350° C. indicated by the point c3, it is also feared that adhesion of the resulting cam shaft blank $2_2$ to the mold 68 and so on may be produced due to the rapid and large solidificational shrinkage of the cam shaft blank material $2_2$ to cause damage such as deformation and wearing of the mold 68.

Thereupon, when the temperature of the surface layer of the cam shaft blank $2_2$ has reached 500° C. indicated by the point $c_2$ in about 3.0 to about 10.8 seconds after pouring, and also when the temperatures of both portions 77 and 81 of the mold 68 are in range of points $p_3$ to $p_4$ and points $q_3$ to $q_4$ in FIG. 26, the mold is opened, and the knock-out pin means 76 is operated to release the resulting cam shaft blank $2_2$ and unnecessary portions shaped by the molten metal passage 80 from the mold.

Then, when the temperature of the cavity defining portion 77 is down to approximately 125° C. as indicated by a point $p_5$ of the line N2 and the temperature of the molten metal passage defining portion 81 is down to approximately 115° C. as indicated by a point $q_5$ of the line N3 in FIG. 26, the operations of the individual cooling mechanisms $75_1$ and $75_2$ are stopped to stop the cooling of the cavity defining portion 77 and the molten metal passage defining portion 81.

The first and second preheating mechanisms $74_1$ to $74_2$ are operative even after start of pouring to control the temperatures of both defining portions 77 and 81 as indicated by the lines $N_1$ and $N_2$, so that the temperatures of both defining portions 77 and 81 can be immediately restored to the preheated temperatures after the cooling has been stopped. This enables starting of the subsequent casting operation.

The cam shaft blank $2_2$ produced by the above procedure has no thermal cracking produced therein, and the mold 48 is also not damaged in any way. Moreover, the cam shaft blank $2_2$ is covered with the shell-like solidified layer and hence, cannot be deformed during release thereof. Even if it were deformed, the amount deformed is very slight.

Figure 27:
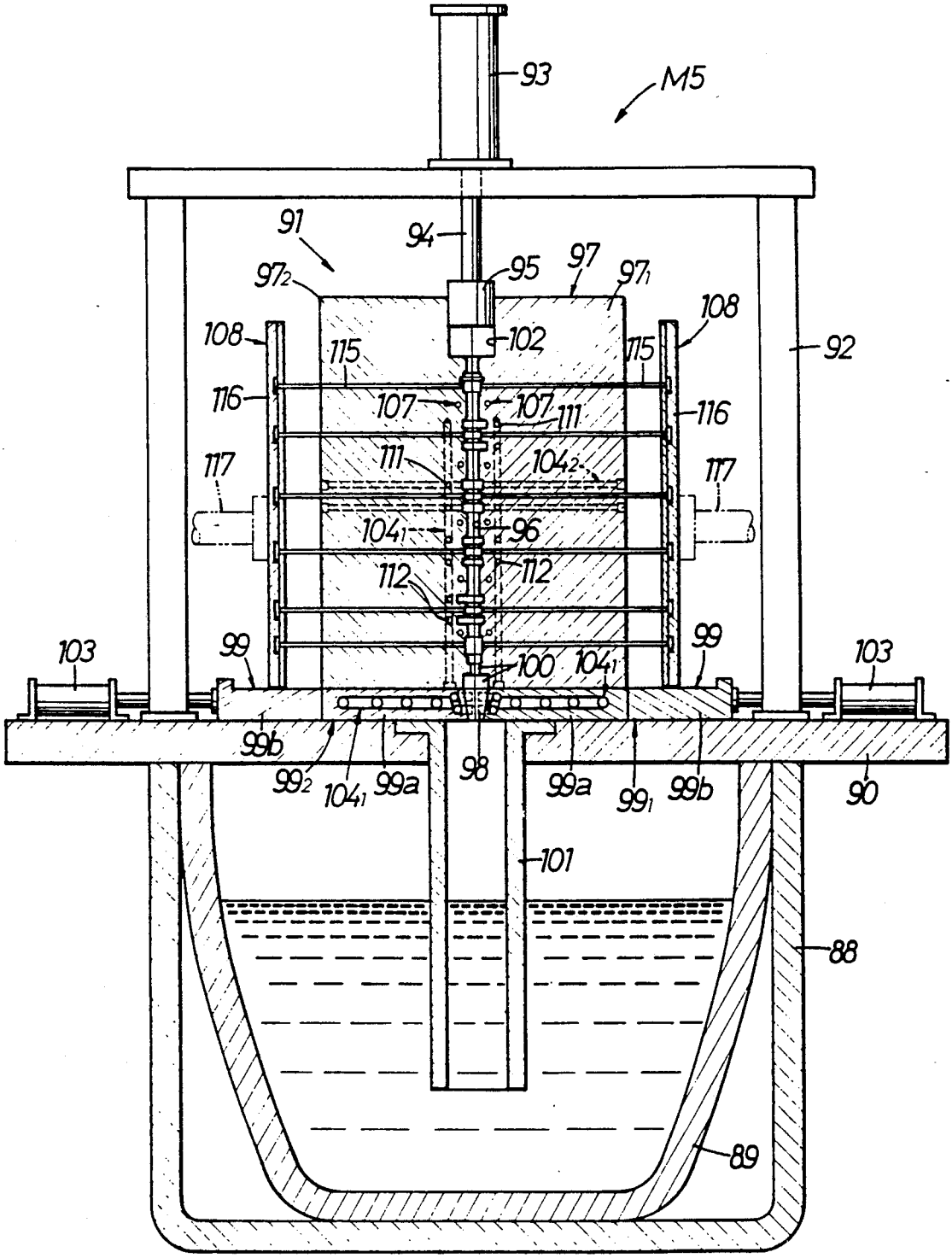
Figure 28:
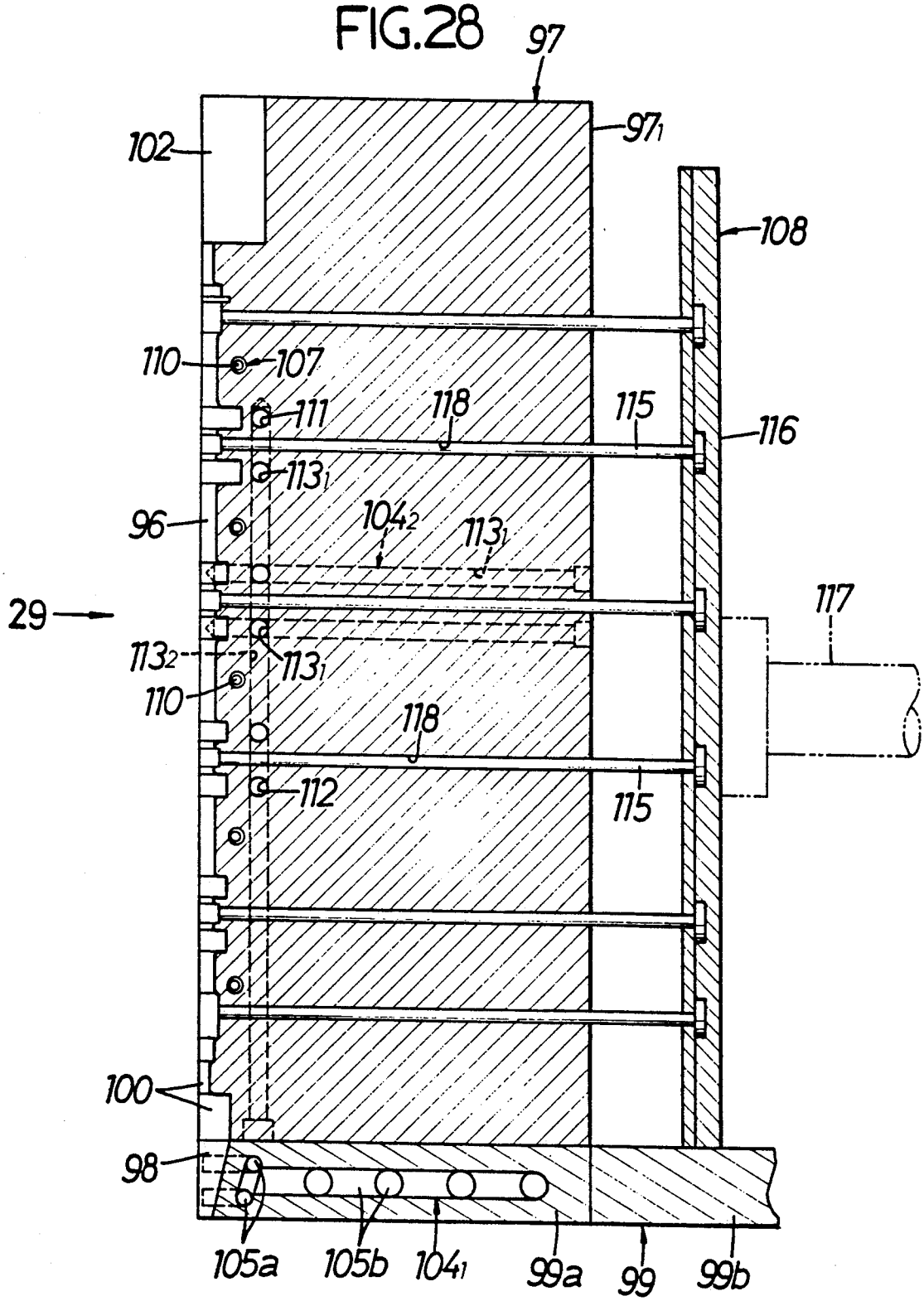
Figure 29:
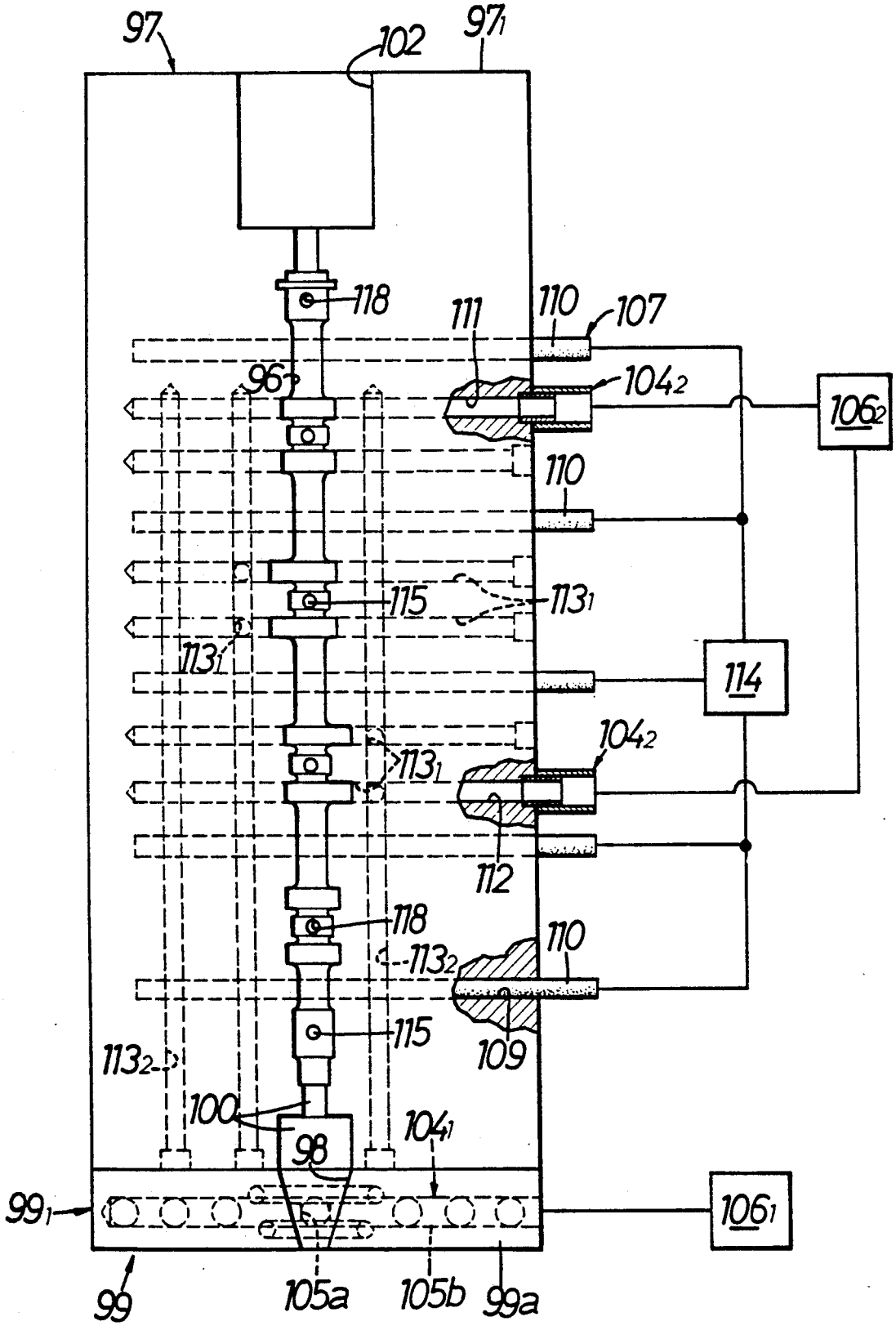

In some cases, cooling of the cavity defining portion 57, 77 in each of the casting operations in the items [IV] to [VI] may be started before completion of pouring, and cooling of the molten metal defining portion 61, 81 may be started immediately after completion of pouring. [VII] Casting of Cam Shaft Blank of Cast Iron FIGS. 27 to 29 shows a mold casting apparatus M5 which is used to cast a cam shaft blank $2_1$ as shown in FIG. 4 as a cast iron casting.

The mold casting apparatus M5 is constructed in the following manner.

Crucible 89 opened at its upper surface is contained within a heater 88 likewise opened at its upper surface, with upward openings of the heater 88 and the crucible 89 being closed by a lid 90. A mold 91 is disposed on the lid 90, and pressing means for pressing a molten metal present in a cavity of the mold 91, e.g., a pressing cylinder 93 in the illustrated embodiment is disposed, with its piston rod 94 directed upwardly, on a support frame 92 on the lid 90. The piston rod 94 has, at its lower end, a larger diameter portion 95 of a copper alloy, which is of a water-cooled construction, but instead thereof, a lower end portion of the larger diameter portion 95 may be formed of a ceramic material.

The mold 91 comprises a cavity defining portion 97 including a cavity 96 for casting a cam shaft blank, and a molten metal passage defining portion 99 having a frustoconical molten metal in communication with a lower end of the cavity 96. In the illustrated embodiment, the cavity 96 and the molten metal passage 98 communicate with each other through the cavity defining portion 97. The molten metal passage 98 communicates at its lower end with the crucible 89 through a molten metal supply pipe 101 suspended on the lid 99.

The cavity defining portion 97 is constructed of first and second components $97_1$ and $97_2$ into a split type, and mold surfaces of the two components $97_1$ and $97_2$ define a through hole 100, the cavity 96, and a pressing hole 102 communicating with the cavity 96 and adapted to slidably receive the larger diameter portion 95 of the piston rod 94. The two components $97_1$ and $97_2$ are opened and closed by an operating device which is not shown.

The molten metal defining portion 99 is also constructed of first and second blocks $99_1$ and $99_2$ into a split type in association with the cavity defining portion 97, and mold surfaces of the both blocks $99_1$ and $99_2$ define the molten metal passage 98. The reference numeral 103 designates an operating cylinder for opening and closing the two blocks $99_1$ and $99_2$.

The cavity defining portion 97 and an inner portion **99*a* of the molten metal passage defining portion 99 are formed of a highly heat conductive material, e.g., a Cu-Cr alloy containing 0.8 to 4% by weight of Cr, with a heat conductivity thereof being of 0.4 to 0.8 cal/cm-/sec./°C. An outer portion 99*b* of the molten metal passage defining portion 99** are formed of a steel.

In the molten metal passage defining portion 99, a first cooling circuit $104_1$ is mounted in each of the both inner portions **99*a*. The first cooling circuit $104_1$ includes a water passage 105*a* located around the molten metal passage 98, and a water passage 105*b* communicating with the water passage 105*a* and distributed throughout the inner portion 99*a*, with a supply port and a discharge port (both not shown) being provided in the water passage 105*b***.

The both first cooling circuits $104_1$ are connected to a first cooling-temperature controller $106_1$ which has a function for operating each of the first cooling circuit $104_1$ to rapidly cool and solidify the molten metal within the molten metal passage 98 after charging of the molten metal into the cavity 96, thereby closing the molten metal passage 98.

In the cavity defining portion 97, each of the first and second components $97_1$ and $97_2$ is provided with a heating circuit 107, a second cooling circuit $104_2$ and knock-out means 108. These portions are the same for the both components $97_1$ and $97_2$ and hence, only those for the first component $97_1$ will be described.

The heating circuit 107 is constituted of a plurality of insertion holes 109 perforated in the first component $97_1$, and bar-like heaters 110 inserted into and held in the corresponding insertion holes 109, respectively. Each of the insertion holes 109 is disposed with a portion thereof being in proximity to a region for shaping each smaller diameter portion **2*d*** of the cam shaft blank $2_1$ in the first component $97_1$.

The second cooling circuit $104_2$ comprises an upper inlet passage 111 horizontally made in the first component $97_1$, a lower outlet passage 112 likewise made in the first component $97_1$, and a plurality of communication passages $113_1$ and $113_2$ made in the first component $97_1$ to extend horizontally and vertically in an intersecting relation to each other to connect the inlet and oulet passages 111 and 112, so that water introduced into the inlet passage 111 is passed via the individual communication passages $113_1$ and $113_2$ and discharged through the outlet passage 112. The inlet passage 111, the outlet passage 115 and the individual horizontal communication passages $113_1$ are disposed so that a portion of each of them may be in proximity to a region in the first component $97_1$ for shaping the nose **2*e* which is a chilled portion of the cam portion 2*a***.

The individual heaters 110 of the heating circuit 107 are connected to a heating-temperature controller 114 which has a function for activating the heating circuit 107 and thus energizing the individual heaters 110 to heat the first component $97_1$ prior to pouring of a molten metal into the cavity 96, and deactivating the heating circuit 107 and thus deenergizing the individual heaters 110 after starting of pouring.

During heating, each heater 110 is spaced apart from the nose **2*e* shaping region of the first component $97_1$ and hence, the temperature of that region is lower than other regions. Of course, the individual heaters 110 of the second component $97_2$ are also connected to the heating-temperature controller 114**.

The inlet passage 111 and the outlet passage 112 of the second cooling circuit $104_2$ are connected to a second cooling-temperature controller $106_2$ which includes a function for activating the second cooling circuit $104_2$ and thus permitting a cooling water to flow through the second cooling circuit $104_2$ to cool the first component $97_1$ after starting of pouring, thereby rapidly cooling a surface layer of the cam shaft blank material $2_1$ in contact with the first component $97_1$ to convert the surface layer into a shell-like solidified layer.

During cooling, the noses 2e can be rapidly cooled to ensure that they are reliably chilled, because the inlet passage 111, the outlet passage 112 and the individual horizontal communication passages $113_1$ are in proximity to the noses 2e shaping regions of the first component $97_1$ and also because those regions are at a lower temperature than that of other regions at the heating stage. Of course, the second cooling circuit $104_2$ of the second component $97_2$ is also connected to the second cooling-temperature controller $106_2$.

The knock-out means 108 comprises a plurality of pins 115, a support plate 116 for supporting one ends of the pins 115, and an operating member 117 connected to the support plate 116. Each of the pins 115 is slidably received in each of insertion holes 118 opened into the cavity 96.

The pressing cylinder 93 has a function for applying a pressing force to an unsolidified cam shaft blank material $2_1$ present in the cavity 96 to maintain it up to a releasing point, after the molten metal passage 98 has been closed.

The following is the description of an operation for casting a cam shaft blank $2_1$ in the above-described mold casting apparatus M5.

There is prepared a molten metal of the same cast iron composition as that described in the item [IV], and the molten metal is subjected to a similar inoculation, followed by placement into the crucible 89 for heating.

The cavity defining portion 97 is heated prior to pouring of the molten metal, so that a region for shaping each smaller diameter portion 2d is maintained at a temperature of 100° to 150° C., and the region for shaping the nose 2e is at a temperature of 50° to 100° C.

A gas pressure is applied to the surface of the molten metal in the crucible 89 at a molten metal temperature of 1380° to 1420° C. to pour the molten metal into the cavity 96 through the molten metal supply pipe 101, the molten metal passage 98 and the through hole 100, thereby casting a cam shaft blank $2_1$. The amount of molten metal poured at this time is 5 kg.

If the cavity defining portion 97 has been previously heated as described above, the running of the molten metal during pouring is improved, and it is possible to avoid cracking and the like of the cam shaft blank $2_1$ due to rapid cooling of the molten metal.

The pouring rate is controlled at a constant level in a range of 0.6 to 1.5 kg/sec., and this makes it possible to prevent the production of casting defects such as cavities and the like due to inclusion of gases, oxides and the like.

After starting of pouring, heating of the cavity defining portion 97 by the heating circuit 107 is stopped and at the same time, the cavity defining portion 97 is started to be cooled by the second cooling circuit $104_2$.

Then, after the molten metal has been charged into the cavity 96, the molten metal passage defining portion 99 is cooled by the first cooling circuit $104_1$, rapidly cooling and solidifying the molten metal in the molten metal passage 98 to close the latter. The operation of the first cooling circuit $104_1$ is continued immediately before releasing of the resulting cam shaft blank. The molten metal in the molten metal supply pipe 101 is passed back into the crucible 89 after solidification of the molten metal in the molten metal passage 98.

Then, the pressing cylinder 93 is operated to press the molten metal in the cavity 96, i.e., the unsolidified cam shaft blank material $2_1$ with a pressure of 0.8 to 1.2 kg/cm$^2$ by the larger diameter portion 95. This operation of the pressing cylinder 93 is continued immediately before releasing of the resulting cam shaft blank.

Thereafter, the resulting cam shaft blank $2_1$ is released from the mold, and the timing therefor is as described in the item [I] with reference to FIG. 6.

According to the above procedure, an effect similar to that in the item [I] can be provided and particularly, in this case, it is possible to provide a good quality cam shaft blank $2_1$ free from interal defects, because rapid cooling of the cam shaft blank material $2_1$ is conducted while applying a pressure.

[VIII] Casting of Cam Shaft Blank of Cast Steel

Figure 30:
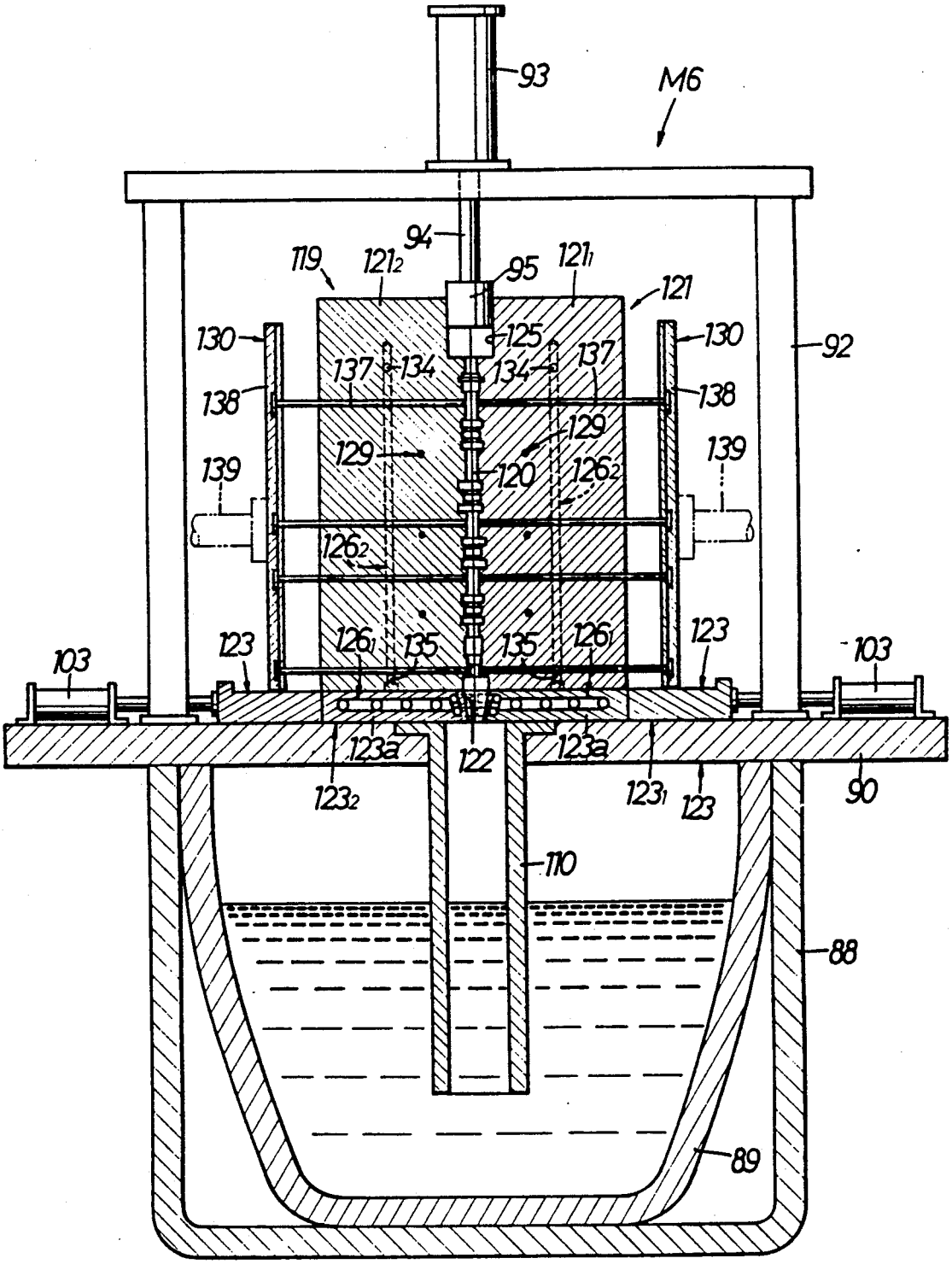
Figure 31:
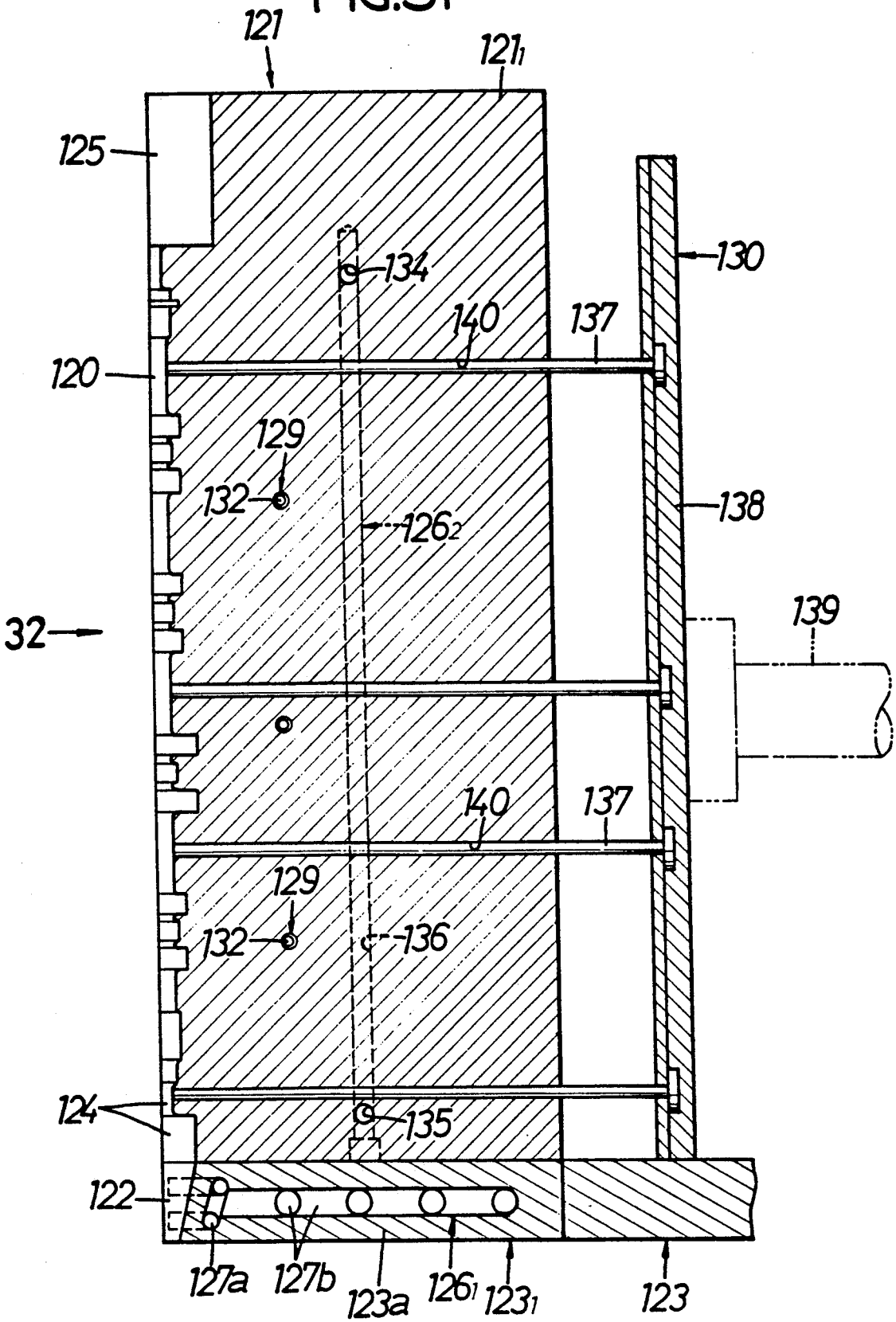
Figure 32:
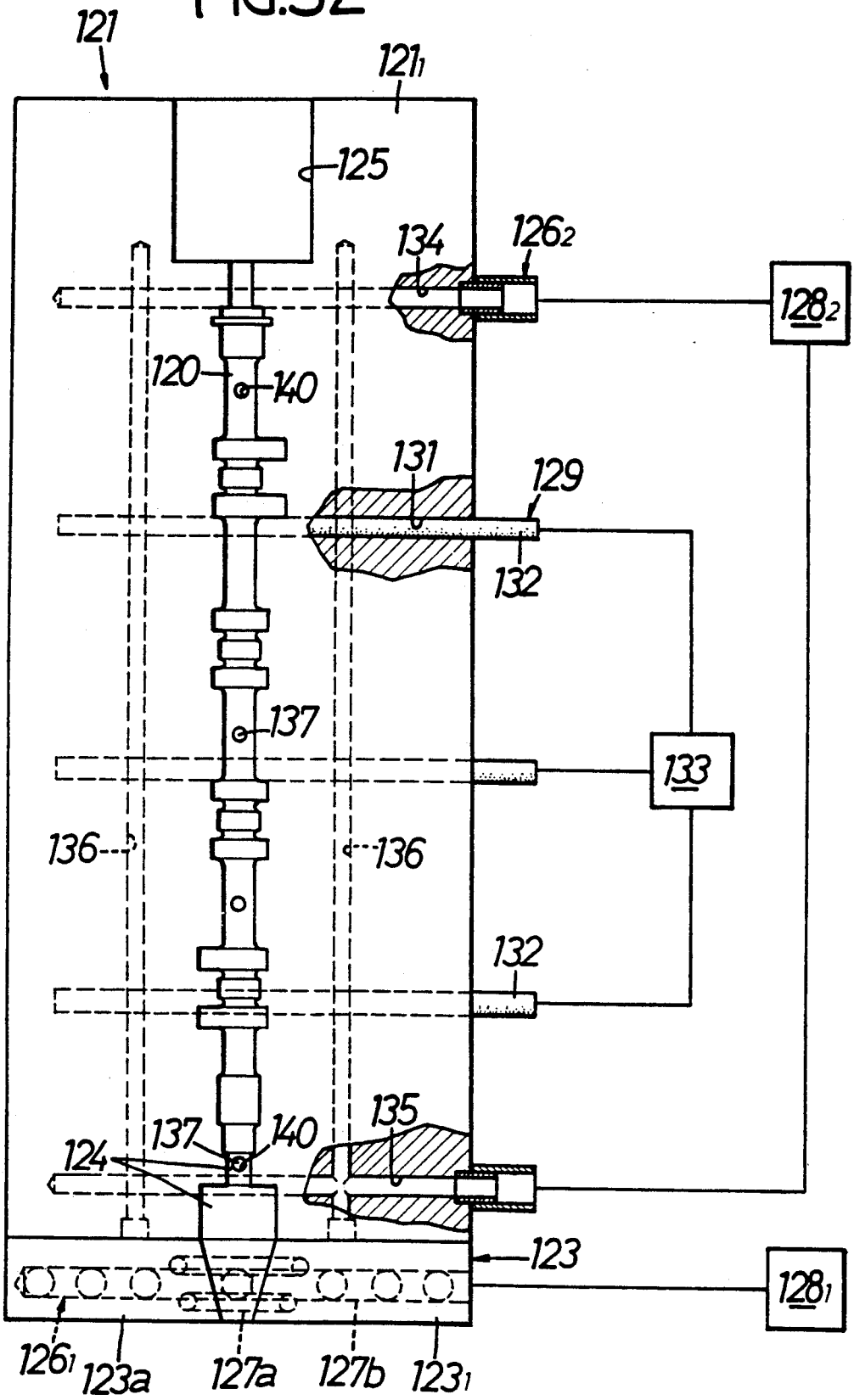
Figure 33:
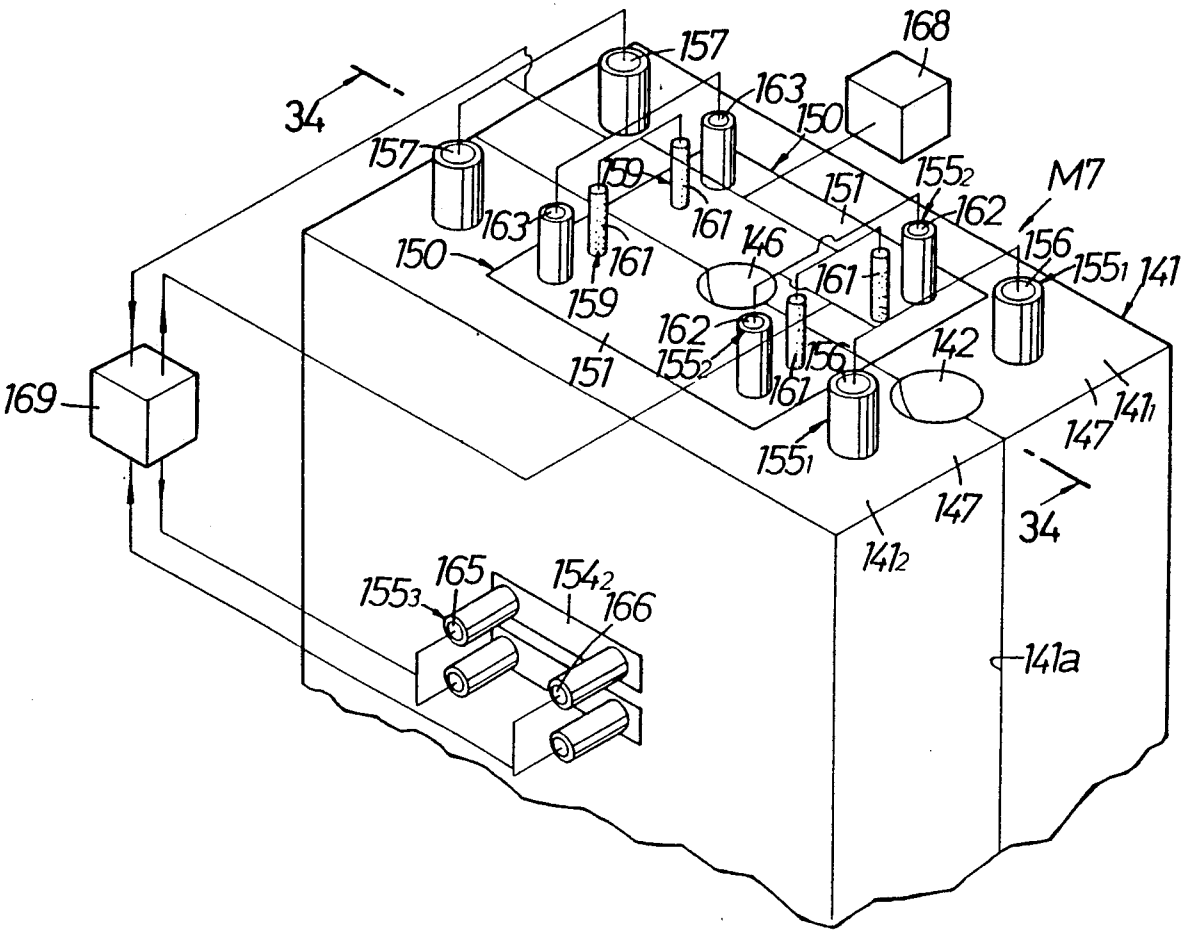
Figure 34:
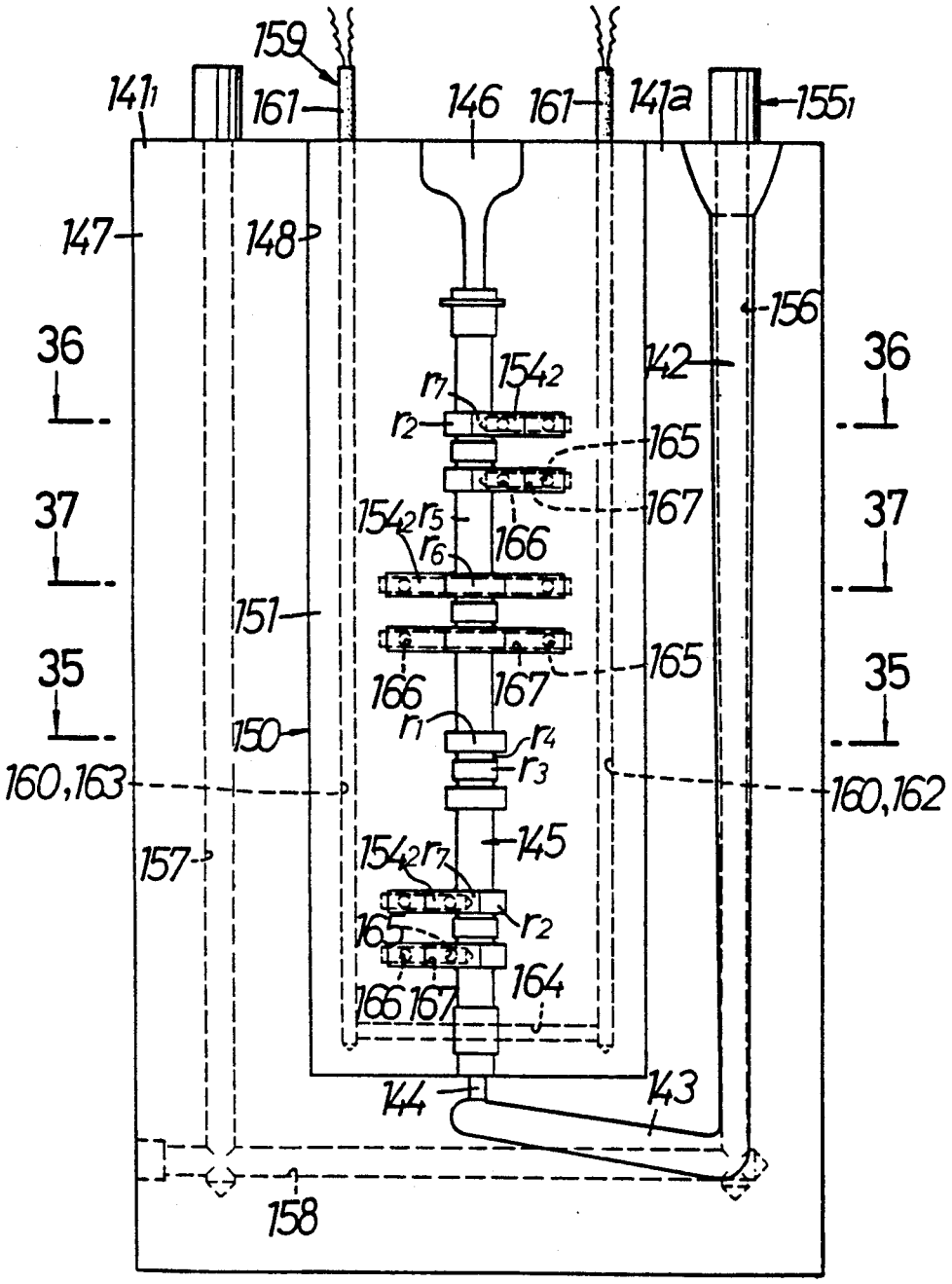
Figure 35:
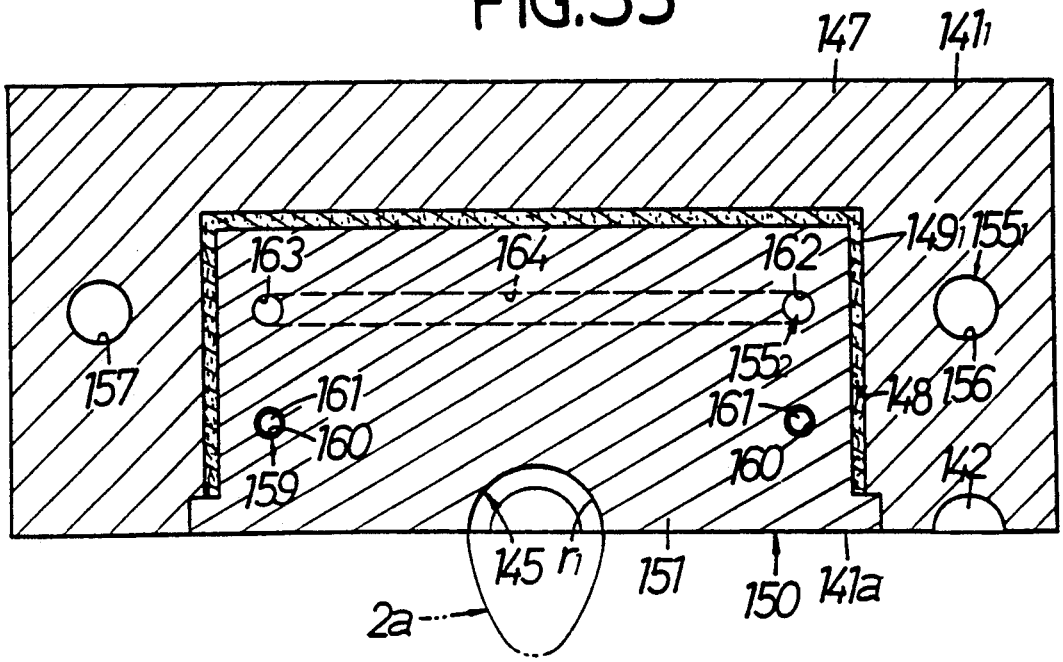
Figure 36:
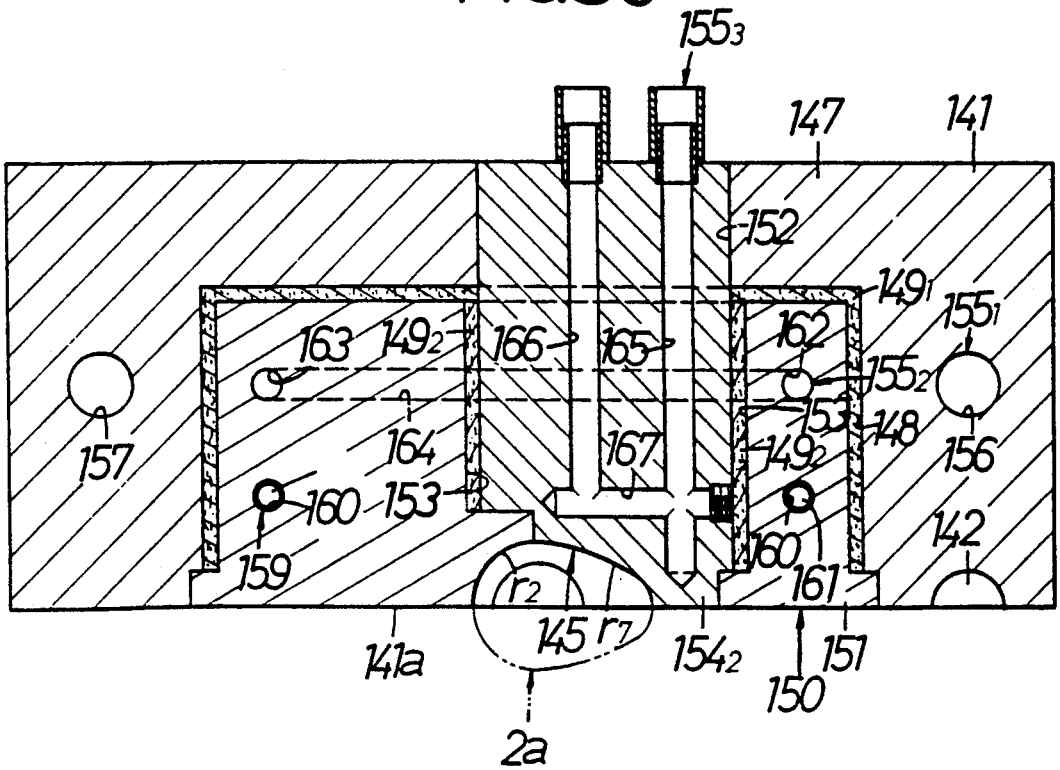
Figure 37:
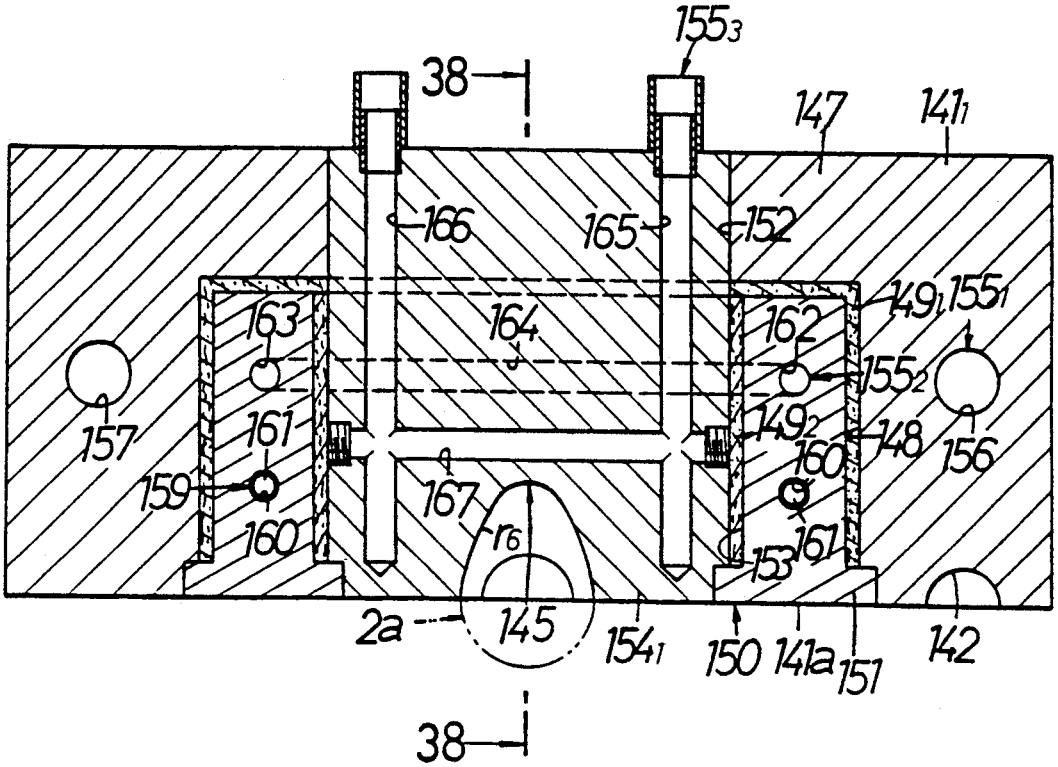
Figure 38:
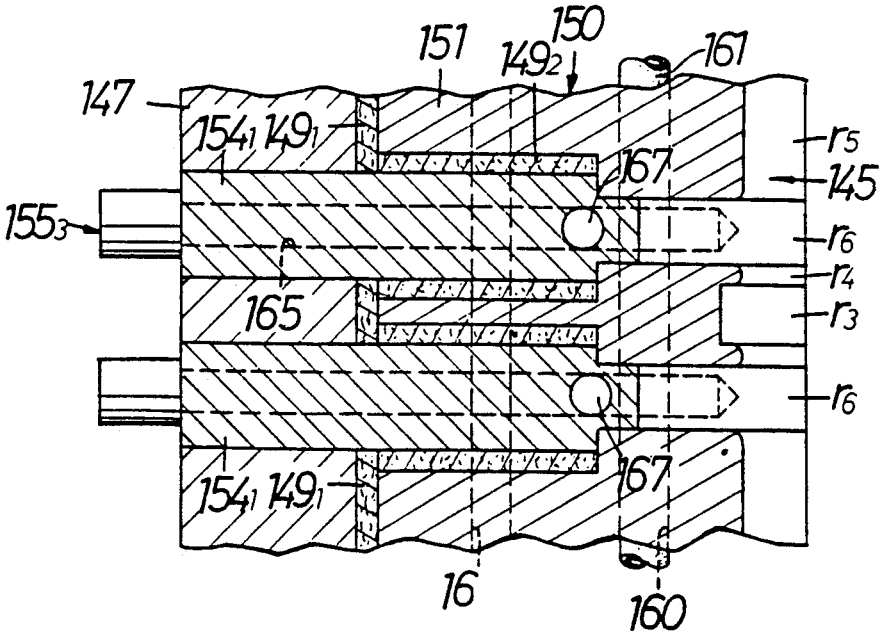

FIGS. 30 to 32 show a mold casting apparatus M6 which is used to cast a cam shaft blank $2_2$ as a steel casting as shown in FIG. 13. The apparatus M6 has the same arrangements as those described in the item [VII] except for a mold 119. Therefore, in the Figures, the like reference characters are used to designate like parts; and the description thereof is omitted and primarily, the mold 119 will be described below.

The mold 119 comprises a cavity defining portion 121 including a cavity 120 for a cam shaft blank, and a molten metal passage defining portion 123 having a frustoconical molten metal passage 122 communicating with a lower end of the cavity 120, and is formed of, for example, the same material as that described in the item [VII]. In the illustrated embodiment, the cavity 120 and the molten metal passage 122 communicate with each other via a through hole 124 in the cavity defining portion 121. The molten metal passage 122 communicates at its lower end with the crucible 89 through the molten metal supply pipe 101 suspended on the lid 90.

The cavity defining portion 121 is constructed of first and second components $121_1$ and $121_2$ into a split type, and mold surfaces of the two components $121_1$ and $121_2$ define a through hole 124, the cavity 120, and a pressing hole 125 adapted to slidably receive the larger diameter portion 95 of the piston rod 94. The two components $121_1$ and $121_2$ are opened and closed by an operating device which is not shown.

The molten metal defining portion 123 is also constructed of first and second blocks $123_1$ and $123_2$ into a split type in association with the cavity defining portion 121, and mold surfaces of the both blocks $123_1$ and $123_2$ define the molten metal passage 122.

In the molten metal passage defining portion 123, a first cooling circuit $126_1$ is mounted in each of the both inner portions 123a. The first cooling circuit $126_1$ includes a water passage 127a located around the molten metal passage 122, and a water passage 127b communicating with the water passage 127a and distributed throughout the inner portion 123a, with a supply port and a discharge port (not shown) being provided in the water passage 127b.

Both the first cooling circuits $126_1$ are connected to a first cooling-temperature controller $128_1$ which has a function for operating each of the first cooling circuit $126_1$ to rapidly cool and solidify the molten metal within the molten metal passage 122 after charging of the molten metal into the cavity 120, thereby closing the molten metal passage 122.

In the cavity defining portion 121, each of the first and second components $121_1$ and $121_2$ is provided with a heating circuit 129, a second cooling circuit $126_2$ and knock-out means 130. These portions are the same for both components $121_1$ and $121_2$ and hence, only those for the first component $121_1$ will be described.

The heating circuit 129 is constituted of a plurality of insertion holes 131 perforated in the first component $121_1$, and bar-like heaters 132 inserted into and held in the corresponding insertion holes 131, respectively.

The individual heaters 132 are connected to a heating-temperature controller 114 which includes a function for activating the heating circuit 129 and thus energizing the individual heaters 132 to heat the first component $121_1$ prior to pouring of a molten metal, and deactivating the heating circuit 129 and thus deenergizing the individual heaters 132 after starting of pouring. Of course, the individual heaters 129 of the second component $121_2$ are also connected to the heating-temperature controller 133.

The second cooling circuit $126_2$ comprises a horizontal inlet passage 134 made in an upper portion of the first component $121_1$, a horizontal outlet passage 135 made in a lower portion of the first component, and a plurality of vertical communication passages 136 made in the first component $121_1$ to connect the inlet and outlet passages 134 and 135, so that a cooling water introduced into the inlet passage 134 is permitted to flow through the individual communication passage 136 and discharged through the outlet passage 135.

The inlet passage 134 and the outlet passage 135 are connected to a second cooling-temperature controller $128_2$ which includes a function for activating the second cooling circuit $126_2$ and thus permitting cooling water to flow through the second cooling circuit $126_2$ to cool the first component $121_1$ after the starting of pouring, thereby rapidly cooling a surface layer of the cam shaft blank material $2_1$ in contact with the first component $121_1$ to convert the surface layer into a shell-like solidified layer.

The knock-out means 130 comprises a plurality of pins 137, a support plate 138 for supporting one ends of the pins 137, and an operating member 139 connected to the support plate 138. Each of the pins 137 is slidably received in each of insertion holes 118 provided in the first component $121_1$ and opened into the cavity 120 and through hole 124.

The following is the description of an operation for casting a cam shaft blank $2_2$ in the above-described mold casting apparatus M5.

There is prepared a molten metal of the same cast iron composition as that described in the item [II], and the molten metal is subjected to similar primary and secondary deacidifying treatments, followed by placement into the crucible 89 for heating.

The cavity defining portion 121 has been heated to a temperature of 50° to 180° C. by the heating circuit 129 prior to pouring of the molten metal. A gas pressure is applied to the surface of the molten metal in the crucible 89 at a molten metal temperature of 1630° to 1670° C. to pour the molten metal into the cavity 120 through the molten metal supply pipe 101, the molten metal passage 122 and the through hole 124, thereby casting a cam shaft blank $2_2$. The pouring rate and the amount of molten metal poured are the same as those in the item [VII].

After starting of pouring, heating of the cavity defining portion 121 by the heating circuit 129 is stopped and at the same time, the cavity defining portion 121 begins to be cooled by the second cooling circuit $126_2$.

Then, after the molten metal has been charged into the cavity 120, the molten metal passage defining portion 123 is cooled by the first cooling circuit $126_1$, rapidly cooling and solidifying the molten metal in the molten metal passage 122 to close the latter. The operation of the first cooling circuit $126_1$ is continued immediately before releasing of the resulting cam shaft blank.

Then, the pressing cylinder 93 is operated to press the molten metal in the cavity 120, i.e., the unsolidified cam shaft blank material $2_2$ with a pressure of 0.8 to 1.2 kg/cm$^2$ by the larger diameter portion 95. This operation of the pressing cylinder 93 is continued immediately before releasing of the resulting cam shaft blank.

Thereafter, the resulting cam shaft blank $2_2$ is released from the mold, and the timing therefor is as described in the item [II] with reference to FIG. 14.

According to the above procedure, an effect similar to that in the item [II] can be provided and particularly, in this case, it is possible to provide a good quality cam shaft blank $2_2$ free from interal defects, because rapid cooling of the cam shaft blank material $2_2$ is conducted while applying a pressure.

[VIII] Casting of Cam Shaft Blank of Aluminum Alloy Casting

The mold casting apparatus M6 for a steel casting described in the item [VIII] is used in casting a cam shaft blank as an aluminum alloy casting.

In casting, there is prepared a molten metal of the same aluminum alloy composition as that described in the item [III], and the moltem metal is placed into the crucible 89 and heated therein.

The cavity defining portion 121 has been heated to a temperature of 100° to 140° C. by the heating circuit 129 prior to pouring of the molten metal. A gas pressure is applied to the surface of the molten metal in the crucible 89 to pour the molten metal into the cavity 120 through the molten metal supply pipe 101, the molten metal passage 122 and the through hole 124 at a temperature of 700° to 749° C. and a pouring rate of 0.3 to 0.8 kg/sec., thereby casting a cam shaft blank $2_2$. The amount of molten metal poured at this time is 2.0 kg.

If the cavity defining portion 121 has been previously heated as described above, the running of the molten metal during pouring is improved, and it is possible to avoid cracking and the like of the resulting cam shaft blank $2_2$ due to rapid cooling of the molten metal.

After starting of pouring, heating of the cavity defining portion 121 by the heating circuit 129 is stopped and at the same time, the cavity defining portion 121 is started to be cooled by the second cooling circuit $126_2$.

Then, after the molten metal has been charged into the cavity 120, the molten metal passage defining portion 123 is cooled by the first cooling circuit $126_1$, rapidly cooling and solidifying the molten metal in the molten metal passage 122 to close the latter. The operation of the first cooling circuit $126_1$ is continued immediately before releasing of the resulting cam shaft blank.

Then, the pressing cylinder 93 is operated to press the molten metal in the cavity 120, i.e., the unsolidified cam shaft blank material $2_2$ with a pressure of 0.2 to 0.5 kg/cm$^2$ by the larger diameter portion 95. This operation of the pressing cylinder 93 is continued immediately before releasing of the resulting cam shaft blank.

Thereafter, the resulting cam shaft blank $2_2$ is released from the mold, and the timing therefor is as described in the item [III] with reference to FIG. 16.

According to the above procedure, an effect similar to that in the item [III] can be provided and particularly, in this case, it is possible to provide a good quality cam shaft blank $2_2$ free from interal defects, because rapid cooling of the cam shaft blank material $2_2$ is conducted while applying a pressure.

The pressing pressure has been applied to the molten metal within the cavity 96, 120 by the pressing cylinder 93 in the items [VII] to [IX], but it should be understood that a pressing pressure may be applied to the molten metal within the cavity 96, 120 by a riser. In addition, the heating-temperature controller 114, 133 may have a function for reducing an output from the heating circuit 107, 129 and thus decreasing an energizing current for the individual heater 110, 132. Further, any manner may be used to pour the molten metal into the cavity 96, 120, and for example, the molten metal may be poured horizontally or from above. Yet further, the cavity defining portion 97, 121 may be integral with the molten metal passage defining portion 99, 123.

[X] Casting of Cam shaft Blank of Cast Iron

There is prepared a cam shaft blank $2_1$ as a cast iron casting as shown in FIG. 4. In the cam shaft blank $2_1$, a nose *2e* of each cam portion *2a* as a first component is of a hard structure and in this embodiment, of a chilled structure, and other portions, i.e., a base circular portion *2f* of each cam portion *2a*, each journal portion *2b*, each neck portion *2c* and each smaller diameter portion *2d* are of soft structures and in this embodiment, of eutectic graphite or graphite flake structures.

FIGS. 33 to 38 show a mold casting apparatus M7 including a mold 141 for casting a cam shaft blank $2_1$. The mold 141 is constructed of a first die $141_1$ and a second die $141_2$ into a split type, and is opened and closed by an operating device which is not shown. Mold surfaces 141*a* of the first and second dies $141_1$ and $141_2$ define a sprue 142, a runner 143, a gate 144, a cam shaft blank molding cavity 145 and a riser gate 146.

The first and second dies $141_1$ and $141_2$ are of substantially the same construction and hence, only the first die $141_1$ will be described. The first die $141_1$ comprises a body 147 including the sprue 142, the runner 143 and the gate 144, and a molding block 150 having the cavity 145 and the riser gate 146 and fitted in a recess 148 in the body 147 with a heat insulating material $149_1$ interposed therebetween.

The molding block 150 comprises a slowly-cooled portion 151 including a base circular portion shaping zone r1, r2 (FIGS. 35, 36) for shaping the whole or one half of the base circular portion *2f* of the cam portion *2a*, a journal portion shaping zone $r_3$ for shaping the journal portion *2b*, a neck portion shaping zone $r_4$ for shaping the neck portion *2c* and a smaller diameter portion shaping zone $r_5$ for shaping the smaller diameter portion *2d* to serve as a second component shaping region, and a plurality of plate-like rapidly-cooled portions $154_1$ and $154_2$ mounted in through holes 152 and 153 in the body 147 and the slowly-cooled portion 151 of the first die $141_1$ to serve as a first component shaping region and including a nose shaping zone $r_6$, $r_7$ (FIGS. 36, 37) for shaping the whole or one half of the nose *2e* of the cam portion *2a*.

A heat insulating material $149_2$ similar to that described above is interposed between the slowly cooling member 151 and each of the rapidly-cooled portions $154_1$ and $154_2$, but in the vicinity of the mold surfaces 141*a*, the slowly-cooled portion 151 is in direct contact with the rapidly-cooled portions $154_1$ and $154_2$. This permits a heat transfer between the slowly-cooled portion 151 and the rapidly-cooled portions $154_1$ and $154_2$, but such heat transfer is substantially suppressed.

The body 147 and the rapidly-cooled portions $154_1$ and $154_2$ are formed of a Cu-Cr alloy containing 0.8 to 4% by weight of Cr and has a heat conductivity of 0.4 to 0.8 cals/cm/sec./°C.

The slowly-cooled portion 151 is formed of graphite and has a heat conductivity of 0.005 to 0.4 cals/cm/sec./°C. In addition to graphite, other materials for forming the slowly-cooled portion 151 can be employed such as ceramics, copper alloys, steels, etc., and in any case, materials having a heat conductivity lower than that of the rapidly-cooled portions $154_1$ and $154_2$ are preferred.

Each of the heat insulating materials $149_1$ and $149_2$ used are of a ceramic sheet made of an inorganic fiber such as alumina and silica fibers.

A cooling circuit $155_1$ is provided in the body 147 and comprised of a vertical cooling-water inlet passage 156 made in the body 147 along the sprue 142, a vertical cooling-water outlet passage 157 made in the body 147 along the molding block 150 at the opposite side from the sprue 142, and a horizontal communication passage 158 made in the body 147 to connect to both passages 156 and 157 at their lower portions.

The slowly-cooled portion 151 is also provided with a heating circuit 159 and a cooling circuit $155_2$. The heating circuit 159 comprises a pair of vertical insertion holes 160 perforated in the slowly-cooled portion 151 in a manner to sandwich the individual rapidly-cooled portions $154_1$ and $154_2$ and in close proximity to the mold surfaces 141*a*, and bar-like heaters 161 mounted in the corresponding insertion holes 160. The cooling circuit $155_2$ comprises vertical cooling-water inlet and outlet passages 162 and 163 made in the slowly-cooled portion 151 to sandwich the individual rapidly-cooled portions $154_1$ and $154_2$ and to extend away from the mold surfaces 141*a*, and a horizontal communication passage 164 made in the slowly-cooled portion 151 to connect both passages 162 and 163 at their lower portions. In this case, the volume of the slowly-cooled portion 151 occupied by the cooling circuit $155_2$ is smaller.

Further, a cooling circuit $155_3$ is provided in each of the rapidly-cooled portions $154_1$ and $154_2$ and comprises horizontal cooling-water inlet and outlet passages 165 and 166 made in the rapidly-cooled portion $154_1$ and $154_2$, and a horizontal communication passage 167 connecting the passages 165 and 166 in the vicinity of the nose shaping zone $r_6$, $r_7$. In this case, the volume of the rapidly-cooled portion $154_1$, $154_2$ occupied by the cooling circuit $155_3$ is larger.

The individual heater 161 of the heating circuit 159 in each of the first and second dies $141_1$ and $141_2$ are connected to a heating-temperature controller 168 which includes a function for energizing each heater 161 to heat the slowly-cooled portion 151 prior to pouring of a molten metal, and deenergizing each heater 161 as pouring is started.

During heating, transferring of heat from the slowly-cooled portion 151 causes the rapidly-cooled portions $154_1$ and $154_2$ to be also heated, but such transferring of heat is substantially suppressed, because the heat insulating material $149_2$ is interposed between the both members 151 and $154_1$, $154_2$ and also because the members 151 and 154 $154_2$ are in direct contact with each other at their reduced portions. Thus, the temperature of the rapidly-cooled portions $154_1$ and $154_2$ become lower than that of the slowly-cooled portion 151, resulting in a distinct difference in temperature therebetween.

The inlet passages 156, 162 and 165 and the outlet passages 157, 163 and 166 of the cooling circuits $155_1$ to $155_3$ in the first and second dies $141_1$ and $141_2$ are connected to a cooling-temperature controller 169 which includes a function for permitting a cooling water to flow through the individual cooling circuits $155_1$ to $155_3$ to cool the body 147, the slowly-cooled portion 151 and the rapidly-cooled portions $154_1$ and $154_2$, as pouring of a molten metal is started.

During cooling, the slowly-cooled portion 151 is slowly cooled due to its lower heat conductivity and the smaller volume occupied by the cooling circuit $155_2$. On the other hand, the rapidly-cooled portions $154_1$ and $154_2$ are rapidly cooled due to its higher heat conductivity and the larger volume occupied by the cooling circuit $155_3$. In this case, a distinct difference in temperature is produced between the slowly-cooled portion 151 and the rapidly-cooled portion $154_1$, $154_2$, because of the heat insulating material $149_2$ interposed between the both portions 151 and $154_1$, $154_2$ and also because of the difference in temperature before pouring.

This enables the nose 2e in each cam portion 2a of the resulting cam shaft blank $2_1$ to be formed of a chilled structure and also enables other portions of the resulting cam shaft blank $2_1$ to be formed in an eutectic graphite or graphite flake structure.

Description will be made of an operation for casting a cam shaft blank $2_1$ in the above-described mold casting apparatus M7.

There is prepared a molten metal of the same cast iron composition as that described in the item [IV], and the molten metal is subjected to a similar inoculation.

The mold 141 is heated by the heating circuit 159 prior to pouring of the molten metal, so that the slowly-cooled portion 151 is maintained at a temperature of 150° to 450° C., and the individual rapidly-cooled portions $154_1$ and $154_2$ are maintained at a temperature 120° C. The molten metal after inoculation is poured into the mold 141 at a temperature 1380° to 1420° C. to cast a cam shaft blank $2_1$. The amount of molten metal poured at this time is of 5 kg.

If the mold 141 has been previously heated as described above, the running of the molten metal during pouring is improved, and it is possible to avoid cracking and the like of the resulting cam shaft blank $2_1$ due to rapid cooling of the molten metal.

After starting of pouring, heating of the mold 141 by the heating circuit 159 is stopped, and at the same time, the mold 141 is started to be cooled by the cooling circuits $155_1$ to $155_3$, so that the slowly-cooled portion 151 is slowly cooled and the individual rapidly-cooled portions $154_1$ and $154_2$ are rapidly cooled.

This cooling operation is continued until the solidification of the cam shaft blank material $2_1$ has been completed with the entire outer periphery thereof converted into a shell-like solidified layer. Thereafter, the mold is opened, and the resulting cam shaft blank $2_1$ is released from the mold.

The temperature of the solidified layer at this releasing is preferred to be in a range of from the eutectic crystal line to 350° C. therebelow. This makes it possible to avoid thermal cracking of the resulting cam shaft blank $2_1$ and also avoid damage of the mold 141 due to the solidificational shrinkage of the cam shaft blank material $2_1$.

Figure 39A:
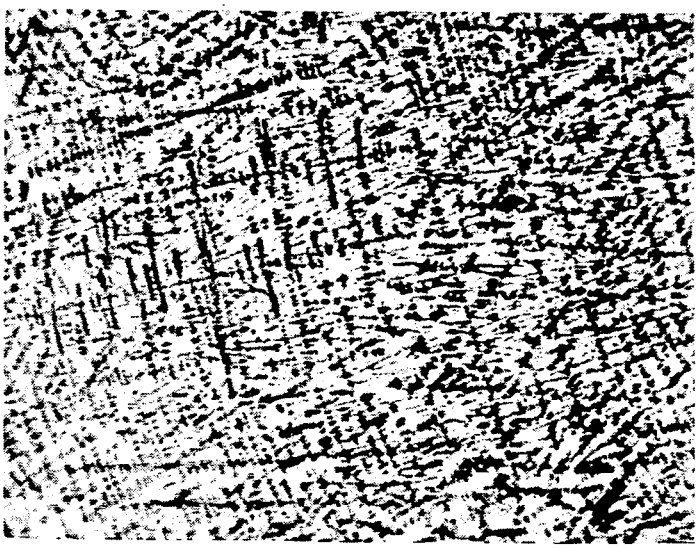
FIGS. 39A and 39B are microphotographs each showing a metallographical structure of a cast iron cam shaft blank.
Figure 39B:
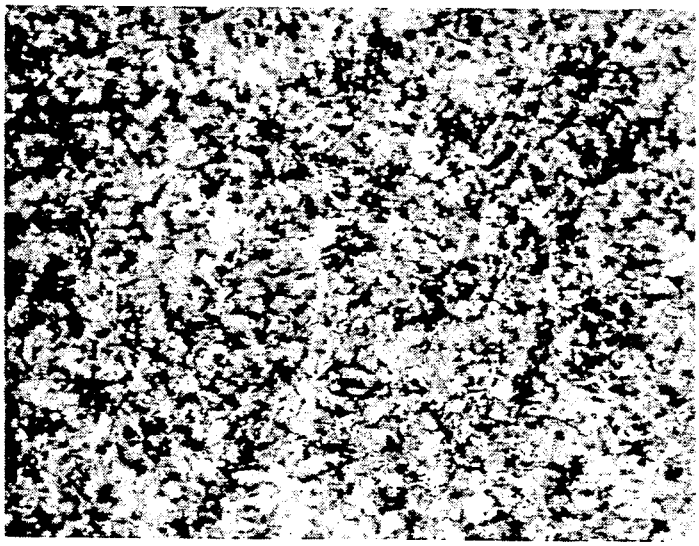

In the cam shaft blank $2_1$, each nose 2e is of a chilled structure having fine $Fe_3C$ particles (white portion), as apparent from a microphotograph (100 times) shown in FIG. 39A for illustrating a metallographical structure, and other portions, for example, a journal portion 4 is of a structure having graphite flake particles (blank portion), as apparent from a microphotograph shown in FIG. 39B for illustrating a metallograpgical structure.

Each nose 2e of the aforesaid chilled structure is excellent in wear resistance, and the journal portion 2b or the like of the aforesaid graphite flake structure has a toughness and a good workability.

In this embodiment, the casting material is not limited to the cast iron, and a carbon cast steel and an alloy cast steel can be used. Further, the heating-temperature controller 168 may be designed so that an energizing current to the individual heaters 161 is reduced as pouring is started, thereby decreasing the amount of heat for heating the mold 141.

Figure 40:
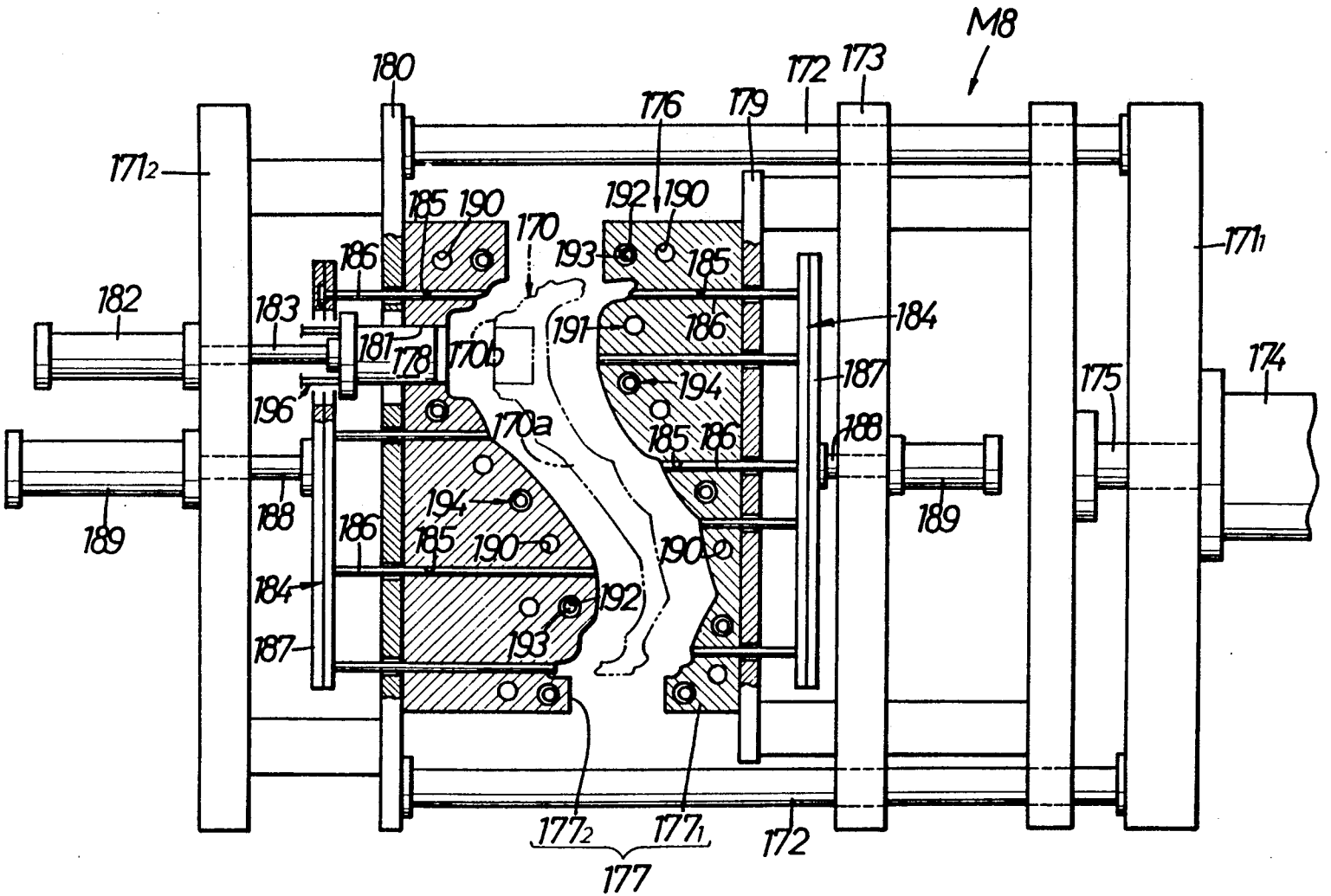
Figure 41:
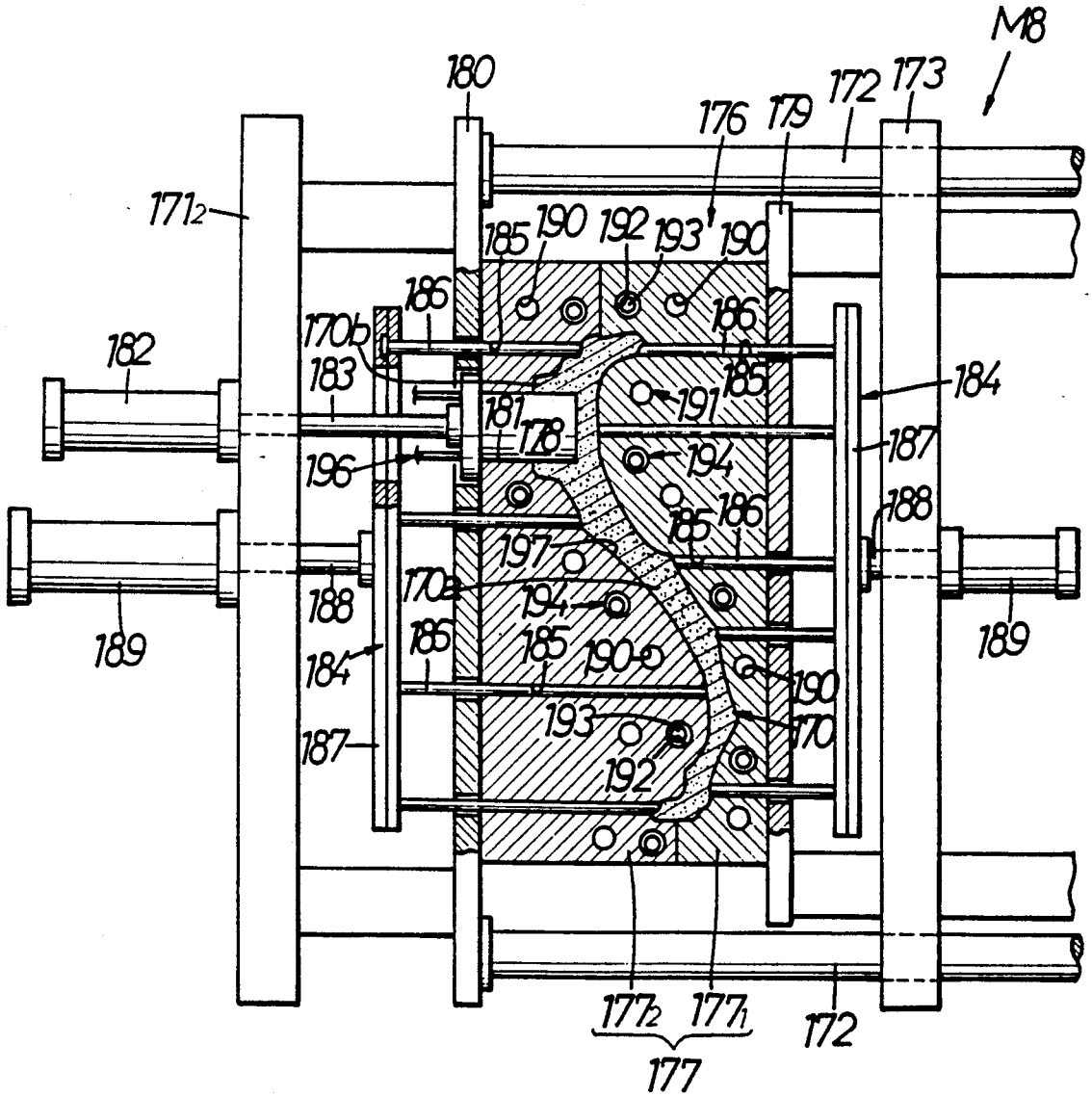
Figure 42:
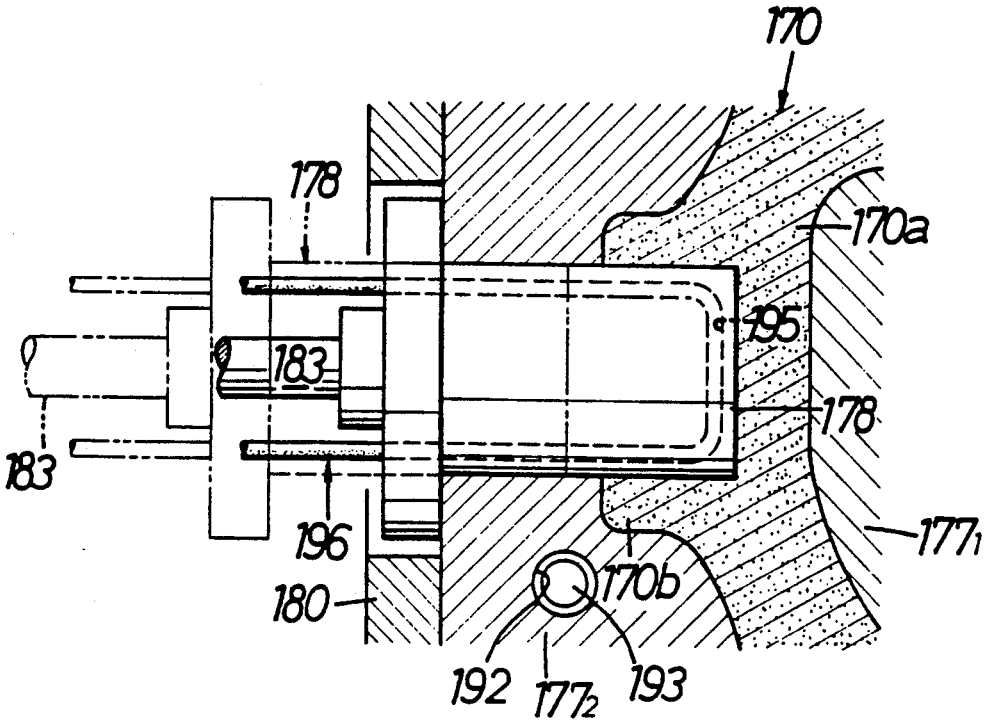

The mold casting processes described in the items [I] to [X] are not limited to the production of the cam shaft blank, and are also applicable to the casting production of various mechanical parts such as crank shaft, brake caliper and nuckle arm blanks. [XI] Casting of Nuckle Arm Blank of Cast Iron As shown in FIGS. 40 to 42, a nuckle arm blank 170 as a cast iron casting includes a blank body 170a as a thicker portion and a cylindrical portion 170b integral with the body 170a as a thiner portion.

A mold casting apparatus M8 for casting the nuckle arm blank 170 comprises a pair of left and right or first and second stationary base plates $171_1$ and $171_2$ between which a plurality of guide posts 171 are suspended. A movable frame 173 is slidably supported on the guide posts 172, and a piston rod 175 of a operating cylinder 174 is attached to the first stationary base plate $171_1$ and connected to the movable frame 173.

The mold 176 for a nuckle arm blank comprises a mold body 177 and a movable core 178 mounted in the mold body 177 for shaping the cylindrical portion 170b in cooperation therewith. The mold body 177 is comprised of a movable die $177_1$ attached to a die base 179 of the movable frame 173, and a stationary die $177_2$ attached to a die base 180 of the second stationary base plate $171_2$. The movable core 178 is slidably received into an insertion hole 181 provided in the stationary die $177_2$, and a piston rod 183 of an operating cylinder 182 is attached to the second stationary base plate $171_2$ and connected to the movable core 178. The reference numeral 184 designates a knock-out means in the movable die $177_1$ and the stationary die $177_2$. Each knock-out means 184 comprises a plurality of pins 186 slidably received in insertion holes in each of the movable die $177_1$ and the stationary die $177_2$, and an operating cylinder 189 attached to the movable frame 173 and having a piston rod 188 connected to a support plate 187.

Each of the movable die $177_1$ and the stationary die $177_2$ is provided with a cooling circuit 191 including a cooling-water channel distributed over the entire region of each of the dies $177_1$ and $177_2$, and a heating circuit 194 including bar-like heaters 193 inserted into and held in a plurality of insertion holes, respectively. A cooling circuit 196 including a cooling-water channel 195 (FIG. 42) is also provided in the movable core 178.

Description will now be made of an operation for casting a knuckle arm blank 170 in the above-described mold casting apparatus M8.

As shown in FIG. 41, the movable die $177_1$ is moved and mated to the stationary die $177_2$, with the movable core 178 placed in a space between both the dies $171_1$ and $171_2$, and the mold is clamped, thereby defining a cavity 197 for knuckle arm blank 170. The heating circuit 194 is operated to heat the movable die $177_1$ and the stationary die $177_2$.

There is prepared a molten metal of the same cast iron composition as that described in the item [IV)], and the molten metal is subjected to a similar inoculation, followed by pouring into the cavity 197 for casting of the knuckle arm blank 170.

After starting of pouring of the molten metal, heating of the movable die $177_1$ and the stationary die $177_2$ by the heating circuit 194 is stopped and at the same time, the cooling circuits 191 in both dies $177_1$ and $177_2$ are operated to start cooling thereof. During this casting operation, the cooling circuit 196 in the movable circuit 178 is kept inoperative.

Surface layers of the blank body 170*a* and the cylindrical portion 170*b* are rapidly cooled under a rapidly-cooled effect of the movable die $177_1$, the stationary die $177_2$ and the movable core 178. When the temperature of the surface layers is down to about 1150° C. (eutectic crystal line Le1) as described above, the blank body 170*a* and the cylindrical portion 170*b* become solidified with their surface layers each converted into a shell-like solidified layer.

The appearance of the solidified layer is earlier on the cylindrical portion 170*b* because of its thinner wall, as compared with that on the thicker blank body 170*a*.

Thus, when the surface layer of the cylindrical portion 178 has been converted into the solidified layer, the movable core 178 is retracted from the cylindrical portion 170*b*, as shown by a chain line in FIG. 42.

Thereafter, when the surface layer of the blank body 170*a* has been converted into the solidified layer, the movable die $177_1$ is moved to provide the mold opening, and the resulting nuckle arm 170 is released from the mold by the knock-out means 184.

Figure 43:
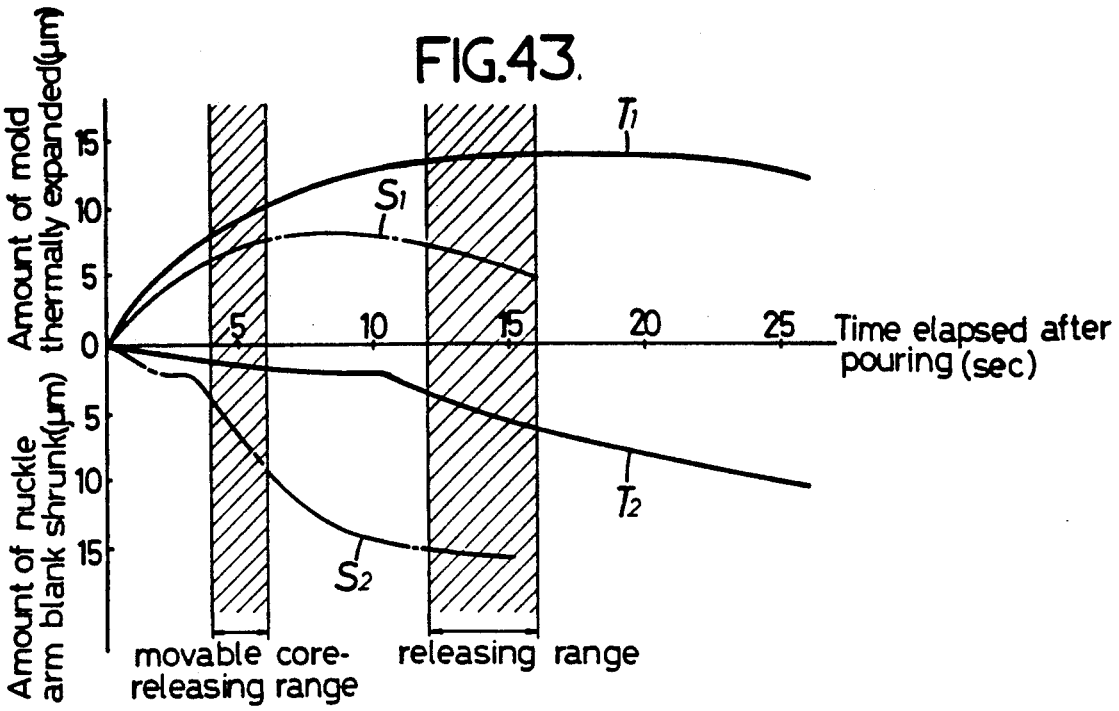
FIG. 43 is a graph illustrating a relationship between the time elapsed after pouring of a molten metal and the amount of mold thermally expanded and the amount of nuckle arm blank material shrunk under a condition where a movable core is not cooled.

FIG. 43 illustrates a relationship of the amount of mold 176 thermally expanded and the shrinkage amount of knuckle arm blank 170 with respect to elapsed time after pouring of the molten metal, wherein a line S1 corresponds to that of the cylindrical portion shaping region of the mold 176; a line T1 corresponds to that of the blank body shaping region of the mold 176; a line S2 corresponds to that of the cylindrical portion 170 of the knuckle arm blank 170; and line T2 corresponds to the blank body 170*a* of the knuckle arm blank 170.

It can be seen from FIG. 43 that removal of the movable core 178 should be conducted after a lapse of about 4 to 6 seconds from the pouring, and releasing of the knuckle arm blank 170 from the mold should be conducted after a lapse of about 12 to about 16 seconds. If such removal and releasing are conducted earlier, the cylindrical portion 170*b* and the blank body 170*a* have no shape retention because of their unsolidified states. On the other hand, if removal and releasing are conducted later thermal cracking of the resulting knuckle arm blank 170 and damage of the mold 176, particularly the movable die $177_1$ and the stationary die $177_2$ are produced.

Figure 44:
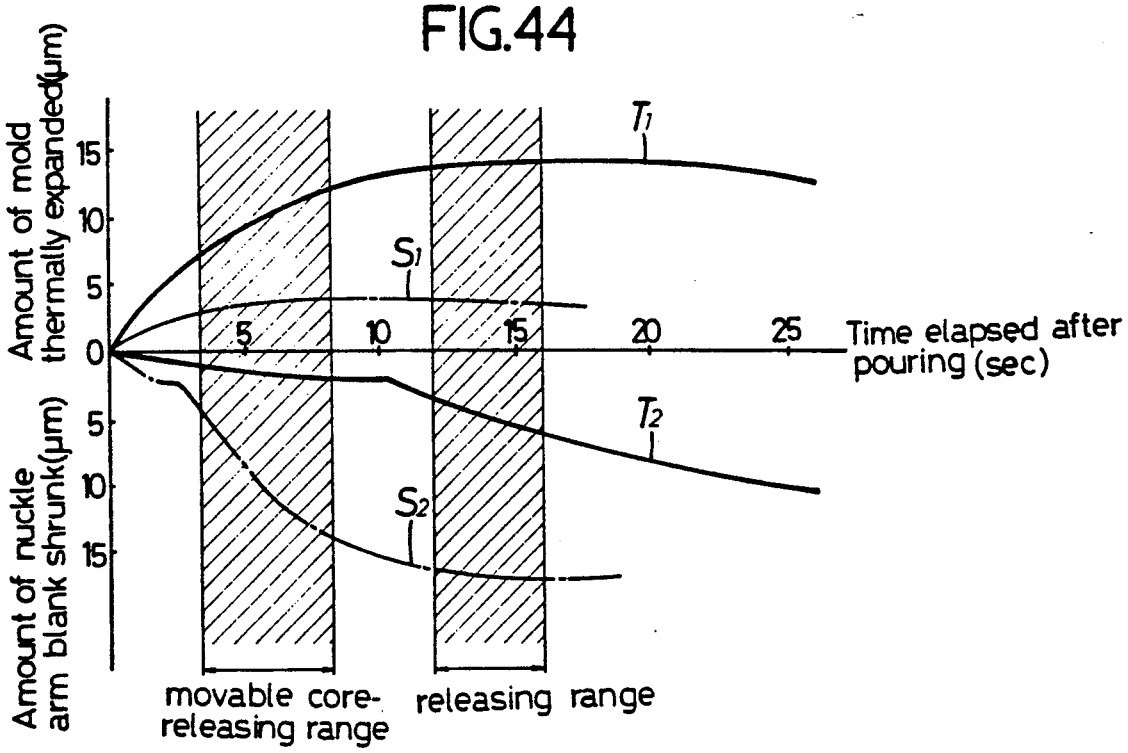
FIG. 44 is a graph similar to FIG. 43 under a condition where the movable core is cooled.

FIG. 44 illustrates a relationship similar to that in FIG. 43, except that the cooling circuit 196 in the movable core 178 is operated after the starting of pouring in the above-described casting operation, so that cooling of the movable core 178 is also used.

Figure 45:
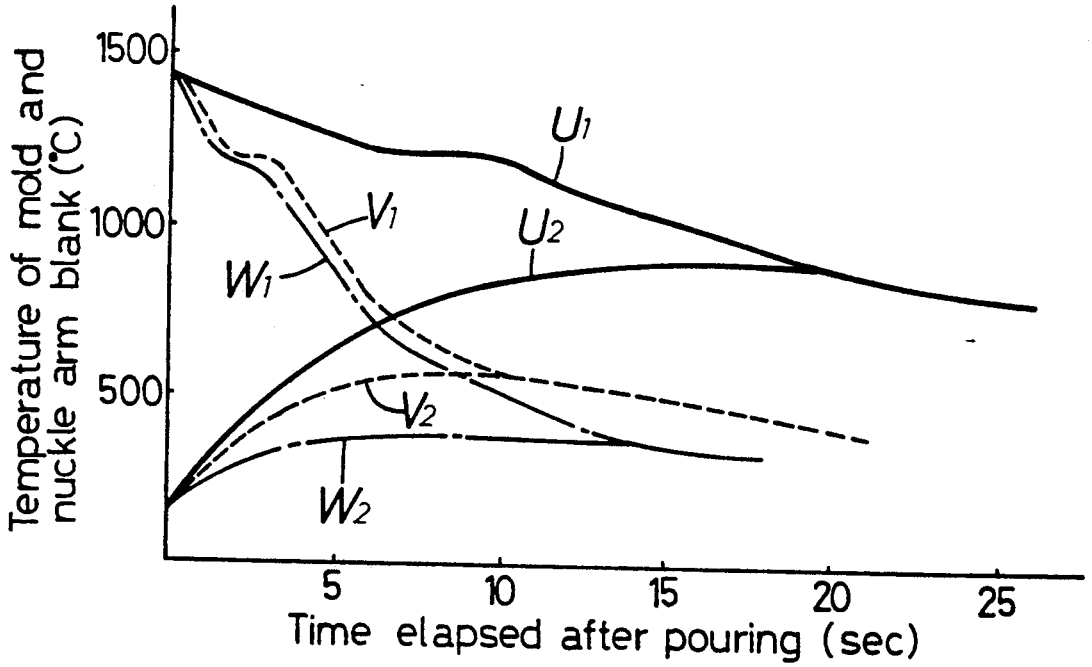
FIG. 45 is a graph illustrating a relationship between the time elapsed after pouring of a molten metal and the temperatures of a mold and a nuckle arm blank material.

FIG. 45 illustrates a relationship between the temperatures of the mold 176 and the knuckle arm blank 170 and the time elapsed after pouring of the molten metal. A line U1 corresponds to that of the blank body shaping region of the mold 176; a line V1 corresponds to that of the cylindrical portion 170*b* when the movable core 178 has not been cooled; a line V2 corresponds to that of the movable core 178 which is not cooled; a line W1 corresponds to that of the cylindrical portion 170*b* when the movable core 178 has been cooled; and a line W2 corresponds to that of the movable core 178 cooled.

As illustrated in FIG. 45, to prevent thermal cracking of the cylindrical portion 170*b*, the consideration is the difference between the amount of shrinkage of cylindrical portion 170*b* and the amount of thermal expansion of movable core 178 and thus a difference in temperature between the cylindrical portion 170*b* and the movable core 178 with respect to the lapse of time after pouring of the molten metal. However, if the movable core 178 is cooled, a difference in temperature at the limit time point for removal of the movable core 178 indicated by lines W1 and W2 can be maintained for a period of time longer than those indicated by lines V1 and V2 when the movable core 178 is not cooled. This makes it possible to moderate the severity of removal of the movable core 178, while widening a range of time points at which the movable core 178 is to be removed.

In the above embodiment, it is possible to carry out a directional solidification of a molten metal with a temperature gradient provided for the mold 176 by controlling the heating circuit 194 and the cooling circuits 191 and 196.

[XII] Mold for Casting Cam Shaft Blank

Figure 46:
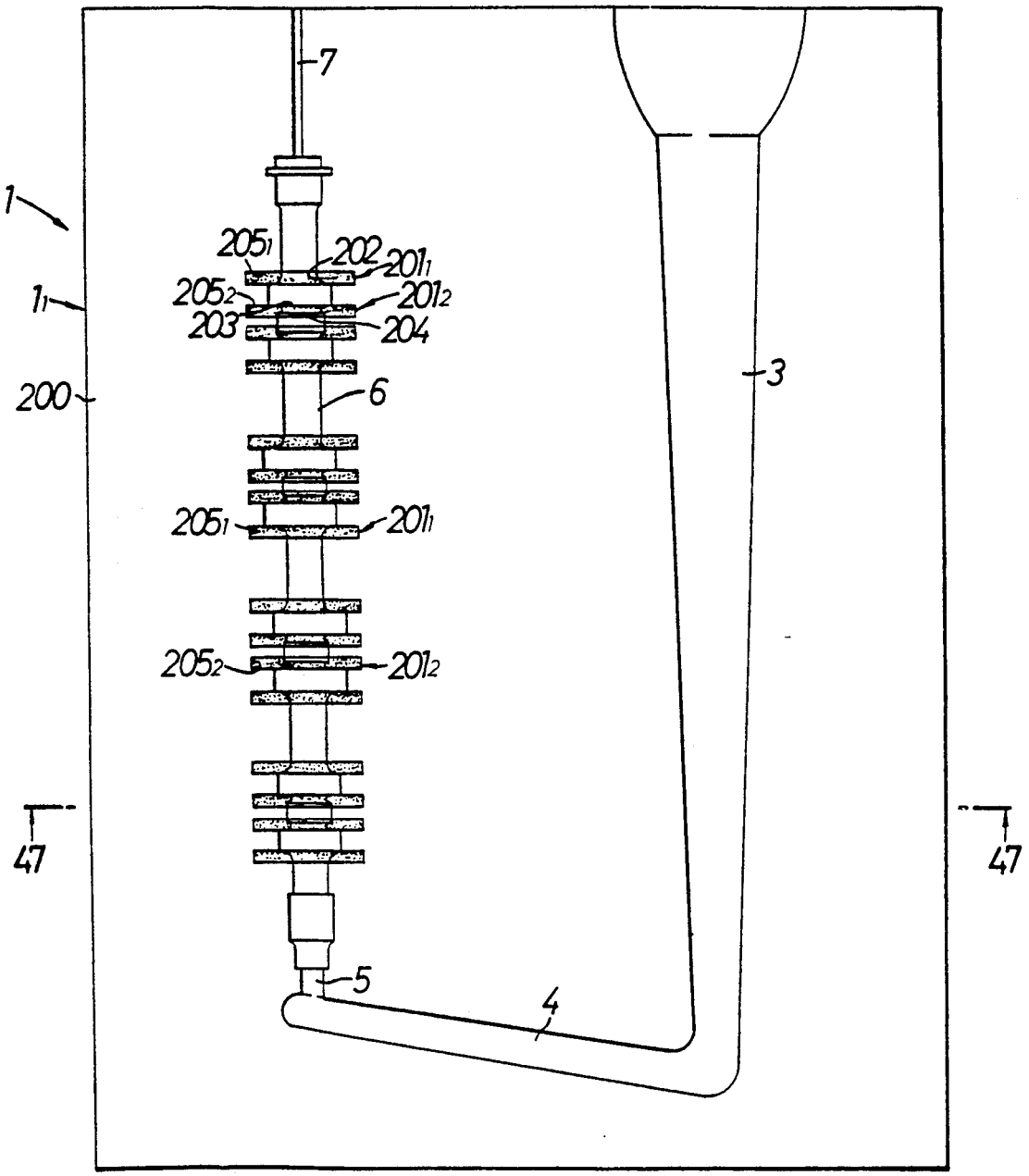
FIG. 46 is a front view of a mold, similar to FIG. 2.
Figure 47:
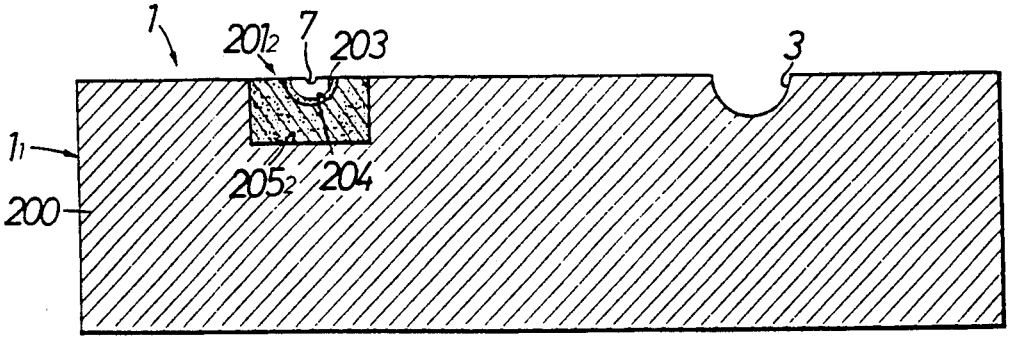
FIG. 47 is a sectional view taken along a line 47—47 in FIG. 46.

FIGS. 46 and 47 illustrate a first die similar to the first die $1_1$ of the split type mold 1, except that the heating circuit 8, the cooling circuit 9 and the like are omitted.

The first die $1_1$ is comprised of a mold body 200 forming a main portion, and a plurality of plate-like heat resistant members $201_1$ and $201_2$ attachable to and detachable from the mold body 200.

In the cam shaft blank $2_1$ illustrated in FIG. 4, that portion 2*g* of each smaller diameter portion 2*d* which is connected with the cam portion 2*a* and each neck portion 2*c* are annular recesses. Thereupon, convex portions for shaping them are provided in the heart resistant members $201_1$ and $201_2$.

Figure 48A:
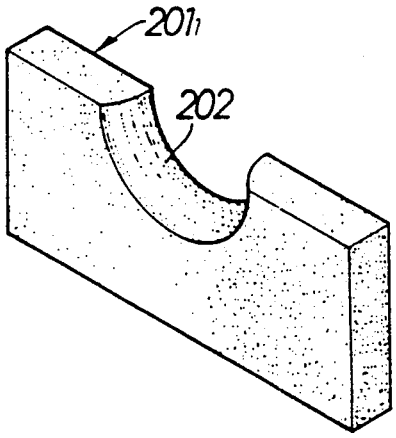
FIGS. 48A and 48B are views each showing each of two types of heat resistant members.
Figure 48B:
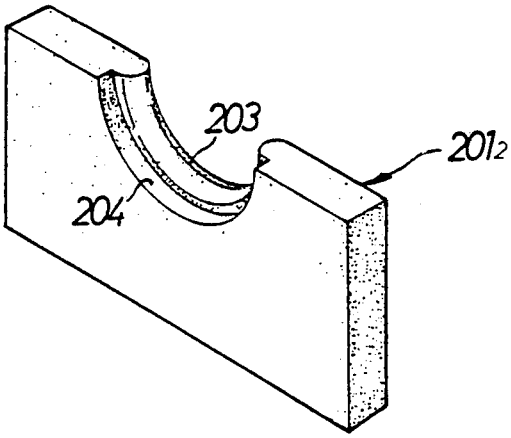

The heat resistant members $201_1$ and $201_2$ are of two types, one of which includes a semi-annular convex portion 202 for shaping one half of the connection 2*g*, as shown in FIG. 48, and the other includes a semi-annular convex portion 203 for shaping one half of the neck portion 2*c*, and a semi-annular concave portion 204 adjacent to the convex shaping portion 203 for shaping a part of the journal portion 2*b*, as shown in FIG. 48B.

Each of the heat resistant members $201_1$ and $201_2$ is formed of a shell sand and fitted in a recess $205_1$, $205_2$ of the first die $1_1$; and forms a pair with each of the heat resistant members $201_1$ and $201_2$ also likewise fitted in the second die (not shown) during closing of the mold, thereby shaping each connection portion 2*g* and each neck portion 2*c*.

If constructed in the above manner, when wearing due to running of the molten metal or damage due to adhesion attendant upon the solidificational shrinkage of the cam shaft blank material $2_1$ or the like are produced in each heat resistant member $201_1$, $201_2$, it is possible to reconstruct the mold 1 only by replacement of such heat resistant member $201_1$, $201_2$ by a new one. With each of the heat resistant members $201_1$ $201_2$ formed of a shell sand as described above, it is preferred to replace them by new ones for each casting operation from the viewpoint of their heat resistance.

Figure 49:
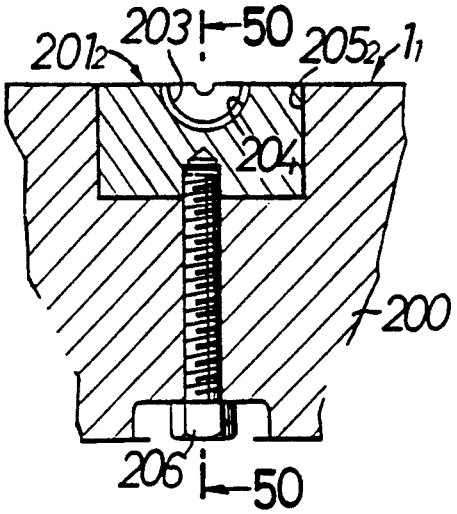
FIG. 49 is a sectional view of details of another mold.
Figure 50:
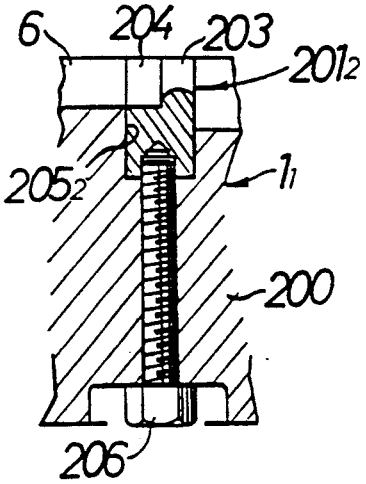
FIG. 50 is a sectional view taken along a line 50—50 in FIG. 49.

FIGS. 49 and 50 illustrate a mold including a heat resistant member $201_2$ which is formed of a material such as a metal, a ceramic, carbon, etc., and which is attached to the mold body 200 by a bolt 206. Although not shown in the Figures, the other resistant member $201_1$ is similarly formed. In this case, the heat resistance of the heat resistant members $201_1$ and $201_2$ can be improved and hence, is capable of resisting many runs of casting operations, leading to a decrease in the number of replacing operations.

The technological thought of the use of the above-described heat resistant members is not limited to the casting production of the cam shaft blanks and is also applicable to the casting production of various castings having recesses.

[XIII] Mold for Casting Cam Shaft Blank

Figure 51:
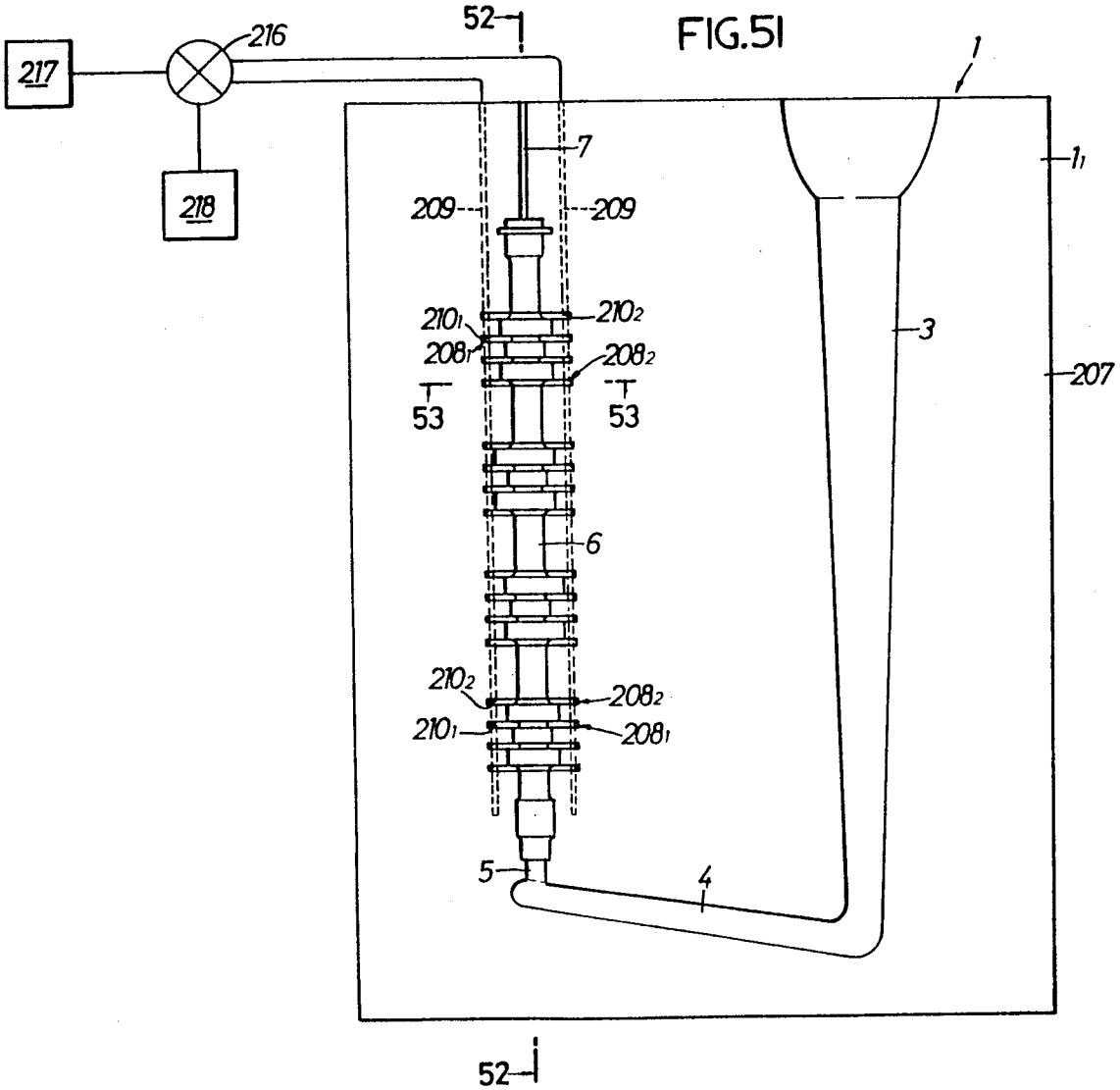
FIG. 51 is a front view of a mold, similar to FIG. 2.
Figure 52:
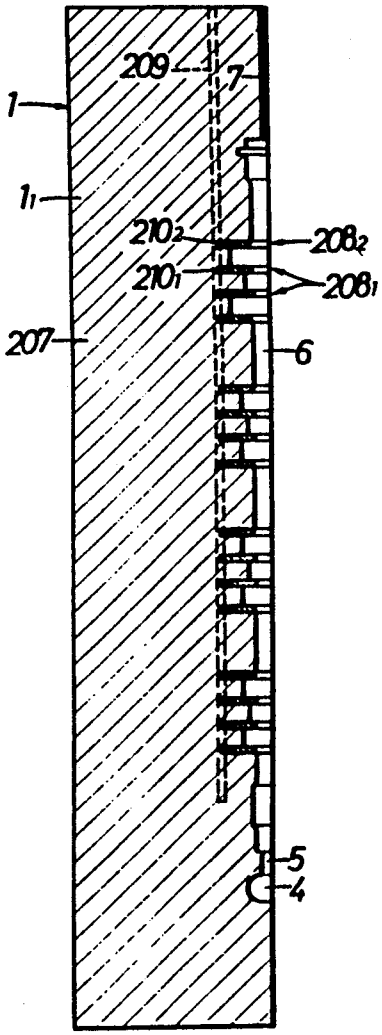
FIG. 52 is a sectional view taken along a line 52—52 in FIG. 51.
Figure 53:
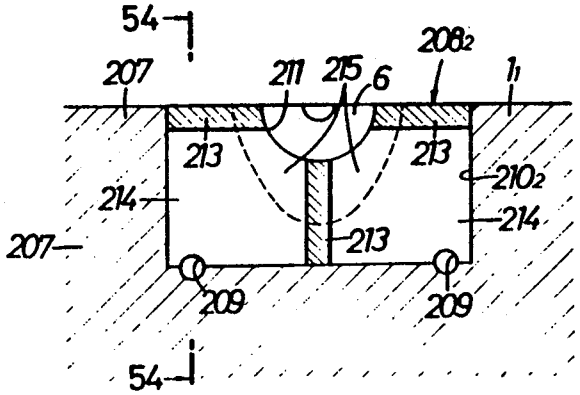
FIG. 53 is an enlarged sectional view taken along a line 53—53 in FIG. 51.
Figure 54:
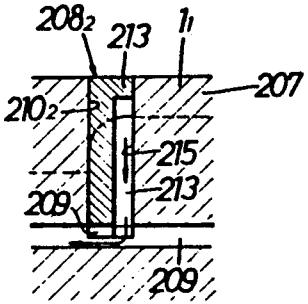
FIG. 54 is an enlarged sectional view taken along a line 54—54 in FIG. 53.

FIG. 51 illustrates a first die similar to the first die $1_1$ described in the item [XII].

As shown in FIG. 51 to 54, the first die $1_1$ comprises a mold body 207 forming a primary portion, plate-like heat resistant members $208_1$ and $208_2$ added to the mold body 207 for shaping a plurality of neck portions and a connection portion.

The mold body 207 includes a pair of air flow channels 209 made along a back side of a cavity 6, and holes $210_1$ and $210_2$ opened to the cavity 6 in neck portion-shaping and connection portion-shaping regions of the cavity 6, so that the heat resistant members $208_1$ and $208_2$ are mounted into the corresponding holes $210_1$ and $210_2$, respectively. A bottom of each of the holes $210_1$ and $210_2$ communicates with the two air flow channels 209.

Figure 55A:
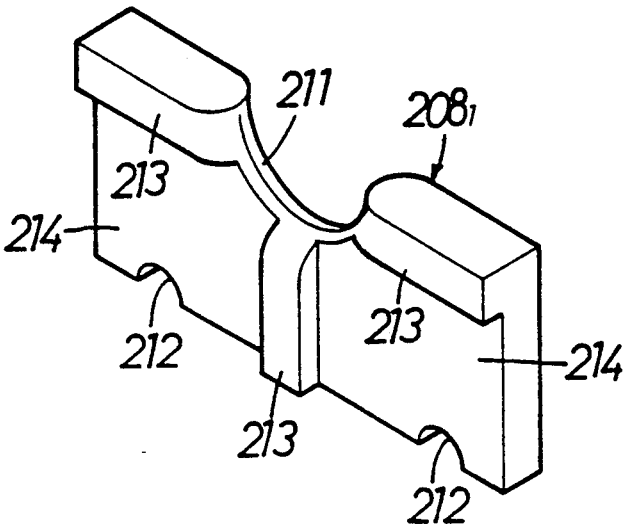
FIGS. 55A and 55B are perspective views each showing each of two types of heat resistant members.
Figure 55B:
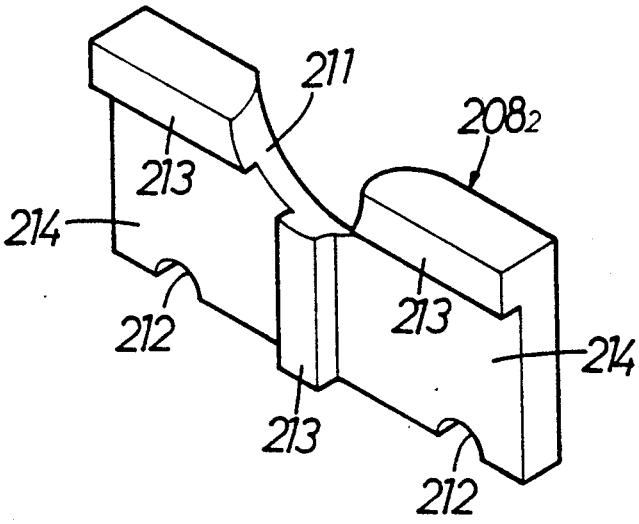

As shown in FIGS. 55A and 55B, one $208_1$ of the heat resistant members $208_1$ and $208_2$ serves to shape a neck portion 2c, and the other $208_2$ serves to shape a connection 2g. These members are substantially of the same construction and hence, description will be made of the neck portion shaping heat-resistant member $208_1$ and the description of the other $208_2$ is omitted, except that the same characters are applied to the same portions.

The heat resistant member $208_1$ is formed of a material such as a metal, a ceramic, etc., and includes a semi-annular cut recess 211 at a portion close to the cavity 6 and corresponding to the neck portion 2c, and a semi-annular cut recess 212 communicating with the both air flow channels 209. Further, the heat resistant member $208_1$ is provided on its one side face with three projections 213 abutting against an inner surface of the hole $210_1$ in the mold body 207. Two of the three projections 213 are disposed at places to sandwich an opening of the cut recess 211, and the remaining one is disposed on a bottom surface of the cut recess 211.

The height of each of the projections 213 is of 0.1 to 0.2 mm, and two slits 215 are defined between the adjacent projections 213 and between the both recesses 214 and the inner surface of the hole $210_1$. The slits permit the communication between the cavity 6 and both air flow channels 209.

The width of the slit 215 corresponds to the height of the projection 213. If the slit 215 has such a very small width, it has a function for permitting flow of air thereinto but inhibiting flow of a molten metal thereinto.

The air flow channels 209 are connected to a vacuum pump 217 and a compressor 218 through a switch valve 216.

With the above construction, in casting, both air flow channels 209 are connected to the vacuum pump 217 through the switch pump 216. During pouring of a molten metal, a gas within the cavity 6 is discharged through a vent 7 and the individual slits 215, and a gas produced after pouring is efficiently discharged through the individual slits 215.

After the resulting cam shaft blank $2_1$ has been released from the mold, both air flow channels 209 are connected to the compressor 218 through the switch valve 216, so that compressed air is supplied to both air flow channels 209. Thus, even if the solidified material which might be produced due to entering into the individual slits 215 is present in the latter, the compressed air causes such solidified material to be discharged.

[XIV] Mold for Casting Cam Shaft Blank

Figure 56:
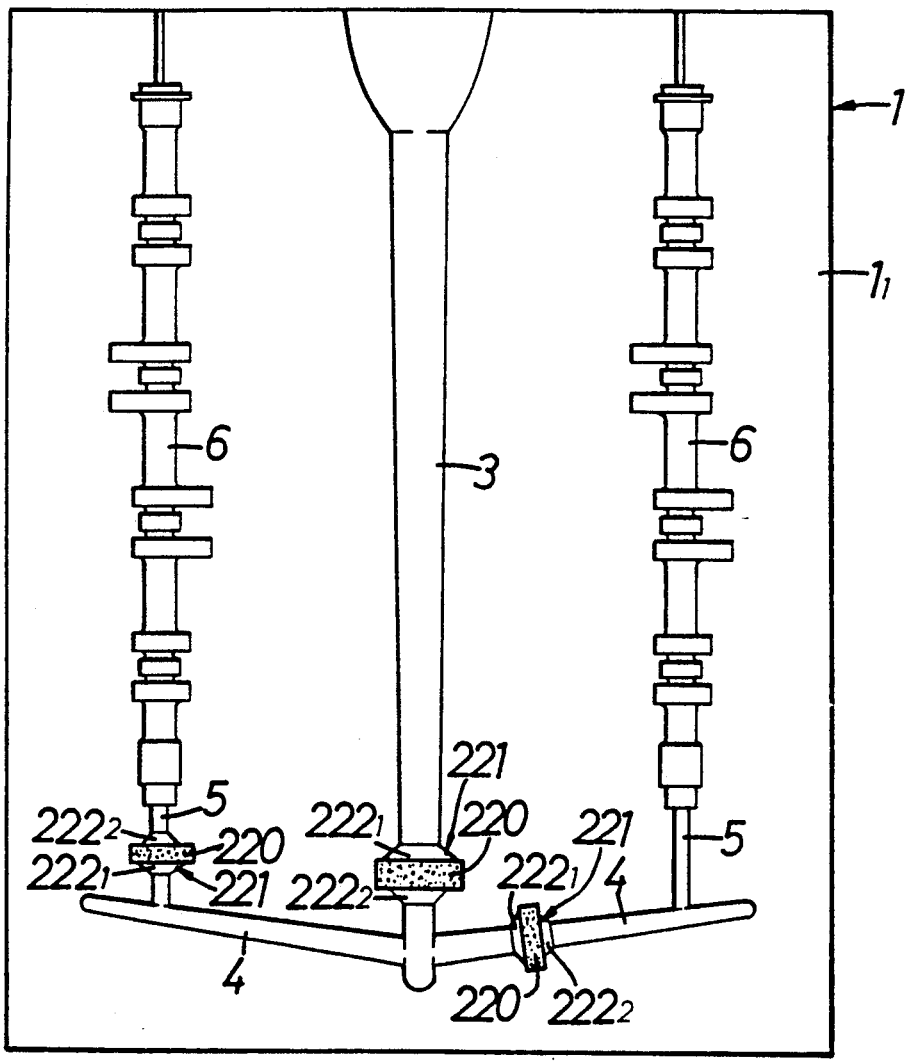
FIG. 56 is a front view of a mold, similar to FIG. 2.
Figure 57:
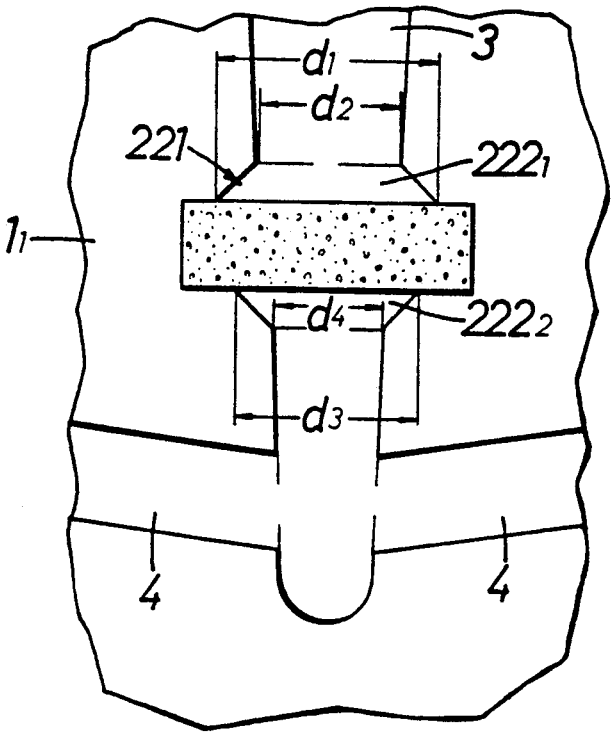
FIG. 57 is an enlarged view of details of the mold shown in FIG. 56.

FIGS. 56 and 57 illustrate a first die similar to the first die $1_1$ of the spilt type mold 1 described in the item [I] and shown in FIG. 2, but a pair of cavities 6 are provided, and the heating circuit 8 and the cooling circuit 9 or the like are omitted. A mold 1 is formed of a Cu-Cr alloy containing 0.75 to 1% by weight of Cr and has a heat conductivity of 0.2 to 0.9 cal/cm/sec./°C.

A filter 220 made of a SiC porous material having an average pore diameter of about 1–5 mm is placed in each of a molten metal passage, i.e., a sprue 3, communicating with the cavities 6, a runner 4 communicating with one of the cavities 6 and a gate 5 communicating with the other cavity 6.

In addition to SiC, a ceramic material selected from the group consisting of $Al_2O_3$, $SiO_2$, $Si_3N_4$ and the like may be used.

In each filter-placed portion 221, first and second frustoconical recesses $222_1$ and $222_2$ having larger diameter end faces opposed to each other are defined on molten metal entry and exit sides of the filter 220 in a state that the first die $1_1$ and a second die (not shown) has been mated to each other. For example, as shown in FIG. 57, the diameters d1 and d2 of a smaller diameter end face and the larger diameter end face of the first recess $222_1$ are of 20 and 30 mm, respectively, while the diameters d3 and d4 of a smaller diameter end face and the larger diameter end face of the second recess $222_2$ are of 25 and 15 mm, respectively. Accordingly, for sectional areas of the individual end faces, there is established a relationship of the larger diameter end face of the first recess $222_1$ > the larger diameter end face of the second recess $222_2$ > the smaller diameter end face of the first recess $222_1$ > the smaller diameter end face of the second recess $222_2$.

Setting of the sectional areas of the individual end faces in such a relationship enables an efficient filteration of a molten metal and also enables a throttling effect to be provided to increase the pouring rate.

After preparation of a molten metal of the same cast iron composition as that described in the item [IV], the molten metal was subjected to a similar inoculaion and then to a casting process using the mold 1 under the following conditions.

The conditions were such that a preheating temperature of the nose shaping region of the mold 1 was of about 70°–150° C.; preheating temperatures of other regions were of about 120°–450° C.; a pouring temperature was of 1380° to 1420° C.; a pouring time was of 4–15 seconds; and the amount poured was of 9 kg. After a lapse of about 3 to 8 seconds from the pouring, the temperature of the surface layer of the cam shaft blank material was at a temperature of 950° to 850° C., and when that surface layer was converted into a solidified layer, the resulting cam shaft blank was released from the mold.

The above procedure makes it possible to reduce the time required from the start of pouring to the releasing of the resulting cam shaft blank and to efficiently produce a high quality cam shaft blank 21. This is attributable to the removal of slag by each of the filters 220 and the control of running of the molten metal to suppress the inclusion of gas to the utmost. In addition, because the pouring rate is increased, it is possible to prevent a failure of running of the molten metal.

Table VI shows % incidence of casting defects when the filter 220 was used and not used. It is apparent from Table VI that the use of the filter 220 enables the % incidence of casting defects to be suppressed substantially.

TABLE VI

| Casting defect | Filter when not used | Filter When used |
|---|---|---|
| Pin hole | 50 to 60% | 2 to 3% |
| Inclusion of slag | 10 to 20% | 1 to 2% |

It should be noted that the filter 220 may be placed in the sprue 3, the runner 4 or the gate 5.

The above-described slit 215, the heat resistant members $\mathbf{201}_1$, $\mathbf{201}_2$, $\mathbf{208}_1$ and $\mathbf{208}_2$ and the filter 220 may be provided in the above-described several mold casting apparatus, as required.

What is claimed is:

1. A mold casting apparatus comprising a mold having a casting cavity and a molten metal passage communicating with said casting cavity, pressing means coupled to said mold for applying pressure to the molten metal within said casting cavity, a first cooling circuit mounted in a molten metal passage in said mold, a heating circuit mounted in a first portion of a cavity-defining portion in said mold, a second cooling circuit mounted in a second portion of said cavity-defining portion in said mold, said heating circuit, said first cooling circuit and said second cooling circuit being separate and independent from one another, a heating-temperature controller means connected to said heating circuit, and first and second cooling-temperature controller means connected to said first and second cooling circuits, respectively, said heating-temperature controller means being constructed to activate said heating circuit to heat said first portion of said cavity-defining portion prior to introduction of the molten metal into the cavity and further to reduce the output from said heating circuit after commencement of the introduction of the molten metal into the mold, said first cooling-temperature controller means being constructed to activate said first cooling circuit to rapidly cool the molten metal within said molten metal passage after introduction of the metal into said cavity, thereby closing said molten metal passage, said second cooling-temperature controller means being constructed to activate said second cooling circuit after commencement of the introduction of the molten metal into the mold to cool said second portion of said cavity-defining portion, thereby rapidly cooling the surface of the cast product in said second portion to form a shell-like solidified layer thereon, said pressing means being constructed to apply pressure to the cast product present in an unsolidified state within said casting cavity after the molten metal passage has been closed.

2. A mold casting apparatus according to claim 1 wherein said mold includes a filter in said molten metal passage, said filter being constructed to regulate flow of the molten metal.

3. A mold casting apparatus according to claim 2 wherein said filter is a porous ceramic material.

4. A mold casting apparatus according to claim 1 wherein said mold includes a convex shaping portion for producing a recessed portion in said cast product, said convex shaping portion being provided in a heat resistant member detachably mounted on a body of said mold.

5. A mold casting apparatus according to claim 4 wherein said heat resistant member is made from a shell sand.

6. A mold casting apparatus according to claim 4 wherein said heat resistant member is made of a material selected from the group consisting of metals, ceramics and carbon.

7. A mold casting apparatus according to claim 1 wherein said mold includes, an air flow channel extending along a back side of the casting cavity, said air flow channel and said casting cavity communicating with each other through a slit which permits flow of air thereinto but opposes flow of the molten metal thereinto.

8. A mold casting apparatus according to claim 6 wherein said slit is defined by an inner surface of a recessed portion formed in a body of the mold said recessed portion being open into said casting cavity, and by a recess in a heat resistant member mounted in said recessed portion, said heat resistant member defining a portion of said casting cavity.

9. A mold casting apparatus for casting a product having a first portion of a harder structure and a second portion of a softer structure, the apparatus comprising a mold having a first region for forming a first portion of a cast product, a second region for forming a second portion of the cast product which is softer than the first portion, and a heat insulating material interposed between said two regions, said mold including a heating circuit for differentially heating said two regions prior to introduction of a molten metal into the mold to maintain said first region at a lower temperature than that of said second region, said heating circuit being constructed to reduce the heat applied to said two regions in response to commencement of the introduction of molten metal into the mold and a cooling circuit separate and independent from said heating circuit and including control means for effecting rapid cooling of said first region in response to commencement of the introduction of the molten metal into the mold.

* * * * *